US010186107B2

(12) United States Patent
Kitamura et al.

(10) Patent No.: US 10,186,107 B2
(45) Date of Patent: Jan. 22, 2019

(54) GAMING MACHINE WITH EXPANDABLE SYMBOL MATRIX

(71) Applicants: Universal Entertainment Corporation, Tokyo (JP); Aruze Gaming (Hong Kong) Limited, Kowloon (HK)

(72) Inventors: Kenta Kitamura, Tokyo (JP); Hiromoto Yamauchi, Tokyo (JP); Yuki Terada, Tokyo (JP); Kensaku Yoshikawa, Tokyo (JP)

(73) Assignees: UNIVERSAL ENTERTAINMENT CORPORATION, Tokyo (JP); ARUZE GAMING (HONG KONG) LIMITED, Kowloon (HK)

( * ) Notice: Subject to any disclaimer, the term of this patent is extended or adjusted under 35 U.S.C. 154(b) by 142 days.

(21) Appl. No.: 15/276,728

(22) Filed: Sep. 26, 2016

(65) Prior Publication Data

US 2017/0092050 A1 Mar. 30, 2017

(30) Foreign Application Priority Data

Sep. 28, 2015 (JP) ..... 2015-190376

(51) Int. Cl.

| | |
|---|---|
| ***A63F 9/24*** | (2006.01) |
| ***G07F 17/32*** | (2006.01) |
| ***G07F 17/34*** | (2006.01) |

(52) U.S. Cl.

CPC ..... *G07F 17/3213* (2013.01); *G07F 17/3248* (2013.01); *G07F 17/34* (2013.01)

(58) Field of Classification Search

CPC ... G07F 17/34; G07F 17/3213; G07F 17/3267
See application file for complete search history.

(56) References Cited

U.S. PATENT DOCUMENTS

| | | | | |
|---|---|---|---|---|
| 6,544,120 | B2 * | 4/2003 | Ainsworth | G07F 17/3244 273/138.2 |
| 2003/0045345 | A1 * | 3/2003 | Berman | G07F 17/3211 463/20 |
| 2005/0159208 | A1 * | 7/2005 | Pacey | G07F 17/3211 463/20 |
| 2008/0045300 | A1 * | 2/2008 | Quayle | G07F 17/34 463/18 |
| 2010/0029368 | A1 * | 2/2010 | Hornik | G07F 17/3211 463/20 |

(Continued)

*Primary Examiner* — Steve Rowland
(74) *Attorney, Agent, or Firm* — Lex IP Meister, PLLC

(57) ABSTRACT

There is provided a gaming machine capable of providing new gaming characteristics: the number of active lines is changeable to vary a winning probability. A slot machine controls a lower image display panel having a symbol display area in which some of symbols arranged in symbol arrays are respectively rearranged in display blocks in accordance with the game. The slot machine rearranges, on a one to one basis, the symbols in the display blocks arranged in a matrix of M columns by N rows. When a predetermined condition is satisfied, the slot machine adds display blocks to the matrix in the symbol display area to form a matrix of M columns by N+α rows, and sets additional active lines in the expanded display frame, the number of the additional active lines being calculated by multiplying the number of the added rows α by a predetermined value.

9 Claims, 94 Drawing Sheets

(56) References Cited

U.S. PATENT DOCUMENTS

| | | | | |
|---|---|---|---|---|
| 2013/0065663 | A1* | 3/2013 | Johnson | G07F 17/3213 463/20 |
| 2016/0247361 | A1* | 8/2016 | Meyer | G07F 17/3225 |
| 2016/0314661 | A1* | 10/2016 | Vann | G07F 17/34 |

* cited by examiner

FIG.8

LINE PAYOUT

| SYMBOL | 1 | 2 | 3 | 4 | 5 |
|---|---|---|---|---|---|
| WILD | 0 | 5 | 50 | 100 | 300 |
| WOMAN | 0 | 2 | 20 | 40 | 100 |
| COIN | 0 | 0 | 15 | 30 | 60 |
| MIRROR | 0 | 0 | 12 | 25 | 50 |
| BOWL | 0 | 0 | 10 | 20 | 40 |
| BRACELET | 0 | 0 | 8 | 15 | 30 |
| ACE | 0 | 0 | 5 | 10 | 20 |
| KING | 0 | 0 | 4 | 9 | 18 |
| QUEEN | 0 | 0 | 3 | 8 | 16 |
| JACK | 0 | 0 | 2 | 7 | 14 |
| TEN | 0 | 0 | 1 | 6 | 12 |
| NINE | 0 | 0 | 1 | 5 | 10 |

SCATTER PAYOUT

| SYMBOL | 1 | 2 | 3 | 4 | 4 |
|---|---|---|---|---|---|
| BONUS | 0 | 0 | 1 | 0 | 0 |

FIG.9

BET CONFIGURATION

| | | | | | | MAX BET | |
|---|---|---|---|---|---|---|---|
| CONFIG_1 | 1 | 2 | 3 | 4 | 5 | 250 | |
| CONFIG_2 | 1 | 2 | 3 | 5 | 10 | 500 | ※DEFAULT |
| CONFIG_3 | 1 | 2 | 5 | 10 | 15 | 750 | |
| CONFIG_4 | 1 | 2 | 5 | 10 | 20 | 1000 | |

FIG.10A

SYMBOL ARRAYS OF VIDEO REELS FOR BASE GAME

| CODE NO. | REEL 1 | REEL 2 | REEL 3 | REEL 4 | REEL 5 |
|---|---|---|---|---|---|
| 0 | COIN | MIRROR | WILD | BRACELET | BOWL |
| 1 | COIN | MIRROR | WILD | BRACELET | BOWL |
| 2 | COIN | MIRROR | WILD | BRACELET | BOWL |
| 3 | KING | QUEEN | WOMAN | TEN | JACK |
| 4 | KING | QUEEN | WOMAN | TEN | JACK |
| 5 | KING | QUEEN | WOMAN | TEN | JACK |
| 6 | WILD | WILD | WOMAN | WILD | WILD |
| 7 | NINE | BOWL | WOMAN | ACE | NINE |
| 8 | NINE | BOWL | WOMAN | ACE | NINE |
| 9 | NINE | BOWL | WOMAN | ACE | NINE |
| 10 | MIRROR | JACK | WOMAN | COIN | BRACELET |
| 11 | MIRROR | JACK | WOMAN | COIN | BRACELET |
| 12 | MIRROR | JACK | WOMAN | COIN | BRACELET |
| 13 | BONUS | WILD | WOMAN | KING | BONUS |
| 14 | QUEEN | NINE | WOMAN | KING | TEN |
| 15 | QUEEN | NINE | BONUS | KING | TEN |
| 16 | QUEEN | NINE | ACE | WILD | TEN |
| 17 | WILD | BRACELET | ACE | MIRROR | WILD |
| 18 | BOWL | BRACELET | ACE | MIRROR | ACE |
| 19 | BOWL | BRACELET | WILD | MIRROR | ACE |
| 20 | BOWL | TEN | COIN | NINE | ACE |
| 21 | JACK | TEN | COIN | NINE | COIN |
| 22 | JACK | TEN | COIN | NINE | COIN |
| 23 | JACK | WILD | KING | WILD | COIN |
| 24 | WILD | ACE | KING | QUEEN | KING |
| 25 | NINE | ACE | KING | QUEEN | KING |
| 26 | NINE | ACE | WILD | QUEEN | KING |
| 27 | NINE | COIN | NINE | BOWL | BONUS |
| 28 | BRACELET | COIN | NINE | BOWL | MIRROR |
| 29 | BRACELET | COIN | NINE | BOWL | MIRROR |
| 30 | BRACELET | KING | MIRROR | JACK | MIRROR |
| 31 | BONUS | KING | MIRROR | JACK | NINE |
| 32 | TEN | KING | MIRROR | JACK | NINE |
| 33 | TEN | WILD | BONUS | BRACELET | NINE |
| 34 | TEN | MIRROR | QUEEN | BRACELET | WILD |

FIG.10B

SYMBOL ARRAYS OF VIDEO REELS FOR BASE GAME

| CODE NO. | REEL 1 | REEL 2 | REEL 3 | REEL 4 | REEL 5 |
|---|---|---|---|---|---|
| 35 | WILD | MIRROR | QUEEN | BRACELET | QUEEN |
| 36 | ACE | MIRROR | QUEEN | TEN | QUEEN |
| 37 | ACE | NINE | WILD | TEN | QUEEN |
| 38 | ACE | NINE | BOWL | TEN | BOWL |
| 39 | COIN | NINE | BOWL | WILD | BOWL |
| 40 | COIN | WILD | BOWL | ACE | BOWL |
| 41 | COIN | QUEEN | JACK | ACE | JACK |
| 42 | KING | QUEEN | JACK | ACE | JACK |
| 43 | KING | QUEEN | JACK | COIN | JACK |
| 44 | KING | BOWL | WILD | COIN | BONUS |
| 45 | BONUS | BOWL | NINE | COIN | BRACELET |
| 46 | MIRROR | BOWL | NINE | KING | BRACELET |
| 47 | MIRROR | JACK | NINE | KING | BRACELET |
| 48 | MIRROR | JACK | BRACELET | KING | TEN |
| 49 | NINE | JACK | BRACELET | MIRROR | TEN |
| 50 | NINE | BRACELET | BRACELET | MIRROR | TEN |
| 51 | NINE | BRACELET | BONUS | MIRROR | WILD |
| 52 | WILD | BRACELET | TEN | WILD | ACE |
| 53 | QUEEN | TEN | TEN | QUEEN | ACE |
| 54 | QUEEN | TEN | TEN | QUEEN | ACE |
| 55 | QUEEN | TEN | WILD | QUEEN | COIN |
| 56 | BOWL | WILD | ACE | BOWL | COIN |
| 57 | BOWL | ACE | ACE | BOWL | COIN |
| 58 | BOWL | ACE | ACE | BOWL | KING |
| 59 | JACK | ACE | COIN | JACK | KING |
| 60 | JACK | COIN | COIN | JACK | KING |
| 61 | JACK | COIN | COIN | JACK | MIRROR |
| 62 | BONUS | COIN | KING | WILD | MIRROR |
| 63 | BRACELET | KING | KING | BRACELET | MIRROR |
| 64 | BRACELET | KING | KING | BRACELET | WILD |
| 65 | BRACELET | KING | BONUS | BRACELET | QUEEN |
| 66 | TEN | MIRROR | MIRROR | TEN | QUEEN |
| 67 | TEN | MIRROR | MIRROR | TEN | QUEEN |
| 68 | TEN | MIRROR | MIRROR | TEN | BOWL |
| 69 | WILD | WILD | NINE | WILD | BOWL |

FIG.10C

SYMBOL ARRAYS OF VIDEO REELS FOR BASE GAME

| CODE NO. | REEL 1 | REEL 2 | REEL 3 | REEL 4 | REEL 5 |
|---|---|---|---|---|---|
| 70 | ACE | QUEEN | NINE | ACE | BOWL |
| 71 | ACE | QUEEN | NINE | ACE | BONUS |
| 72 | ACE | QUEEN | WILD | ACE | JACK |
| 73 | COIN | BOWL | QUEEN | COIN | JACK |
| 74 | COIN | BOWL | QUEEN | COIN | JACK |
| 75 | COIN | BOWL | QUEEN | COIN | WILD |
| 76 | BONUS | JACK | BOWL | KING | BRACELET |
| 77 | KING | JACK | BOWL | KING | BRACELET |
| 78 | KING | JACK | BOWL | KING | BRACELET |
| 79 | KING | WILD | JACK | MIRROR | TEN |
| 80 | MIRROR | BRACELET | JACK | MIRROR | TEN |
| 81 | MIRROR | BRACELET | JACK | MIRROR | TEN |
| 82 | MIRROR | BRACELET | BONUS | WILD | WILD |
| 83 | WILD | TEN | BRACELET | QUEEN | COIN |
| 84 | QUEEN | TEN | BRACELET | QUEEN | COIN |
| 85 | QUEEN | TEN | BRACELET | QUEEN | COIN |
| 86 | QUEEN | WILD | TEN | NINE | KING |
| 87 | BOWL | ACE | TEN | NINE | KING |
| 88 | BOWL | ACE | TEN | NINE | KING |
| 89 | BOWL | ACE | WILD | BOWL | MIRROR |
| 90 | BONUS | COIN | ACE | BOWL | MIRROR |
| 91 | JACK | COIN | ACE | BOWL | MIRROR |
| 92 | JACK | COIN | ACE | WILD | WILD |
| 93 | JACK | KING | COIN | JACK | QUEEN |
| 94 | WILD | KING | COIN | JACK | QUEEN |
| 95 | BRACELET | KING | COIN | JACK | QUEEN |
| 96 | BRACELET | MIRROR | BONUS | BRACELET | BONUS |
| 97 | BRACELET | MIRROR | KING | BRACELET | NINE |
| 98 | TEN | MIRROR | KING | BRACELET | NINE |
| 99 | TEN | WILD | KING | TEN | NINE |
| 100 | TEN | QUEEN | MIRROR | TEN | BOWL |
| 101 | WILD | QUEEN | MIRROR | TEN | BOWL |
| 102 | COIN | QUEEN | MIRROR | WILD | BOWL |
| 103 | COIN | NINE | WILD | WILD | WILD |
| 104 | COIN | NINE | QUEEN | WILD | JACK |

FIG.10D

SYMBOL ARRAYS OF VIDEO REELS FOR BASE GAME

| CODE NO. | REEL 1 | REEL 2 | REEL 3 | REEL 4 | REEL 5 |
|---|---|---|---|---|---|
| 105 | KING | NINE | QUEEN | WOMAN | JACK |
| 106 | KING | BOWL | QUEEN | WOMAN | JACK |
| 107 | KING | BOWL | BOWL | WOMAN | BRACELET |
| 108 | MIRROR | BOWL | BOWL | WOMAN | BRACELET |
| 109 | MIRROR | WILD | BOWL | WOMAN | BRACELET |
| 110 | MIRROR | JACK | BONUS | WOMAN | TEN |
| 111 | WILD | JACK | JACK | WOMAN | TEN |
| 112 | QUEEN | JACK | JACK | WOMAN | TEN |
| 113 | QUEEN | BRACELET | JACK | WOMAN | WILD |
| 114 | QUEEN | BRACELET | WILD | WOMAN | WILD |
| 115 | BONUS | BRACELET | BRACELET | WOMAN | WILD |
| 116 | NINE | TEN | BRACELET | WOMAN | WOMAN |
| 117 | NINE | TEN | BRACELET | ACE | WOMAN |
| 118 | NINE | TEN | TEN | ACE | WOMAN |
| 119 | BOWL | WILD | TEN | ACE | WOMAN |
| 120 | BOWL | WILD | TEN | COIN | WOMAN |
| 121 | BOWL | WILD | WILD | COIN | WOMAN |
| 122 | WILD | WOMAN | COIN | COIN | WOMAN |
| 123 | JACK | WOMAN | COIN | KING | WOMAN |
| 124 | JACK | WOMAN | COIN | KING | WOMAN |
| 125 | JACK | WOMAN | ACE | KING | WOMAN |
| 126 | BRACELET | WOMAN | ACE | WILD | WOMAN |
| 127 | BRACELET | WOMAN | ACE | NINE | WOMAN |
| 128 | BRACELET | WOMAN | MIRROR | NINE | BONUS |
| 129 | TEN | WOMAN | MIRROR | NINE | ACE |
| 130 | TEN | WOMAN | MIRROR | MIRROR | ACE |
| 131 | TEN | WOMAN | WILD | MIRROR | ACE |
| 132 | WILD | WOMAN | QUEEN | MIRROR | WILD |
| 133 | WILD | WOMAN | QUEEN | QUEEN | COIN |
| 134 | WILD | ACE | QUEEN | QUEEN | COIN |
| 135 | WOMAN | ACE | BONUS | QUEEN | COIN |
| 136 | WOMAN | ACE | NINE | WILD | KING |
| 137 | WOMAN | WILD | NINE | BOWL | KING |
| 138 | WOMAN | COIN | NINE | BOWL | KING |
| 139 | WOMAN | COIN | BOWL | BOWL | WILD |

FIG.10E

SYMBOL ARRAYS OF VIDEO REELS FOR BASE GAME

| CODE NO. | REEL 1 | REEL 2 | REEL 3 | REEL 4 | REEL 5 |
|---|---|---|---|---|---|
| 140 | WOMAN | COIN | BOWL | JACK | NINE |
| 141 | WOMAN | KING | BOWL | JACK | NINE |
| 142 | WOMAN | KING | WILD | JACK | NINE |
| 143 | WOMAN | KING | JACK | WILD | MIRROR |
| 144 | WOMAN | WILD | JACK | NINE | MIRROR |
| 145 | WOMAN | NINE | JACK | NINE | MIRROR |
| 146 | WOMAN | NINE | BRACELET | NINE | BONUS |
| 147 | BONUS | NINE | BRACELET | | QUEEN |
| 148 | ACE | | BRACELET | | QUEEN |
| 149 | ACE | | TEN | | QUEEN |
| 150 | ACE | | TEN | | WILD |
| 151 | WILD | | TEN | | ACE |
| 152 | MIRROR | | KING | | ACE |
| 153 | MIRROR | | KING | | ACE |
| 154 | MIRROR | | KING | | |
| 155 | TEN | | | | |
| 156 | TEN | | | | |
| 157 | TEN | | | | |
| 158 | WILD | | | | |
| 159 | | | | | |
| 160 | | | | | |
| 161 | | | | | |
| 162 | | | | | |
| 163 | | | | | |
| 164 | | | | | |
| 165 | | | | | |
| 166 | | | | | |
| 167 | | | | | |
| 168 | | | | | |
| 169 | | | | | |
| 170 | | | | | |
| 171 | | | | | |
| 172 | | | | | |
| 173 | | | | | |
| 174 | | | | | |

FIG.11A

SYMBOL ARRAYS OF VIDEO REELS FOR FREE GAME

| CODE NO. | REEL 1 | REEL 2 | REEL 3 | REEL 4 | REEL 5 |
|---|---|---|---|---|---|
| 0 | COIN | MIRROR | WILD | BRACELET | BOWL |
| 1 | COIN | MIRROR | WILD | BRACELET | BOWL |
| 2 | COIN | MIRROR | WILD | BRACELET | BOWL |
| 3 | KING | QUEEN | WOMAN | TEN | JACK |
| 4 | KING | QUEEN | WOMAN | TEN | JACK |
| 5 | KING | QUEEN | WOMAN | TEN | JACK |
| 6 | WILD | WILD | WOMAN | WILD | WILD |
| 7 | NINE | BOWL | WOMAN | ACE | NINE |
| 8 | NINE | BOWL | WOMAN | ACE | NINE |
| 9 | NINE | BOWL | WOMAN | ACE | NINE |
| 10 | MIRROR | JACK | WOMAN | COIN | BRACELET |
| 11 | MIRROR | JACK | WOMAN | COIN | BRACELET |
| 12 | MIRROR | JACK | WOMAN | COIN | BRACELET |
| 13 | BONUS | WILD | WOMAN | KING | BONUS |
| 14 | QUEEN | NINE | WOMAN | KING | TEN |
| 15 | QUEEN | NINE | BONUS | KING | TEN |
| 16 | QUEEN | NINE | ACE | WILD | TEN |
| 17 | WILD | BRACELET | ACE | MIRROR | WILD |
| 18 | BOWL | BRACELET | ACE | MIRROR | ACE |
| 19 | BOWL | BRACELET | WILD | MIRROR | ACE |
| 20 | BOWL | TEN | COIN | NINE | ACE |
| 21 | JACK | TEN | COIN | NINE | COIN |
| 22 | JACK | TEN | COIN | NINE | COIN |
| 23 | JACK | WILD | KING | WILD | COIN |
| 24 | WILD | ACE | KING | QUEEN | KING |
| 25 | NINE | ACE | KING | QUEEN | KING |
| 26 | NINE | ACE | WILD | QUEEN | KING |
| 27 | NINE | COIN | NINE | BOWL | MIRROR |
| 28 | BRACELET | COIN | NINE | BOWL | MIRROR |
| 29 | BRACELET | COIN | NINE | BOWL | MIRROR |
| 30 | BRACELET | KING | MIRROR | JACK | NINE |
| 31 | TEN | KING | MIRROR | JACK | NINE |
| 32 | TEN | KING | MIRROR | JACK | NINE |
| 33 | TEN | WILD | QUEEN | BRACELET | WILD |
| 34 | WILD | MIRROR | QUEEN | BRACELET | QUEEN |

FIG.11B

SYMBOL ARRAYS OF VIDEO REELS FOR FREE GAME

| CODE NO. | REEL 1 | REEL 2 | REEL 3 | REEL 4 | REEL 5 |
|---|---|---|---|---|---|
| 35 | ACE | MIRROR | QUEEN | BRACELET | QUEEN |
| 36 | ACE | MIRROR | WILD | TEN | QUEEN |
| 37 | ACE | NINE | BOWL | TEN | BOWL |
| 38 | COIN | NINE | BOWL | TEN | BOWL |
| 39 | COIN | NINE | BOWL | WILD | BOWL |
| 40 | COIN | WILD | JACK | ACE | JACK |
| 41 | KING | QUEEN | JACK | ACE | JACK |
| 42 | KING | QUEEN | JACK | ACE | JACK |
| 43 | KING | QUEEN | WILD | COIN | BONUS |
| 44 | BONUS | BOWL | NINE | COIN | BRACELET |
| 45 | MIRROR | BOWL | NINE | COIN | BRACELET |
| 46 | MIRROR | BOWL | NINE | KING | BRACELET |
| 47 | MIRROR | JACK | BRACELET | KING | TEN |
| 48 | NINE | JACK | BRACELET | KING | TEN |
| 49 | NINE | JACK | BRACELET | MIRROR | TEN |
| 50 | NINE | BRACELET | BONUS | MIRROR | WILD |
| 51 | WILD | BRACELET | TEN | MIRROR | ACE |
| 52 | QUEEN | BRACELET | TEN | WILD | ACE |
| 53 | QUEEN | TEN | TEN | QUEEN | ACE |
| 54 | QUEEN | TEN | WILD | QUEEN | COIN |
| 55 | BOWL | TEN | ACE | QUEEN | COIN |
| 56 | BOWL | WILD | ACE | BOWL | COIN |
| 57 | BOWL | ACE | ACE | BOWL | KING |
| 58 | JACK | ACE | COIN | BOWL | KING |
| 59 | JACK | ACE | COIN | JACK | KING |
| 60 | JACK | COIN | COIN | JACK | MIRROR |
| 61 | BRACELET | COIN | KING | JACK | MIRROR |
| 62 | BRACELET | COIN | KING | WILD | MIRROR |
| 63 | BRACELET | KING | KING | BRACELET | WILD |
| 64 | TEN | KING | MIRROR | BRACELET | QUEEN |
| 65 | TEN | KING | MIRROR | BRACELET | QUEEN |
| 66 | TEN | MIRROR | MIRROR | TEN | QUEEN |
| 67 | WILD | MIRROR | NINE | TEN | BOWL |
| 68 | ACE | MIRROR | NINE | TEN | BOWL |
| 69 | ACE | WILD | NINE | WILD | BOWL |

FIG.11C

SYMBOL ARRAYS OF VIDEO REELS FOR FREE GAME

| CODE NO. | REEL 1 | REEL 2 | REEL 3 | REEL 4 | REEL 5 |
|---|---|---|---|---|---|
| 70 | ACE | QUEEN | WILD | ACE | JACK |
| 71 | COIN | QUEEN | QUEEN | ACE | JACK |
| 72 | COIN | QUEEN | QUEEN | ACE | JACK |
| 73 | COIN | BOWL | QUEEN | COIN | WILD |
| 74 | BONUS | BOWL | BOWL | COIN | BRACELET |
| 75 | KING | BOWL | BOWL | COIN | BRACELET |
| 76 | KING | JACK | BOWL | KING | BRACELET |
| 77 | KING | JACK | JACK | KING | TEN |
| 78 | MIRROR | JACK | JACK | KING | TEN |
| 79 | MIRROR | WILD | JACK | MIRROR | TEN |
| 80 | MIRROR | BRACELET | BONUS | MIRROR | WILD |
| 81 | WILD | BRACELET | BRACELET | MIRROR | COIN |
| 82 | QUEEN | BRACELET | BRACELET | WILD | COIN |
| 83 | QUEEN | TEN | BRACELET | QUEEN | COIN |
| 84 | QUEEN | TEN | TEN | QUEEN | KING |
| 85 | BOWL | TEN | TEN | QUEEN | KING |
| 86 | BOWL | WILD | TEN | NINE | KING |
| 87 | BOWL | ACE | WILD | NINE | MIRROR |
| 88 | JACK | ACE | ACE | NINE | MIRROR |
| 89 | JACK | ACE | ACE | BOWL | MIRROR |
| 90 | JACK | COIN | ACE | BOWL | WILD |
| 91 | WILD | COIN | COIN | BOWL | QUEEN |
| 92 | BRACELET | COIN | COIN | WILD | QUEEN |
| 93 | BRACELET | KING | COIN | JACK | QUEEN |
| 94 | BRACELET | KING | KING | JACK | BONUS |
| 95 | TEN | KING | KING | JACK | NINE |
| 96 | TEN | MIRROR | KING | BRACELET | NINE |
| 97 | TEN | MIRROR | MIRROR | BRACELET | NINE |
| 98 | WILD | MIRROR | MIRROR | BRACELET | BOWL |
| 99 | COIN | WILD | MIRROR | TEN | BOWL |
| 100 | COIN | QUEEN | WILD | TEN | BOWL |
| 101 | COIN | QUEEN | QUEEN | TEN | WILD |
| 102 | KING | QUEEN | QUEEN | WILD | JACK |
| 103 | KING | NINE | QUEEN | WILD | JACK |
| 104 | KING | NINE | BOWL | WILD | JACK |

FIG.11D

SYMBOL ARRAYS OF VIDEO REELS FOR FREE GAME

| CODE NO. | REEL 1 | REEL 2 | REEL 3 | REEL 4 | REEL 5 |
|---|---|---|---|---|---|
| 105 | MIRROR | NINE | BOWL | WOMAN | BRACELET |
| 106 | MIRROR | BOWL | BOWL | WOMAN | BRACELET |
| 107 | MIRROR | BOWL | BONUS | WOMAN | BRACELET |
| 108 | WILD | BOWL | JACK | WOMAN | TEN |
| 109 | QUEEN | WILD | JACK | WOMAN | TEN |
| 110 | QUEEN | JACK | JACK | WOMAN | TEN |
| 111 | QUEEN | JACK | WILD | WOMAN | WILD |
| 112 | BONUS | JACK | BRACELET | WOMAN | WILD |
| 113 | NINE | BRACELET | BRACELET | WOMAN | WILD |
| 114 | NINE | BRACELET | BRACELET | WOMAN | WOMAN |
| 115 | NINE | BRACELET | TEN | WOMAN | WOMAN |
| 116 | BOWL | TEN | TEN | WOMAN | WOMAN |
| 117 | BOWL | TEN | TEN | ACE | WOMAN |
| 118 | BOWL | TEN | WILD | ACE | WOMAN |
| 119 | WILD | WILD | COIN | ACE | WOMAN |
| 120 | JACK | WILD | COIN | COIN | WOMAN |
| 121 | JACK | WILD | COIN | COIN | WOMAN |
| 122 | JACK | WOMAN | ACE | COIN | WOMAN |
| 123 | BRACELET | WOMAN | ACE | KING | WOMAN |
| 124 | BRACELET | WOMAN | ACE | KING | WOMAN |
| 125 | BRACELET | WOMAN | MIRROR | KING | WOMAN |
| 126 | TEN | WOMAN | MIRROR | WILD | BONUS |
| 127 | TEN | WOMAN | MIRROR | NINE | ACE |
| 128 | TEN | WOMAN | WILD | NINE | ACE |
| 129 | WILD | WOMAN | QUEEN | NINE | ACE |
| 130 | WILD | WOMAN | QUEEN | MIRROR | WILD |
| 131 | WILD | WOMAN | QUEEN | MIRROR | COIN |
| 132 | WOMAN | WOMAN | NINE | MIRROR | COIN |
| 133 | WOMAN | WOMAN | NINE | QUEEN | COIN |
| 134 | WOMAN | ACE | NINE | QUEEN | KING |
| 135 | WOMAN | ACE | BOWL | QUEEN | KING |
| 136 | WOMAN | ACE | BOWL | WILD | KING |
| 137 | WOMAN | WILD | BOWL | BOWL | WILD |
| 138 | WOMAN | COIN | WILD | BOWL | NINE |
| 139 | WOMAN | COIN | JACK | BOWL | NINE |

FIG.11E

SYMBOL ARRAYS OF VIDEO REELS FOR FREE GAME

| CODE NO. | REEL 1 | REEL 2 | REEL 3 | REEL 4 | REEL 5 |
|---|---|---|---|---|---|
| 140 | WOMAN | COIN | JACK | JACK | NINE |
| 141 | WOMAN | KING | JACK | JACK | MIRROR |
| 142 | WOMAN | KING | BRACELET | JACK | MIRROR |
| 143 | WOMAN | KING | BRACELET | WILD | MIRROR |
| 144 | BONUS | WILD | BRACELET | NINE | QUEEN |
| 145 | ACE | NINE | TEN | NINE | QUEEN |
| 146 | ACE | NINE | TEN | NINE | QUEEN |
| 147 | ACE | NINE | TEN | | WILD |
| 148 | WILD | | | | |
| 149 | | | | | |
| 150 | | | | | |
| 151 | | | | | |
| 152 | | | | | |
| 153 | | | | | |
| 154 | | | | | |
| 155 | | | | | |
| 156 | | | | | |
| 157 | | | | | |
| 158 | | | | | |
| 159 | | | | | |
| 160 | | | | | |
| 161 | | | | | |
| 162 | | | | | |
| 163 | | | | | |
| 164 | | | | | |
| 165 | | | | | |
| 166 | | | | | |
| 167 | | | | | |
| 168 | | | | | |
| 169 | | | | | |
| 170 | | | | | |
| 171 | | | | | |
| 172 | | | | | |
| 173 | | | | | |
| 174 | | | | | |

FIG.12

BASE GAME WINDOW NUMBER RANDOM DETERMINATION TABLE

| ID | NUMBER OF ACTIVE WINDOWS | | | | | WEIGHT | PROBABILITY |
|---|---|---|---|---|---|---|---|
| | R1 | R2 | R3 | R4 | R5 | | |
| 0 | 3 | 3 | 3 | 3 | 3 | 940 | 94.00% |
| 1 | 4 | 4 | 4 | 4 | 4 | 6 | 0.60% |
| 2 | 5 | 5 | 5 | 5 | 5 | 6 | 0.60% |
| 3 | 6 | 6 | 6 | 6 | 6 | 7 | 0.70% |
| 4 | 7 | 7 | 7 | 7 | 7 | 7 | 0.70% |
| 5 | 8 | 8 | 8 | 8 | 8 | 8 | 0.80% |
| 6 | 9 | 9 | 9 | 9 | 9 | 7 | 0.70% |
| 7 | 10 | 10 | 10 | 10 | 10 | 7 | 0.70% |
| 8 | 11 | 11 | 11 | 11 | 11 | 6 | 0.60% |
| 9 | 12 | 12 | 12 | 12 | 12 | 6 | 0.60% |
| | – | – | – | – | – | 1000 | 100.00% |

FIG.13

FREE GAME WINDOW NUMBER RANDOM DETERMINATION TABLE

| ID | NUMBER OF ACTIVE WINDOWS | | | | | WEIGHT | PROBABILITY |
|---|---|---|---|---|---|---|---|
| | R1 | R2 | R3 | R4 | R5 | | |
| 0 | 3 | 3 | 3 | 3 | 3 | 50 | 50.00% |
| 1 | 4 | 4 | 4 | 4 | 4 | 5 | 5.00% |
| 2 | 5 | 5 | 5 | 5 | 5 | 5 | 5.00% |
| 3 | 6 | 6 | 6 | 6 | 6 | 6 | 6.00% |
| 4 | 7 | 7 | 7 | 7 | 7 | 6 | 6.00% |
| 5 | 8 | 8 | 8 | 8 | 8 | 6 | 6.00% |
| 6 | 9 | 9 | 9 | 9 | 9 | 6 | 6.00% |
| 7 | 10 | 10 | 10 | 10 | 10 | 6 | 6.00% |
| 8 | 11 | 11 | 11 | 11 | 11 | 5 | 5.00% |
| 9 | 12 | 12 | 12 | 12 | 12 | 5 | 5.00% |
| | – | – | – | – | – | 100 | 100.00% |

FIG.14

REEL POSITION NUMBER TABLE

| R1 | R2 | R3 | R4 | R5 | |
|---|---|---|---|---|---|
| 0 | 0 | 0 | 0 | 0 | 1st STAGE |
| 1 | 1 | 1 | 1 | 1 | 2nd STAGE |
| 2 | 2 | 2 | 2 | 2 | 3rd STAGE |
| 3 | 3 | 3 | 3 | 3 | 4th STAGE |
| 4 | 4 | 4 | 4 | 4 | 5th STAGE |
| 5 | 5 | 5 | 5 | 5 | 6th STAGE |
| 6 | 6 | 6 | 6 | 6 | 7th STAGE |
| 7 | 7 | 7 | 7 | 7 | 8th STAGE |
| 8 | 8 | 8 | 8 | 8 | 9th STAGE |
| 9 | 9 | 9 | 9 | 9 | 10th STAGE |
| 10 | 10 | 10 | 10 | 10 | 11th STAGE |
| 11 | 11 | 11 | 11 | 11 | 12th STAGE |

FIG.15A

ACTIVE LINE SETTING TABLE

| No. | R1 | R2 | R3 | R4 | R5 |
|---|---|---|---|---|---|
| 1 | 10 | 10 | 10 | 10 | 10 |
| 2 | 9 | 9 | 9 | 9 | 9 |
| 3 | 11 | 11 | 11 | 11 | 11 |
| 4 | 9 | 10 | 11 | 10 | 9 |
| 5 | 11 | 10 | 9 | 10 | 11 |
| 6 | 9 | 11 | 9 | 11 | 9 |
| 7 | 11 | 9 | 11 | 9 | 11 |
| 8 | 10 | 9 | 10 | 9 | 10 |
| 9 | 10 | 11 | 10 | 11 | 10 |
| 10 | 9 | 9 | 10 | 9 | 9 |
| 11 | 11 | 11 | 10 | 11 | 11 |
| 12 | 9 | 10 | 9 | 10 | 9 |
| 13 | 11 | 10 | 11 | 10 | 11 |
| 14 | 10 | 10 | 9 | 10 | 10 |
| 15 | 10 | 10 | 11 | 10 | 10 |
| 16 | 10 | 9 | 9 | 9 | 10 |
| 17 | 10 | 11 | 11 | 11 | 10 |
| 18 | 9 | 10 | 10 | 10 | 9 |
| 19 | 11 | 10 | 10 | 10 | 11 |
| 20 | 9 | 9 | 10 | 11 | 11 |
| 21 | 8 | 8 | 8 | 8 | 8 |
| 22 | 8 | 9 | 10 | 9 | 8 |
| 23 | 10 | 9 | 8 | 9 | 10 |
| 24 | 9 | 8 | 9 | 8 | 9 |
| 25 | 8 | 8 | 9 | 8 | 8 |
| 26 | 8 | 9 | 8 | 9 | 8 |
| 27 | 9 | 9 | 8 | 9 | 9 |
| 28 | 9 | 8 | 8 | 8 | 9 |
| 29 | 8 | 9 | 9 | 9 | 8 |
| 30 | 8 | 8 | 9 | 10 | 10 |
| 31 | 7 | 7 | 7 | 7 | 7 |
| 32 | 7 | 8 | 9 | 8 | 7 |
| 33 | 9 | 8 | 7 | 8 | 9 |
| 34 | 8 | 7 | 8 | 7 | 8 |

| No. | R1 | R2 | R3 | R4 | R5 |
|---|---|---|---|---|---|
| 35 | 7 | 7 | 8 | 7 | 7 |
| 36 | 7 | 8 | 7 | 8 | 7 |
| 37 | 8 | 8 | 7 | 8 | 8 |
| 38 | 8 | 7 | 7 | 7 | 8 |
| 39 | 7 | 8 | 8 | 8 | 7 |
| 40 | 7 | 7 | 8 | 9 | 9 |
| 41 | 6 | 6 | 6 | 6 | 6 |
| 42 | 6 | 7 | 8 | 7 | 6 |
| 43 | 8 | 7 | 6 | 7 | 8 |
| 44 | 7 | 6 | 7 | 6 | 7 |
| 45 | 6 | 6 | 7 | 6 | 6 |
| 46 | 6 | 7 | 6 | 7 | 6 |
| 47 | 7 | 7 | 6 | 7 | 7 |
| 48 | 7 | 6 | 6 | 6 | 7 |
| 49 | 6 | 7 | 7 | 7 | 6 |
| 50 | 6 | 6 | 7 | 8 | 8 |
| 51 | 5 | 5 | 5 | 5 | 5 |
| 52 | 5 | 6 | 7 | 6 | 5 |
| 53 | 7 | 6 | 5 | 6 | 7 |
| 54 | 6 | 5 | 6 | 5 | 6 |
| 55 | 5 | 5 | 6 | 5 | 5 |
| 56 | 5 | 6 | 5 | 6 | 5 |
| 57 | 6 | 6 | 5 | 6 | 6 |
| 58 | 6 | 5 | 5 | 5 | 6 |
| 59 | 5 | 6 | 6 | 6 | 5 |
| 60 | 5 | 5 | 6 | 7 | 7 |
| 61 | 4 | 4 | 4 | 4 | 4 |
| 62 | 4 | 5 | 6 | 5 | 4 |
| 63 | 6 | 5 | 4 | 5 | 6 |
| 64 | 5 | 4 | 5 | 4 | 5 |
| 65 | 4 | 4 | 5 | 4 | 4 |
| 66 | 4 | 5 | 4 | 5 | 4 |
| 67 | 5 | 5 | 4 | 5 | 5 |
| 68 | 5 | 4 | 4 | 4 | 5 |

FIG.15B

ACTIVE LINE SETTING TABLE

| No. | R1 | R2 | R3 | R4 | R5 |
|---|---|---|---|---|---|
| 69 | 4 | 5 | 5 | 5 | 4 |
| 70 | 4 | 4 | 5 | 6 | 6 |
| 71 | 3 | 3 | 3 | 3 | 3 |
| 72 | 3 | 4 | 5 | 4 | 3 |
| 73 | 5 | 4 | 3 | 4 | 5 |
| 74 | 4 | 3 | 4 | 3 | 4 |
| 75 | 3 | 3 | 4 | 3 | 3 |
| 76 | 3 | 4 | 3 | 4 | 3 |
| 77 | 4 | 4 | 3 | 4 | 4 |
| 78 | 4 | 3 | 3 | 3 | 4 |
| 79 | 3 | 4 | 4 | 4 | 3 |
| 80 | 3 | 3 | 4 | 5 | 5 |
| 81 | 2 | 2 | 2 | 2 | 2 |
| 82 | 2 | 3 | 4 | 3 | 2 |
| 83 | 4 | 3 | 2 | 3 | 4 |
| 84 | 3 | 2 | 3 | 2 | 3 |
| 85 | 2 | 2 | 3 | 2 | 2 |
| 86 | 2 | 3 | 2 | 3 | 2 |
| 87 | 3 | 3 | 2 | 3 | 3 |
| 88 | 3 | 2 | 2 | 2 | 3 |
| 89 | 2 | 3 | 3 | 3 | 2 |
| 90 | 2 | 2 | 3 | 4 | 4 |
| 91 | 1 | 1 | 1 | 1 | 1 |
| 92 | 1 | 2 | 3 | 2 | 1 |
| 93 | 3 | 2 | 1 | 2 | 3 |
| 94 | 2 | 1 | 2 | 1 | 2 |
| 95 | 1 | 1 | 2 | 1 | 1 |
| 96 | 1 | 2 | 1 | 2 | 1 |
| 97 | 2 | 2 | 1 | 2 | 2 |
| 98 | 2 | 1 | 1 | 1 | 2 |
| 99 | 1 | 2 | 2 | 2 | 1 |
| 100 | 1 | 1 | 2 | 3 | 3 |
| 101 | 0 | 0 | 0 | 0 | 0 |
| 102 | 0 | 1 | 2 | 1 | 0 |

| No. | R1 | R2 | R3 | R4 | R5 |
|---|---|---|---|---|---|
| 103 | 2 | 1 | 0 | 1 | 2 |
| 104 | 1 | 0 | 1 | 0 | 1 |
| 105 | 0 | 0 | 1 | 0 | 0 |
| 106 | 0 | 1 | 0 | 1 | 0 |
| 107 | 1 | 1 | 0 | 1 | 1 |
| 108 | 1 | 0 | 0 | 0 | 1 |
| 109 | 0 | 1 | 1 | 1 | 0 |
| 110 | 0 | 0 | 1 | 2 | 2 |

FIG.16A

BASIC ACTIVE LINE SET

| No. | R1 | R2 | R3 | R4 | R5 |
|---|---|---|---|---|---|
| 1 | 10 | 10 | 10 | 10 | 10 |
| 2 | 9 | 9 | 9 | 9 | 9 |
| 3 | 11 | 11 | 11 | 11 | 11 |
| 4 | 9 | 10 | 11 | 10 | 9 |
| 5 | 11 | 10 | 9 | 10 | 11 |
| 6 | 9 | 11 | 9 | 11 | 9 |
| 7 | 11 | 9 | 11 | 9 | 11 |
| 8 | 10 | 9 | 10 | 9 | 10 |
| 9 | 10 | 11 | 10 | 11 | 10 |
| 10 | 9 | 9 | 10 | 9 | 9 |
| 11 | 11 | 11 | 10 | 11 | 11 |
| 12 | 9 | 10 | 9 | 10 | 9 |
| 13 | 11 | 10 | 11 | 10 | 11 |
| 14 | 10 | 10 | 9 | 10 | 10 |
| 15 | 10 | 10 | 11 | 10 | 10 |
| 16 | 10 | 9 | 9 | 9 | 10 |
| 17 | 10 | 11 | 11 | 11 | 10 |
| 18 | 9 | 10 | 10 | 10 | 9 |
| 19 | 11 | 10 | 10 | 10 | 11 |
| 20 | 9 | 9 | 10 | 11 | 11 |

ADDITIONAL ACTIVE LINE SET CANDIDATES

| R1 | R2 | R3 | R4 | R5 | |
|---|---|---|---|---|---|
| 9 | 9 | 9 | 9 | 9 | OVERLAP |
| 8 | 8 | 8 | 8 | 8 | |
| 10 | 10 | 10 | 10 | 10 | OVERLAP |
| 8 | 9 | 10 | 9 | 8 | |
| 10 | 9 | 8 | 9 | 10 | |
| 8 | 10 | 8 | 10 | 8 | |
| 10 | 8 | 10 | 8 | 10 | |
| 9 | 8 | 9 | 8 | 9 | |
| 9 | 10 | 9 | 10 | 9 | OVERLAP |
| 8 | 8 | 9 | 8 | 8 | |
| 10 | 10 | 9 | 10 | 10 | OVERLAP |
| 8 | 9 | 8 | 9 | 8 | |
| 10 | 9 | 10 | 9 | 10 | OVERLAP |
| 9 | 9 | 8 | 9 | 9 | |
| 9 | 9 | 10 | 9 | 9 | OVERLAP |
| 9 | 8 | 8 | 8 | 9 | |
| 9 | 10 | 10 | 10 | 9 | OVERLAP |
| 8 | 9 | 9 | 9 | 8 | |
| 10 | 9 | 9 | 9 | 10 | OVERLAP |
| 8 | 8 | 9 | 10 | 10 | |

ADDITIONAL ACTIVE LINE SET

| No. | R1 | R2 | R3 | R4 | R5 |
|---|---|---|---|---|---|
| 21 | 8 | 8 | 8 | 8 | 8 |
| 22 | 8 | 9 | 10 | 9 | 8 |
| 23 | 10 | 9 | 8 | 9 | 10 |
| 24 | 9 | 8 | 9 | 8 | 9 |
| 25 | 8 | 8 | 9 | 8 | 8 |
| 26 | 8 | 9 | 8 | 9 | 8 |
| 27 | 9 | 9 | 8 | 9 | 9 |
| 28 | 9 | 8 | 8 | 8 | 9 |
| 29 | 8 | 9 | 9 | 9 | 8 |
| 30 | 8 | 8 | 9 | 10 | 10 |

FIG.52

BASE GAME MYSTERY FEATURE TRIGGER RANDOM DETERMINATION TABLE

| ID | RESULT | (WEIGHT FOR THE NUMBER OF ROWS) | | | | | | | | | |
|---|---|---|---|---|---|---|---|---|---|---|---|
| | | 3 ROWS | 4 ROWS | 5 ROWS | 6 ROWS | 7 ROWS | 8 ROWS | 9 ROWS | 10 ROWS | 11 ROWS | 12 ROWS |
| 0 | NOT TRIGGERED | 1 | 2 | 2 | 2 | 2 | 2 | 2 | 2 | 2 | 2 |
| 1 | TRIGGERED | 0 | 1 | 1 | 1 | 1 | 1 | 1 | 1 | 1 | 1 |
| | TOTAL | 0 | 3 | 3 | 3 | 3 | 3 | 3 | 3 | 3 | 3 |

FIG.53

FREE GAME MYSTERY FEATURE TRIGGER RANDOM DETERMINATION TABLE

| ID | RESULT | (WEIGHT FOR THE NUMBER OF ROWS) | | | | | | | | | |
|---|---|---|---|---|---|---|---|---|---|---|---|
| | | 3 ROWS | 4 ROWS | 5 ROWS | 6 ROWS | 7 ROWS | 8 ROWS | 9 ROWS | 10 ROWS | 11 ROWS | 12 ROWS |
| 0 | NOT TRIGGERED | 1 | 1 | 1 | 1 | 1 | 1 | 1 | 1 | 1 | 1 |
| 1 | TRIGGERED | 0 | 1 | 1 | 1 | 1 | 1 | 1 | 1 | 1 | 1 |
| | TOTAL | 1 | 2 | 2 | 2 | 2 | 2 | 2 | 2 | 2 | 2 |

FIG.54

BASE GAME FEATURE RANDOM DETERMINATION TABLE

| ID | RESULT | (WEIGHT FOR THE NUMBER OF ROWS) | | | | | | | | | |
|---|---|---|---|---|---|---|---|---|---|---|---|
| | | 3 ROWS | 4 ROWS | 5 ROWS | 6 ROWS | 7 ROWS | 8 ROWS | 9 ROWS | 10 ROWS | 11 ROWS | 12 ROWS |
| 0 | EXPAND | – | 2 | 2 | 2 | 2 | 2 | 2 | 2 | 2 | 2 |
| 1 | LAVA | – | 1 | 1 | 1 | 1 | 1 | 1 | 1 | 1 | 1 |
| | TOTAL | 0 | 3 | 3 | 3 | 3 | 3 | 3 | 3 | 3 | 3 |

FIG.55

FREE GAME FEATURE RANDOM DETERMINATION TABLE

| ID | RESULT | (WEIGHT FOR THE NUMBER OF ROWS) | | | | | | | | | |
|---|---|---|---|---|---|---|---|---|---|---|---|
| | | 3 ROWS | 4 ROWS | 5 ROWS | 6 ROWS | 7 ROWS | 8 ROWS | 9 ROWS | 10 ROWS | 11 ROWS | 12 ROWS |
| 0 | EXPAND | – | 2 | 2 | 2 | 2 | 2 | 2 | 2 | 2 | 2 |
| 1 | LAVA | – | 1 | 1 | 1 | 1 | 1 | 1 | 1 | 1 | 1 |
| | TOTAL | 0 | 3 | 3 | 3 | 3 | 3 | 3 | 3 | 3 | 3 |

FIG.56

BASE GAME WILD REEL RANDOM DETERMINATION TABLE

| ID | R1 | R2 | R3 | R4 | R5 | WEIGHT |
|---|---|---|---|---|---|---|
| 0 | W1 | W1 | W1 | W1 | W1 | 1 |
| 1 | ¥W1 | W1 | W1 | W1 | W1 | 2 |
| 2 | W1 | ¥W1 | W1 | W1 | W1 | 2 |
| 3 | W1 | W1 | ¥W1 | W1 | W1 | 2 |
| 4 | W1 | W1 | W1 | ¥W1 | W1 | 2 |
| 5 | W1 | W1 | W1 | W1 | ¥W1 | 2 |
| 6 | ¥W1 | ¥W1 | W1 | W1 | W1 | 11 |
| 7 | ¥W1 | W1 | ¥W1 | W1 | W1 | 12 |
| 8 | ¥W1 | W1 | W1 | ¥W1 | W1 | 10 |
| 9 | ¥W1 | W1 | W1 | W1 | ¥W1 | 4 |
| 10 | W1 | ¥W1 | ¥W1 | W1 | W1 | 10 |
| 11 | W1 | ¥W1 | W1 | ¥W1 | W1 | 10 |
| 12 | W1 | ¥W1 | W1 | W1 | ¥W1 | 4 |
| 13 | W1 | W1 | ¥W1 | ¥W1 | W1 | 10 |
| 14 | W1 | W1 | ¥W1 | W1 | ¥W1 | 4 |
| 15 | W1 | W1 | W1 | ¥W1 | ¥W1 | 4 |
| 16 | ¥W1 | ¥W1 | ¥W1 | W1 | W1 | 40 |
| 17 | ¥W1 | ¥W1 | W1 | ¥W1 | W1 | 40 |
| 18 | ¥W1 | ¥W1 | W1 | W1 | ¥W1 | 40 |
| 19 | ¥W1 | W1 | ¥W1 | ¥W1 | W1 | 40 |
| 20 | ¥W1 | W1 | ¥W1 | W1 | ¥W1 | 40 |
| 21 | ¥W1 | W1 | W1 | ¥W1 | ¥W1 | 20 |
| 22 | W1 | ¥W1 | ¥W1 | ¥W1 | W1 | 40 |
| 23 | W1 | ¥W1 | ¥W1 | W1 | ¥W1 | 40 |
| 24 | W1 | ¥W1 | W1 | ¥W1 | ¥W1 | 20 |
| 25 | W1 | W1 | ¥W1 | ¥W1 | ¥W1 | 20 |
| 26 | ¥W1 | ¥W1 | ¥W1 | ¥W1 | W1 | 10 |
| 27 | ¥W1 | ¥W1 | ¥W1 | W1 | ¥W1 | 10 |
| 28 | ¥W1 | ¥W1 | W1 | ¥W1 | ¥W1 | 10 |
| 29 | ¥W1 | W1 | ¥W1 | ¥W1 | ¥W1 | 20 |
| 30 | W1 | ¥W1 | ¥W1 | ¥W1 | ¥W1 | 20 |
| | | | | | Total | 500 |

FIG.57

FREE GAME WILD REEL RANDOM DETERMINATION TABLE

| ID | R1 | R2 | R3 | R4 | R5 | WEIGHT |
|---|---|---|---|---|---|---|
| 0 | W1 | W1 | W1 | W1 | W1 | 1 |
| 1 | ¥W1 | W1 | W1 | W1 | W1 | 2 |
| 2 | W1 | ¥W1 | W1 | W1 | W1 | 2 |
| 3 | W1 | W1 | ¥W1 | W1 | W1 | 2 |
| 4 | W1 | W1 | W1 | ¥W1 | W1 | 2 |
| 5 | W1 | W1 | W1 | W1 | ¥W1 | 2 |
| 6 | ¥W1 | ¥W1 | W1 | W1 | W1 | 11 |
| 7 | ¥W1 | W1 | ¥W1 | W1 | W1 | 12 |
| 8 | ¥W1 | W1 | W1 | ¥W1 | W1 | 10 |
| 9 | ¥W1 | W1 | W1 | W1 | ¥W1 | 4 |
| 10 | W1 | ¥W1 | ¥W1 | W1 | W1 | 10 |
| 11 | W1 | ¥W1 | W1 | ¥W1 | W1 | 10 |
| 12 | W1 | ¥W1 | W1 | W1 | ¥W1 | 4 |
| 13 | W1 | W1 | ¥W1 | ¥W1 | W1 | 10 |
| 14 | W1 | W1 | ¥W1 | W1 | ¥W1 | 4 |
| 15 | W1 | W1 | W1 | ¥W1 | ¥W1 | 4 |
| 16 | ¥W1 | ¥W1 | ¥W1 | W1 | W1 | 40 |
| 17 | ¥W1 | ¥W1 | W1 | ¥W1 | W1 | 40 |
| 18 | ¥W1 | ¥W1 | W1 | W1 | ¥W1 | 40 |
| 19 | ¥W1 | W1 | ¥W1 | ¥W1 | W1 | 40 |
| 20 | ¥W1 | W1 | ¥W1 | W1 | ¥W1 | 40 |
| 21 | ¥W1 | W1 | W1 | ¥W1 | ¥W1 | 20 |
| 22 | W1 | ¥W1 | ¥W1 | ¥W1 | W1 | 40 |
| 23 | W1 | ¥W1 | ¥W1 | W1 | ¥W1 | 40 |
| 24 | W1 | ¥W1 | W1 | ¥W1 | ¥W1 | 20 |
| 25 | W1 | W1 | ¥W1 | ¥W1 | ¥W1 | 20 |
| 26 | ¥W1 | ¥W1 | ¥W1 | ¥W1 | W1 | 10 |
| 27 | ¥W1 | ¥W1 | ¥W1 | W1 | ¥W1 | 10 |
| 28 | ¥W1 | ¥W1 | W1 | ¥W1 | ¥W1 | 10 |
| 29 | ¥W1 | W1 | ¥W1 | ¥W1 | ¥W1 | 20 |
| 30 | W1 | ¥W1 | ¥W1 | ¥W1 | ¥W1 | 20 |
| | | | | | Total | 500 |

FIG.58

BASE GAME WILD CHANGE POSITION RANDOM DETERMINATION TABLE

| ID | COMBINATION | | | | | | | | | | | | WEIGHT | PROBABILITY |
|---|---|---|---|---|---|---|---|---|---|---|---|---|---|---|
| | Pos_0 | Pos_1 | Pos_2 | Pos_3 | Pos_4 | Pos_5 | Pos_6 | Pos_7 | Pos_8 | Pos_9 | Pos_10 | Pos_11 | | |
| 0 | R_1 | R_2 | R_3 | R_4 | R_5 | R_5 | R_5 | R_5 | R_5 | R_5 | R_5 | R_5 | 1 | 0.02% |
| 1 | R_1 | R_2 | R_3 | R_4 | R_5 | R_5 | R_5 | R_5 | R_5 | R_5 | R_5 | R_4 | 1 | 0.02% |
| 2 | R_1 | R_2 | R_3 | R_4 | R_5 | R_5 | R_5 | R_5 | R_5 | R_5 | R_4 | R_5 | 1 | 0.02% |
| 3 | R_1 | R_2 | R_3 | R_4 | R_5 | R_5 | R_5 | R_5 | R_5 | R_4 | R_5 | R_3 | 1 | 0.02% |
| 4 | R_1 | R_2 | R_3 | R_4 | R_5 | R_5 | R_5 | R_5 | R_5 | R_4 | R_5 | R_4 | 1 | 0.02% |
| 5 | R_1 | R_2 | R_3 | R_4 | R_5 | R_5 | R_5 | R_5 | R_5 | R_4 | R_3 | R_4 | 1 | 0.02% |
| ... | ... | ... | ... | ... | ... | ... | ... | ... | ... | ... | ... | ... | ... | ... |
| 2048 | R_1 & $\bar{R}$_5 | R_2 & $\bar{R}$_4 | R_3 & $\bar{R}$_3 | R_4 & $\bar{R}$_2 | R_5 & $\bar{R}$_1 | R_5 & $\bar{R}$_1 | R_5 & $\bar{R}$_1 | R_5 & $\bar{R}$_1 | R_5 & $\bar{R}$_1 | R_5 & $\bar{R}$_1 | R_5 & $\bar{R}$_2 | R_5 & $\bar{R}$_1 | 2 | 0.05% |
| 2049 | R_1 & $\bar{R}$_5 | R_2 & $\bar{R}$_4 | R_3 & $\bar{R}$_3 | R_4 & $\bar{R}$_2 | R_5 & $\bar{R}$_1 | R_5 & $\bar{R}$_1 | R_5 & $\bar{R}$_1 | R_5 & $\bar{R}$_1 | R_5 & $\bar{R}$_1 | R_5 & $\bar{R}$_2 | R_5 & $\bar{R}$_1 | R_5 & $\bar{R}$_2 | 2 | 0.05% |
| 2050 | R_1 & $\bar{R}$_5 | R_2 & $\bar{R}$_4 | R_3 & $\bar{R}$_3 | R_4 & $\bar{R}$_2 | R_5 & $\bar{R}$_1 | R_5 & $\bar{R}$_1 | R_5 & $\bar{R}$_1 | R_5 & $\bar{R}$_1 | R_5 & $\bar{R}$_2 | R_5 & $\bar{R}$_1 | R_4 & $\bar{R}$_1 | R_5 & $\bar{R}$_1 | 2 | 0.05% |
| 2051 | R_1 & $\bar{R}$_5 | R_2 & $\bar{R}$_4 | R_3 & $\bar{R}$_3 | R_4 & $\bar{R}$_2 | R_5 & $\bar{R}$_1 | R_5 & $\bar{R}$_1 | R_5 & $\bar{R}$_1 | R_5 & $\bar{R}$_1 | R_5 & $\bar{R}$_2 | R_5 & $\bar{R}$_1 | R_4 & $\bar{R}$_2 | R_3 & $\bar{R}$_3 | 2 | 0.05% |
| ... | ... | ... | ... | ... | ... | ... | ... | ... | ... | ... | ... | ... | ... | ... |
| 3070 | R_1 & $\bar{R}$_5 | R_2 & $\bar{R}$_4 | R_1 & $\bar{R}$_5 | R_1 & $\bar{R}$_5 | R_1 & $\bar{R}$_5 | R_1 & $\bar{R}$_5 | R_1 & $\bar{R}$_5 | R_1 & $\bar{R}$_5 | R_1 & $\bar{R}$_5 | R_1 & $\bar{R}$_5 | R_1 & $\bar{R}$_4 | R_2 & $\bar{R}$_3 | 2 | 0.05% |
| 3071 | R_1 & $\bar{R}$_5 | R_2 & $\bar{R}$_4 | R_1 & $\bar{R}$_5 | R_1 & $\bar{R}$_5 | R_1 & $\bar{R}$_5 | R_1 & $\bar{R}$_5 | R_1 & $\bar{R}$_5 | R_1 & $\bar{R}$_5 | R_1 & $\bar{R}$_5 | R_1 & $\bar{R}$_5 | R_1 & $\bar{R}$_5 | R_1 & $\bar{R}$_5 | 2 | 0.05% |
| TOTAL | – | – | – | – | – | – | – | – | – | – | – | – | 4096 | 100.00% |

FIG.59

FREE GAME WILD CHANGE POSITION RANDOM DETERMINATION TABLE

| ID | COMBINATION | | | | | | | | | | | | WEIGHT | PROBABILITY |
|---|---|---|---|---|---|---|---|---|---|---|---|---|---|---|
| | Pos_0 | Pos_1 | Pos_2 | Pos_3 | Pos_4 | Pos_5 | Pos_6 | Pos_7 | Pos_8 | Pos_9 | Pos_10 | Pos_11 | | |
| 0 | R_1 | R_2 | R_3 | R_4 | R_5 | R_5 | R_5 | R_5 | R_5 | R_5 | R_5 | R_5 | 1 | 0.02% |
| 1 | R_1 | R_2 | R_3 | R_4 | R_5 | R_5 | R_5 | R_5 | R_5 | R_5 | R_5 | R_4 | 1 | 0.02% |
| 2 | R_1 | R_2 | R_3 | R_4 | R_5 | R_5 | R_5 | R_5 | R_5 | R_5 | R_4 | R_5 | 1 | 0.02% |
| 3 | R_1 | R_2 | R_3 | R_4 | R_5 | R_5 | R_5 | R_5 | R_5 | R_4 | R_5 | R_3 | 1 | 0.02% |
| 4 | R_1 | R_2 | R_3 | R_4 | R_5 | R_5 | R_5 | R_5 | R_5 | R_4 | R_5 | R_4 | 1 | 0.02% |
| 5 | R_1 | R_2 | R_3 | R_4 | R_5 | R_5 | R_5 | R_5 | R_5 | R_4 | R_3 | R_4 | 1 | 0.02% |
| ... | ... | ... | ... | ... | ... | ... | ... | ... | ... | ... | ... | ... | ... | ... |
| 2048 | R_1 & R_5 | R_2 & R_4 | R_3 & R_3 | R_4 & R_2 | R_5 & R_1 | R_5 & R_1 | R_5 & R_1 | R_5 & R_1 | R_5 & R_1 | R_5 & R_1 | R_5 & R_2 | R_5 & R_1 | 2 | 0.05% |
| 2049 | R_1 & R_5 | R_2 & R_4 | R_3 & R_3 | R_4 & R_2 | R_5 & R_1 | R_5 & R_1 | R_5 & R_1 | R_5 & R_1 | R_5 & R_1 | R_5 & R_2 | R_5 & R_1 | R_5 & R_2 | 2 | 0.05% |
| 2050 | R_1 & R_5 | R_2 & R_4 | R_3 & R_3 | R_4 & R_2 | R_5 & R_1 | R_5 & R_1 | R_5 & R_1 | R_5 & R_1 | R_5 & R_2 | R_5 & R_1 | R_4 & R_1 | R_5 & R_1 | 2 | 0.05% |
| 2051 | R_1 & R_5 | R_2 & R_4 | R_3 & R_3 | R_4 & R_2 | R_5 & R_1 | R_5 & R_1 | R_5 & R_1 | R_5 & R_1 | R_5 & R_2 | R_5 & R_1 | R_4 & R_2 | R_3 & R_3 | 2 | 0.05% |
| ... | ... | ... | ... | ... | ... | ... | ... | ... | ... | ... | ... | ... | ... | ... |
| 3070 | R_1 & R_5 | R_2 & R_4 | R_1 & R_5 | R_1 & R_5 | R_1 & R_5 | R_1 & R_5 | R_1 & R_5 | R_1 & R_5 | R_1 & R_5 | R_1 & R_5 | R_1 & R_4 | R_2 & R_3 | 2 | 0.05% |
| 3071 | R_1 & R_5 | R_2 & R_4 | R_1 & R_5 | R_1 & R_5 | R_1 & R_5 | R_1 & R_5 | R_1 & R_5 | R_1 & R_5 | R_1 & R_5 | R_1 & R_5 | R_1 & R_5 | R_1 & R_5 | 2 | 0.05% |
| TOTAL | - | - | - | - | - | - | - | - | - | - | - | - | 4096 | 100.00% |

FIG.60

BONUS RANDOM DETERMINATION TABLE

| ID | BONUS | WEIGHT | PROBABILITY |
|---|---|---|---|
| 0 | FREE GAME | 1 | 50.00% |
| 1 | BIG BONUS | 1 | 50.00% |
| | TOTAL | 2 | 100.00% |

FIG.65

(CHALLENGE TRIGGER TABLE)

| ID | RESULT | WEIGHT FOR EACH BET PER LINE | | | | | | | |
|---|---|---|---|---|---|---|---|---|---|
| | | BET 1 | BET 2 | BET 3 | BET 4 | BET 5 | BET 10 | BET 15 | MAX BET |
| 0 | NOT TRIGGERED | 999 | 998 | 997 | 996 | 995 | 990 | 985 | 980 |
| 1 | TRIGGERED | 1 | 2 | 3 | 4 | 5 | 10 | 15 | 20 |
| | TOTAL | 1000 | 1000 | 1000 | 1000 | 1000 | 1000 | 1000 | 1000 |

FIG.66

(PICK BONUS CHALLENGE TABLE)

| No. | PRIZE | NUMBER |
|---|---|---|
| 1 | PROG_2 | 2 |
| 2 | PROG_3 | 2 |
| 3 | PROG_4 | 2 |
| 4 | PROG_5 | 2 |
| 5 | PROG_6 | 2 |
| 6 | LV9 1000 | 2 |
| 7 | LV8 750 | 2 |
| 8 | LV7 500 | 2 |
| 9 | LV6 400 | 2 |
| 10 | LV5 300 | 2 |
| 11 | LV4 250 | 2 |
| 12 | LV3 200 | 2 |
| 13 | LV2 150 | 2 |
| 14 | LV1 100 | 2 |
| 15 | WILD | 1 |
| | TOTAL | 29 |

FIG.67

(PICK BONUS CHALLENGE TABLE)

| No. | PRIZE | NUMBER |
|---|---|---|
| 1 | PROG_1 | 2 |
| 2 | PROG_2 | 2 |
| 3 | PROG_3 | 2 |
| 4 | PROG_4 | 2 |
| 5 | PROG_5 | 2 |
| 6 | PROG_6 | 2 |
| 7 | LV9 1200 | 2 |
| 8 | LV8 750 | 2 |
| 9 | LV7 500 | 2 |
| 10 | LV6 400 | 2 |
| 11 | LV5 300 | 2 |
| 12 | LV4 250 | 2 |
| 13 | LV3 200 | 2 |
| 14 | LV2 150 | 2 |
| 15 | WILD | 1 |
| | TOTAL | 29 |

FIG.79

PROGRESSIVE PAYOUT INITIAL VALUE TABLE

| LEVEL | SC01 | SC02 | SC03 | SC04 |
|---|---|---|---|---|
| PROG_1 | 250,000 | 500,000 | 1,000,000 | 2,500,000 |
| PROG_2 | 1 | 1 | 1 | 1 |
| PROG_3 | 1 | 1 | 1 | 1 |
| PROG_4 | 1 | 1 | 1 | 1 |
| PROG_5 | 1 | 1 | 1 | 1 |
| PROG_6 | 1 | 1 | 1 | 1 |

FIG.80

FIXED JACKPOT PAYOUT TABLE

| LEVEL | SC01 | SC02 | SC03 | SC04 |
|---|---|---|---|---|
| PROG_1 | 0 | 0 | 0 | 0 |
| PROG_2 | 10000 | 10000 | 10000 | 10000 |
| PROG_3 | 3000 | 3000 | 3000 | 3000 |
| PROG_4 | 2000 | 2000 | 2000 | 2000 |
| PROG_5 | 1500 | 1500 | 1500 | 1500 |
| PROG_6 | 1250 | 1250 | 1250 | 1250 |

FIG.81

PROGRESSIVE INCREMENT RATE TABLE

| PROGRESSIVE CONFIGURATION | 1 | 2 | 3 | 4 |
|---|---|---|---|---|
| PROGRESSIVE1 | 0.500000% | 0.500000% | 0.500000% | 0.500000% |
| PROGRESSIVE2 | 0.500000% | 0.500000% | 0.500000% | 0.500000% |
| PROGRESSIVE3 | 0.500000% | 0.500000% | 0.500000% | 0.500000% |
| PROGRESSIVE4 | 0.500000% | 0.500000% | 0.500000% | 0.500000% |
| PROGRESSIVE5 | 0.500000% | 0.500000% | 0.500000% | 0.500000% |
| PROGRESSIVE6 | 0.500000% | 0.500000% | 0.500000% | 0.500000% |

FIG.82

PROGRESSIVE UPPER LIMIT TABLE

| PROGRESSIVE CONFIGURATION | 1 | 2 | 3 | 4 |
|---|---|---|---|---|
| PROGRESSIVE1 | $99,999,999.99 | $99,999,999.99 | $99,999,999.99 | $99,999,999.99 |
| PROGRESSIVE2 | $7,000,000.0 | $7,000,000.0 | $7,000,000.0 | $7,000,000.0 |
| PROGRESSIVE3 | $7,000,000.0 | $7,000,000.0 | $7,000,000.0 | $7,000,000.0 |
| PROGRESSIVE4 | $7,000,000.0 | $7,000,000.0 | $7,000,000.0 | $7,000,000.0 |
| PROGRESSIVE5 | $7,000,000.0 | $7,000,000.0 | $7,000,000.0 | $7,000,000.0 |
| PROGRESSIVE6 | $7,000,000.0 | $7,000,000.0 | $7,000,000.0 | $7,000,000.0 |

GAMING MACHINE WITH EXPANDABLE SYMBOL MATRIX

CROSS REFERENCE TO RELATED APPLICATION

This application claims priority from Japanese Patent Application No. 2015-190376, filed on Sep. 28, 2015, which application is incorporated herein by reference in its entirety.

FIELD OF THE INVENTION

The present invention relates to a gaming machine.

BACKGROUND OF THE INVENTION

In known gaming machines, when an operation of a spin button is input after a player bets credits, symbols are scrolled and displayed on a display provided on the front surface of a cabinet, and then symbols are automatically stopped in a plurality of blocks arranged in a matrix. When a predetermined number or more of symbols of a kind are stopped and displayed (rearranged) on an active line, a winning is achieved, and a payout is awarded. If such a winning is not achieved, the player loses the thus bet credits.

Now, there is a gaming machine in which active lines run from left to right ("left to right way"). For example, see the Specification of U.S. Unexamined Patent Publication No. 2004/0053676 and U.S. Pat. No. 8,740,689. Such active lines running in the "left to right way" include active lines set in a display frame defined by blocks arranged in a matrix. Each active line is a combination of blocks made by selecting one block from the blocks in each column of the matrix.

SUMMARY OF THE INVENTION

Among the above-described known gaming machines, there is a gaming machine having an expandable display frame so that the number of symbols visible at the time of rearrangement increases. In this gaming machine, however, the number of the active lines is not changeable, and therefore the winning probability is not varied. For this reason, a player playing a game may be less motivated to keep playing the game.

The present invention has been made in view of the above. An object of the present invention is to provide a gaming machine capable of providing new gaming characteristics: the number of active lines is changeable to vary a winning probability.

According to an aspect of the present invention, a gaming machine includes:

a symbol display device including a plurality of variable display areas and being configured so that symbol arrays each of which is constituted by arranged symbols are variably displayed in the variable display areas respectively, and then some of the symbols of the symbol arrays are respectively rearranged, on a one to one basis, in a plurality of blocks arranged in a matrix of M columns by N rows in the plurality of variable display areas; and a controller configured to execute a game and to control the symbol display device so that the symbols are rearranged in accordance with the game, the controller configured to execute the following steps of:

determining whether a predetermined condition is satisfied before the rearrangement of the symbols;

when the predetermined condition is not satisfied, setting a plurality of active lines in a display frame defined by the blocks in the matrix of M columns by N rows, each of the active lines being a combination of blocks made by selecting one block from the blocks in each of the variable display areas;

when the predetermined condition is satisfied, adding blocks to the blocks in the display frame to form a matrix of blocks of M columns by N+α rows, and setting, in the expanded display frame, additional active lines, the number of which is calculated by multiplying the number of the added rows, α, by a predetermined value; and when a combination of a predetermined number of more of the symbols of a kind is achieved on any of the active lines, awarding a line payout in accordance with the type of the combination achieved.

In the above arrangement, one or more rows of blocks are able to be added to the blocks arranged in a matrix. Per each additional row, the additional active lines, the number of which is equal to the predetermined value, are set. With this, the number of the active lines is increased, which allows the gaming machine to provide new gaming characteristics: the number of the active lines is changeable to vary the winning probability.

Further, the gaming machine of the above aspect of the present invention may be adapted so that the controller sets the active lines in the matrix of the blocks of M columns by N+α rows arranged in the display frame by adding the additional active lines, the number of which is equal to the predetermined value, to the active lines in the matrix of the blocks of M columns by N+α−1 rows arranged in the display frame.

In the above arrangement, the difference between the active lines in the matrix of M columns by N+α rows and those in the matrix of M columns by N+α−1 rows is the additional active lines of the predetermined value only (the differential), and all the remaining active lines in the matrix of M columns by N+α rows are identical with those in the matrix of M columns by N+α−1 rows. With this, when the number of the rows is increased and the number of the active lines is increased, there is a possibility that the active lines can be easily understandable to the player.

Thus, there is provided the gaming machine capable of providing new gaming characteristics: the number of active lines is changeable to vary the winning probability.

BRIEF DESCRIPTION OF THE DRAWINGS

FIG. 8 is an explanatory diagram for symbols and a payout table.

FIG. 9 is an explanatory diagram illustrating bet configurations.

FIG. 10A is an explanatory diagram illustrating symbol arrays for a base game.

FIG. 10B is an explanatory diagram illustrating the symbol arrays for the base game.

FIG. 10C is an explanatory diagram illustrating the symbol arrays for the base game.

FIG. 10D is an explanatory diagram illustrating the symbol arrays for the base game.

FIG. 10E is an explanatory diagram illustrating the symbol arrays for the base game.

FIG. 11A is an explanatory diagram illustrating symbol arrays for a free game.

FIG. 11B is an explanatory diagram illustrating the symbol arrays for the free game.

FIG. 11C is an explanatory diagram illustrating the symbol arrays for the free game.

FIG. 11D is an explanatory diagram illustrating the symbol arrays for the free game.

FIG. 11E is an explanatory diagram illustrating the symbol arrays for the free game.

FIG. 12 illustrates a base game window number random determination table.

FIG. 13 illustrates a free game window number random determination table.

FIG. 14 illustrates a reel position number table.

FIG. 15A illustrates an active line setting table.

FIG. 15B illustrates the active line setting table.

FIG. 16A is an explanatory diagram illustrating how to add active lines.

FIG. 52 illustrates a base game mystery feature trigger random determination table.

FIG. 53 illustrates a free game mystery feature trigger random determination table.

FIG. 54 illustrates a base game feature random determination table.

FIG. 55 illustrates a free game feature random determination table.

FIG. 56 illustrates a base game wild reel random determination table.

FIG. 57 illustrates a free game wild reel random determination table.

FIG. 58 illustrates a base game wild change position random determination table.

FIG. 59 illustrates a free game wild change position random determination table.

FIG. 60 illustrates bonus random determination table.

FIG. 65 illustrates a challenge trigger table.

FIG. 66 illustrates a pick bonus normal table.

FIG. 67 illustrates a pick bonus challenge table.

FIG. 79 illustrates a progressive payout initial value table.

FIG. 80 illustrates a fixed jackpot payout table.

FIG. 81 illustrates a progressive increment rate table.

FIG. 82 illustrates a progressive upper limit table.

DETAILED DESCRIPTION OF THE PREFERRED EMBODIMENTS

The following describes a gaming machine of the present invention with reference to the drawings.

(Outline of Gaming Machine)

Figure 1:
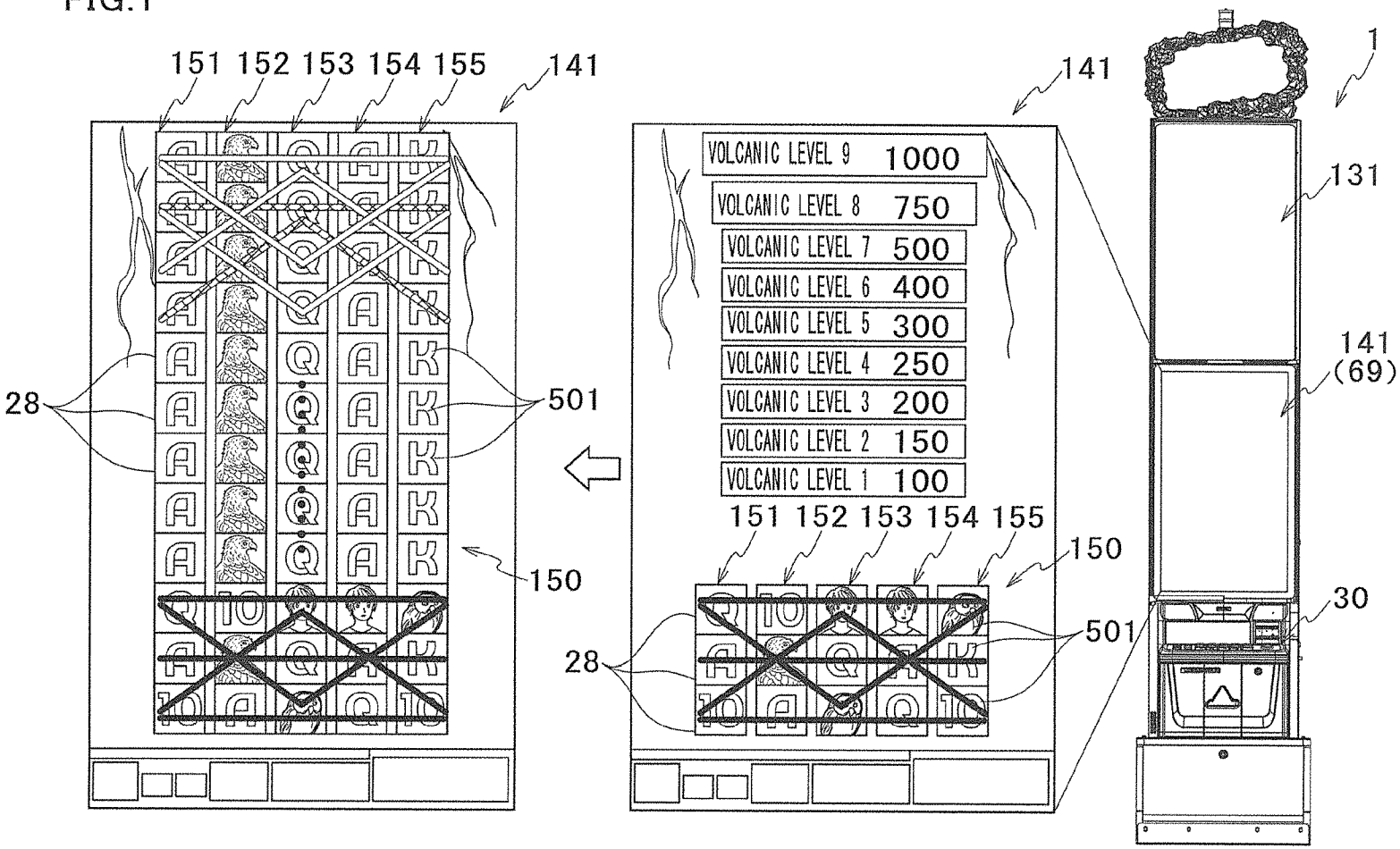
FIG. 1 is an explanatory diagram illustrating an operation state of a gaming machine.

As shown in FIG. 1, a slot machine 1 functioning as the gaming machine includes a lower image display panel 141 functioning as a symbol display device. The lower image display panel 141 is provided with a touch panel 69, which functions as an input device capable of receiving operation conducted by a player.

The slot machine 1 is configured to run a game (base game, free game) started, with a bet, on condition that credits are consumed. The slot machine 1 controls the lower image display panel 141 in accordance with the result of the game. To be more specific, the lower image display panel 141 has video reels 151 to 155 functioning as a plurality of variable display areas. The video reels 151 to 155 are provided in a symbol display area (display frame) 150. In the slot machine 1, symbol arrays in each of which symbols 501 are arranged are variably displayed on the video reels 151 to 155, differently depending on the type of the game (the base game or the free game). Then, some of the symbols 501 of the symbol arrays are respectively rearranged, on a one to one basis, in a plurality of display blocks 28 on the video reels 151 to 155. Basically, there are three display blocks 28 on each of the video reels 151 to 155. That is, the symbols 501 are respectively rearranged, on a one to one basis, in the fifteen display blocks 28 arranged in a matrix of 5 columns by 3 rows in the symbol display area 150. Accordingly, a basic matrix of M columns by N rows is formed by the fifteen display blocks 28 arranged in the matrix of 5 columns by 3 rows. The slot machine 1 controls the lower image display panel 141 so that the symbols 501 are respectively rearranged in these fifteen display blocks 28 in accordance with the result of the game.

In the following description, the symbol display area 150 may be referred to as a display window. In addition, the matrix formed by the display blocks 28 in the symbol display area 150 may be simply referred to as a matrix. Further, the number of rows in the matrix displayed in the symbol display area 150 may be referred to as "window number", or "the number of active windows".

As shown in FIG. 1, the slot machine 1 determines whether a predetermined condition (display frame expansion condition) is satisfied before the rearrangement of the symbols 501. When the predetermined condition is not satisfied, a plurality of active lines are set in the basic matrix of the fifteen display blocks 28 of 5 columns by 3 rows. Hereinafter, the active lines set in the basic matrix of 5 columns by 3 rows may be referred to as basic active lines. In the present embodiment, the number of the basic active lines is 20. Each active line is structured by five display blocks 28. The combination of the five display blocks 28 of each active line is made by selecting one display block 28 from the blocks on each of the video reels 151 to 155. In the present embodiment, the active lines run in a so-called "left to right" way. The slot machine 1 performs determination for a line payout for every active line, with reference to the result of the rearrangement of the symbols 501. In other words, when a predetermined number or more of the symbols 501 of a kind are displayed in the five display blocks 28 of any of the active lines, the slot machine 1 awards the line payout corresponding to the thus achieved combination of the symbols 501.

As described above, in the present embodiment, the credit amount of the line payout is determined in accordance with the achieved combination of the symbols 501. Hereinafter, the symbols of the type which can provide the highest amount of the line payout among the symbols 501 are referred to as top symbols. Further, a line payout obtained as a result of the rearrangement of a predetermined number or more of the symbols of a kind is simply referred to as a "line payout of symbols". The combination of symbols which causes the line payout is expressed as "X of a kind", where X is the number of symbols of the kind. For example, when four top symbols are rearranged on an active line, this combination is referred to as "4 of a kind combination of top symbols".

As shown in FIG. 1, the slot machine 1 determines whether the predetermined condition is satisfied before the rearrangement of the symbols 501. When the predetermined condition is satisfied, display blocks 28 are added to the blocks in the symbol display area 150 functioning as the display frame, to form a matrix of M columns by N+$\alpha$ rows. That is, in the symbol display area 150, there is displayed the display blocks 28 arranged in the matrix of 5 columns by 3+$\alpha$ rows. Further, in the symbol display area 150 where these display blocks 28 are arranged, additional active lines are set. The number of the additional active lines is calculated by multiplying the number of the added rows, $\alpha$, by a predetermined value. Then, the determination for the line payout is performed for every active line, including the additional active lines.

In the present embodiment, the maximum matrix of the display blocks 28 displayed in the symbol display area 150 is a matrix of 5 columns by 12 rows. In other words, nine rows of the display blocks 28 are addable. For each additional row in the matrix, ten active lines are added to those in the symbol display area 150. Consequently, the maximum number of the active lines is 110.

Thus, one or more rows of the display blocks 28 are addable to the display blocks 28 arranged in a matrix. Per each additional row, the predetermined number of active lines are additionally set. With this, the number of the active lines is increased, which allows the gaming machine to provide new gaming characteristics: the number of the active lines is changeable to vary the winning probability.

Figure 2:
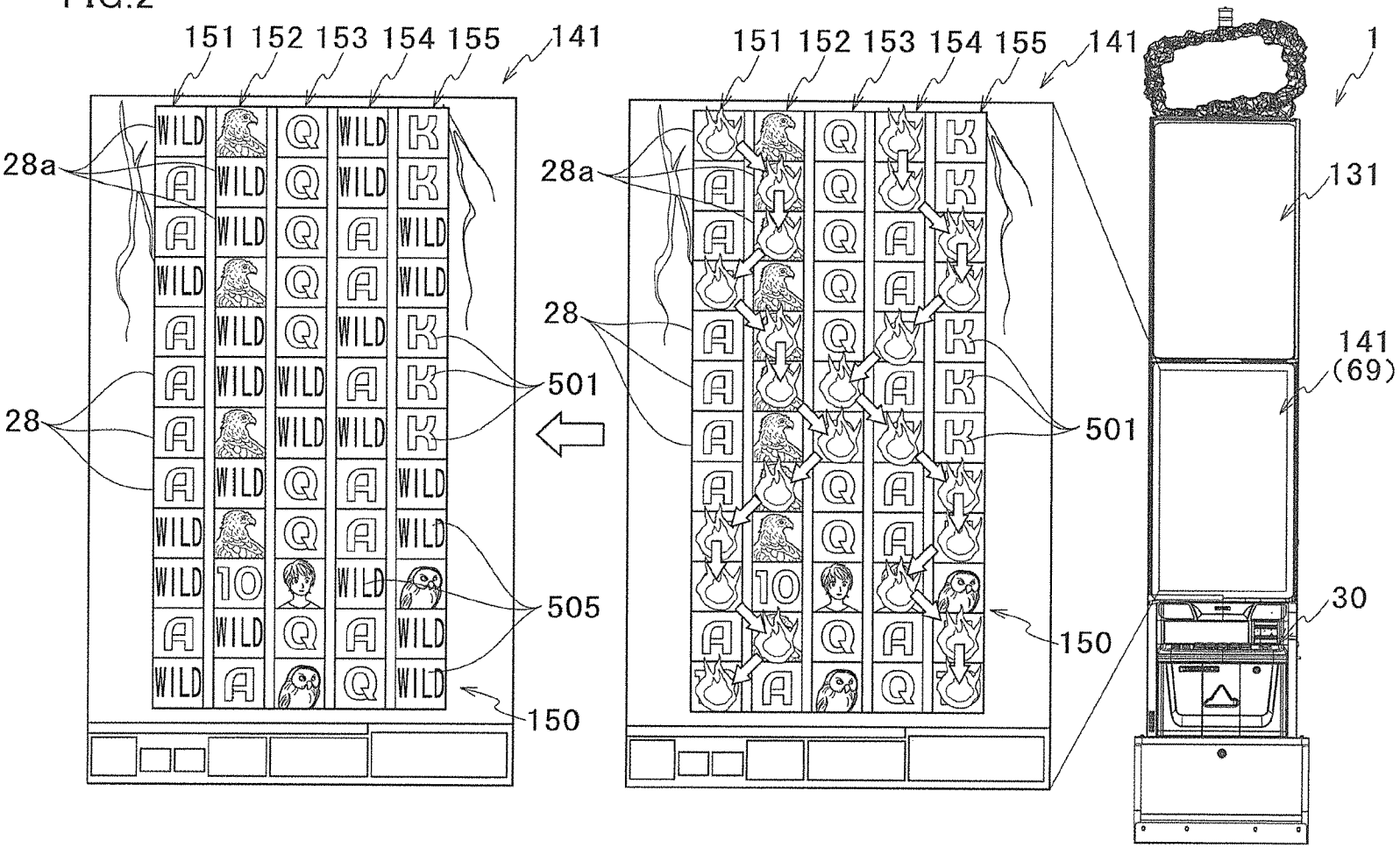
FIG. 2 is an explanatory diagram illustrating an operation state of the gaming machine.

As shown in FIG. 2, the slot machine 1 determines whether another predetermined condition (wild change condition) is satisfied before rearrangement of the symbols 501. When this predetermined condition is satisfied, the display block 28 to be changed is selected in each row in accordance with a predetermined pattern, and the thus selected display blocks 28 are set as change blocks 28*a*. The pattern for selecting the display blocks 28 to function as the change blocks 28*a* is as follows: when the display block in the mth column is selected in the nth row, the display block to be selected in the (n+1)th row is the block in the (m−1)th column, in the mth column, or in the (m+1)th column. Further, suppose that the plurality of display blocks 28 are arranged in a matrix on the video reels 151 to 155. In the present embodiment, after the symbols 501 are rearranged, the slot machine 1 provides a specific effect (magma effect) on the areas of the display blocks 28 corresponding to the change block 28*a* in the first row to the change block 28*a* in the Yth row. Then, the slot machine 1 provides an effect of changing the symbols in all the change blocks 28*a* to the wild symbols 505 which can substitute for any other type of symbols. In the determination for the line payout, the slot machine 1 treats the symbols 501 rearranged in the change blocks 28*a* as the wild symbols 505.

As such, when the predetermined condition is satisfied, the effect is provided on the change block 28*a* in the nth row and mth column, and then the effect is provided on the display block 28 corresponding to the change block 28*a* in the (n+1)th row, which is selected from the blocks in the (m−1)th column, the mth column, and the (m+1)th column. Thus, the display block 28, on which the specific effect is to be provided subsequently to the specific effect on the display block 28 in the nth row, is selected from the display blocks 28 which are at the three positions on the column progression side of (below) that display block 28 in the nth row. Accordingly, the player is only required to check the display blocks 28 at these three positions, which may increase the possibility that the player easily predicts the position of the symbol to be changed to the wild symbol 505. Note that in the present embodiment, the change to the wild symbol 505 is referred to as "lava wild feature". Further, in the present embodiment, there is an expand wild feature, in addition to the lava wild feature. In the expand wild feature, all the symbols 501 on one or more of the video reels 151 to 155 are changed to the wild symbols 505.

The slot machine 1 is capable of running, as the game, a base game in which the symbols are rearranged as described above, and a bonus game which has an advantage over the base game. A trigger condition for triggering the bonus game is that a predetermined number or more of the bonus symbols are included in the symbols 501 rearranged on the video reels 151 to 155 in the base game. When the bonus symbol is rearranged in the display block 28 selected as the change block 28*a* in the base game, the slot machine 1 treats the bonus symbol as the wild symbol 505 in the determination for the line payout, while the slot machine 1 treats the symbol as the bonus symbol in the determination for the trigger condition.

In the above arrangement, when the display block 28, where the bonus symbol which can satisfy the trigger condition for the bonus game having an advantage over the base game is to be rearranged, is selected as the change block 28*a*, the symbol in this block is treated as the wild symbol 505 in the determination for the line payout, while the symbol in this block is treated as the bonus symbol in the determination for the trigger condition. With this, when the bonus symbol is rearranged in the change block 28*a*, the symbol keeps the function as the wild symbol 505, without losing the function as the bonus symbol to trigger the bonus game having an advantageous over the base game.

In the present embodiment, after one or more rows are added to the matrix, the magma effect can possibly be provided. In other words, the wild change condition encompasses the display frame expansion condition. However, the present invention is not limited to this, and the magma effect may be provided without satisfaction of the display frame expansion condition. These conditions will be detailed later.

(Definitions and the Like)

The slot machine is a kind of gaming machine. The base game and the free game each is a slot game in which a plurality of symbols are rearranged. In the present embodiment, the free game may be executed as a kind of a bonus game.

The term "rearrangement" indicates that the symbols are rearranged after the arrangement of the symbols is dismissed. Arrangement means a state where the symbols can be visibly confirmed by a player. More specifically, "rearrangement" is a state in which, after the symbols on the reels are variably displayed as the reels rotate, the variable display of the symbols stops as the rotation of the reels stops, and the symbols stop in the display window.

The free game may be of any type as long as a different game state is established from that in the base game. The free game is a game runnable with a bet of fewer gaming values than that in the base game. Note that "bet of fewer gaming values" encompasses a bet of 0 gaming value. The "free game" therefore may be a game runnable without a bet of a gaming value, which free game awards an amount of gaming values based on symbols rearranged. In other words, the "free game" may be a game which is started without consumption of a gaming value. To the contrary, the "base game" is a game runnable on condition that a gaming value is bet, which normal game can award an amount of gaming value based on the symbols rearranged. In other words, the "base game" is a game which is started with consumption of a gaming value.

A coin, a bill, or electrically valuable information corresponding to these is used as a gaming value (credit). Note that the gaming value in the present invention is not particularly limited. Examples of the gaming value include game media such as medals, tokens, cyber money, tickets, and the like. A ticket is not particularly limited, and a later-mentioned barcoded ticket may be adopted, for example. Alternatively, the gaming value may be a game point not including valuable information. Note that the present embodiment is described on the premise that the credit is used as the gaming value. That is, the base game is run with consumption of the credit.

(Functional Flow)

Figure 3:
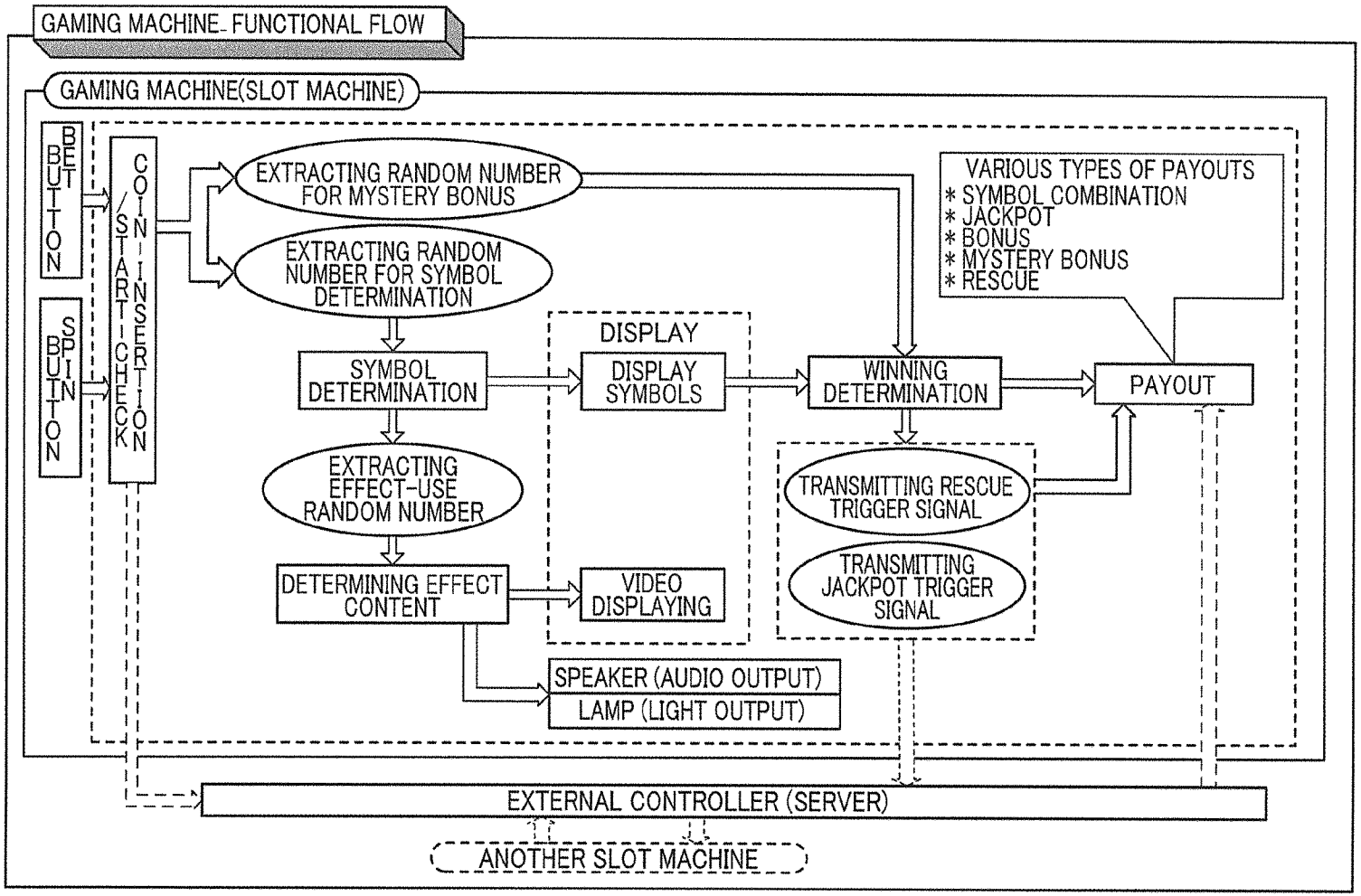
FIG. 3 is an explanatory diagram illustrating a functional flow of the gaming machine.

The following describes basic functions of the slot machine related to the embodiment of the present invention, with reference to FIG. 3. FIG. 3 shows the functional flow of the slot machine of the embodiment of the present invention.

<Start-check>

First, the slot machine checks whether a bet button has been pressed by a player, and subsequently checks whether a spin button has been pressed by the player.

<Symbol Determination>

Next, when the spin button has been pressed by the player, the slot machine extracts a random number for symbol determination, and determines symbols to be displayed to the player at the time of stopping the scroll of the symbol arrays, for respective video reels displayed on a display.

<Symbol Display>

Then the slot machine starts the scroll of the symbol array of each video reel, and stops the scroll so that the determined symbols are displayed to the player.

<Winning Determination>

Subsequently, as the scroll of the symbol array of each video reel is stopped, the slot machine determines whether the combination of the symbols displayed to the player is a combination related to a winning.

<Payout>

When the combination of the symbols displayed to the player is a combination related to a winning, the slot machine offers, to the player, a benefit according to the combination. For example, when a combination of symbols related to a payout of coins is displayed, the slot machine pays out, to the player, coins of the amount corresponding to the combination of the displayed symbols.

When a combination of the symbols related to a free game trigger is displayed, the slot machine starts a free game. In the embodiment of the present invention, the free game is a game executed without consumption of coins, in which random determination for the aforementioned determination of the to-be-stopped symbols is conducted a predetermined number of times.

In addition to the above-described benefit, the slot machine is provided with a benefit such as a mystery feature. The mystery feature is awarded when a winning is made in the random determination for the mystery feature, and specifically, awarded is a predetermined number of plays of the free game. When the spin button is pressed, the slot machine extracts a random number for the mystery bonus and randomly determines whether a mystery feature trigger is established.

The function of rescue provided in the present embodiment is for saving the player when the free game is not executed for a long period of time. That is, with this function, when the number of plays of the game reaches a predetermined value without receiving a predetermined benefit, some of the bet is returned to the player to save the player.

Whether the function of rescue is activated or not is freely selectable by an administrator of the slot machine. If the rescue is activated, the slot machine starts to count the number of plays of the game. When the counted number of plays of the game reaches a predetermined number without a large amount of payout due to the free game or the like, the slot machine awards a benefit such as the free game.

Further, the slot machine may be arranged such that, when a condition for a jackpot trigger is satisfied, coins corresponding to the jackpot amount is paid out to the player. The function of jackpot is as follows: a part of the amount of coins consumed by the player on each slot machine is accumulated as the jackpot amount, and when the jackpot trigger condition is satisfied in one of the slot machines, coins corresponding to the jackpot amount are paid out to the one of the slot machines. In this arrangement, each time the game is executed, the slot machine calculates the amount (accumulative amount) to be added to the jackpot amount, and transmits the accumulative amount to an external controller. The external controller adds the accumulative amount transmitted from each slot machine to the jackpot amount. It should be noted that this jackpot amount and paying out of the jackpot amount may be simply referred to as "jackpot" or "progressive".

<Determination of Effect>

The slot machine produces an effect by displaying an image on a display, outputting light from a lamp, and outputting sound from a speaker. The slot machine extracts an effect-use random number and determines the contents of the effect based on randomly determined symbols or the like. This concludes the description for the basic functions of the slot machine.

(Overall Structure of Game System)

Figure 4:
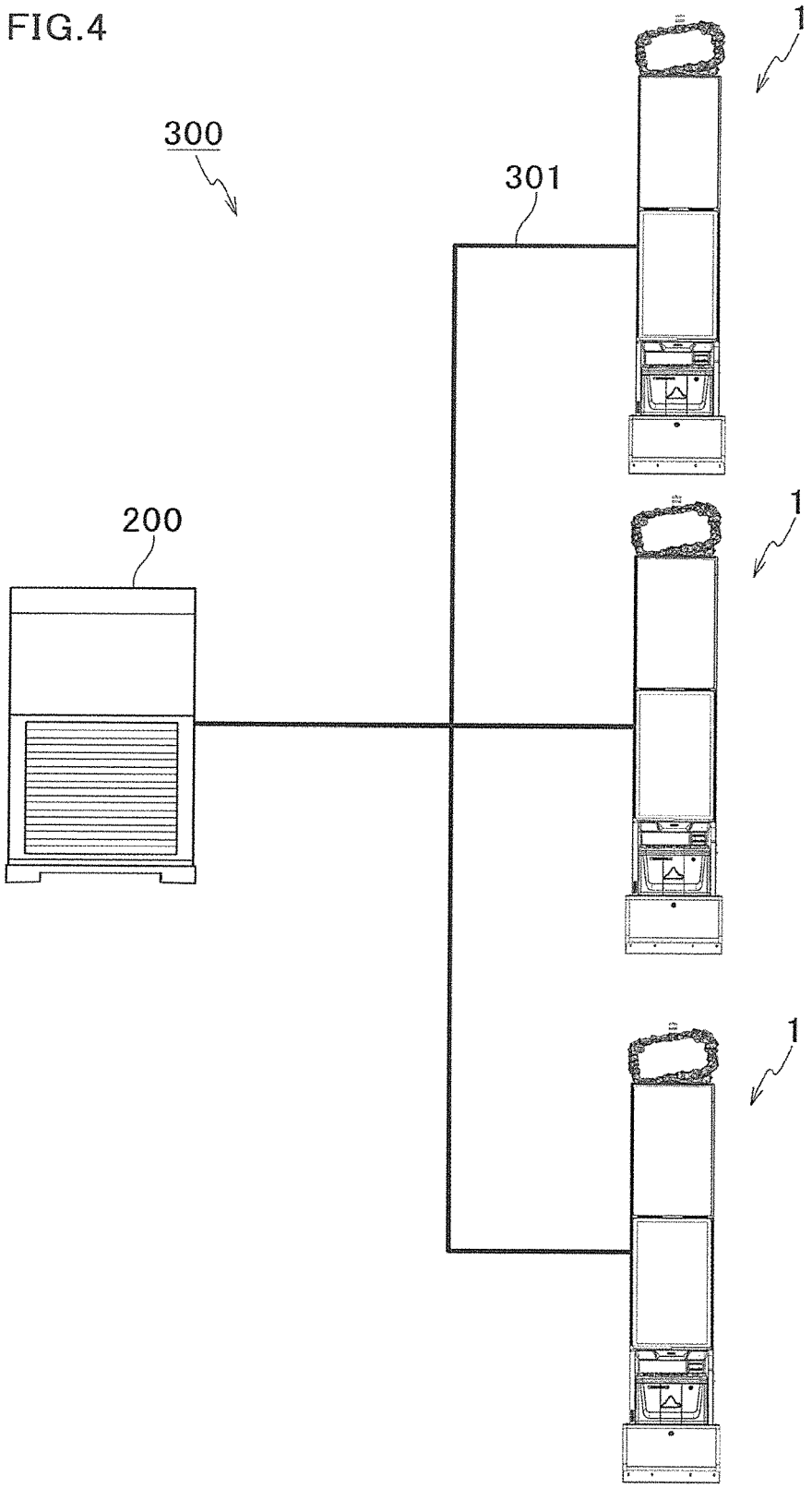
FIG. 4 is a block diagram of a gaming system.

Now, referring to FIG. 4, a game system including the slot machines will be described. FIG. 4 shows the game system including the slot machines of the embodiment of the present invention.

The game system 300 includes the slot machines 1 and an external controller 200 connected to each slot machine 1 over communication lines 301.

The external controller 200 is configured to control the slot machines 1. In this embodiment, the external controller 200 is a so-called hall server provided in a gaming facility where the slot machines 1 are provided. Each of the slot machines 1 has a unique identification number, and the external controller 200 identifies which one of the slot machines 1 transmitted data, by referring to the identification number. Further, when transmitting data from the external controller 200 to any of the slot machines 1, the identification number is used for designating the transmission destination.

The game system 300 may be constructed in a single gaming facility such as a casino where various games are playable or may be constructed for a plurality of gaming facilities. Further, when the game system 300 is constructed in a single gaming facility, the gaming system may be constructed in each floor or section of the gaming facility. The communication line 301 may be a wired or wireless line, and can adopt a dedicated line, an exchange line, or the like.

(Mechanical Structure of Slot Machine)

Figure 5:
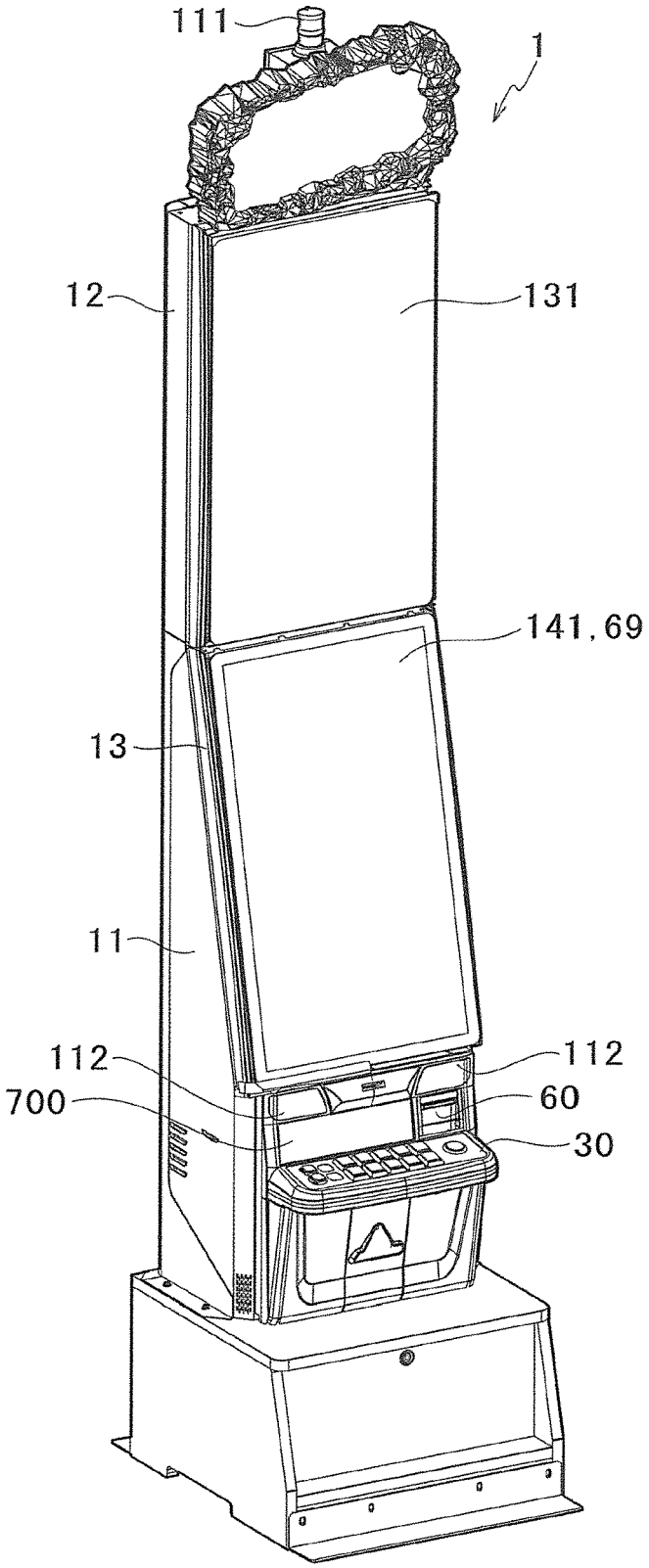
FIG. 5 is a perspective view of a slot machine.

Referring to FIG. 5, the overall structure of the slot machine 1 will be described.

Electrically valuable information such as electronic money is used as a gaming value in the slot machine 1. It is to be noted that the gaming value is not limited to this, and for example a coin, a medal, a token, a ticket with a bar code and the like can be adopted.

The slot machine 1 includes a cabinet 11, a top box 12 installed on the upper side of the cabinet 11, and a main door 13 provided at the front surface of the cabinet 11. To the main door 13, there is provided a speaker 112.

On the main door 13, there is provided the lower image display panel 141 functioning as the symbol display device. The lower image display panel 141 is structured by a liquid crystal panel. The details of the display screen on the lower image display panel 141 will be given later.

On the front surface of the lower image display panel 141, a touch panel 69 is provided. The touch panel 69 allows the player to input various instructions by touching the display screen of the lower image display panel 141. The input signal is transmitted from the touch panel 69 to the main CPU 71.

An upper image display panel 131 is provided at the front surface of the top box 12. The upper image display panel 131 is structured by a liquid crystal panel, and forms the display. The upper image display panel 131 displays images related to effects and images showing introduction of the game contents and explanation of the game rules. Further, the top box 12 is provided with a lamp 111. The slot machine 1 produces effects by displaying images, outputting sounds, and outputting light.

Below the lower image display panel 141, there are provided a control panel 30 having various buttons, a PTS device 700, and a bill entry 22.

The bill entry 60 validates bills and receives genuine bills into the cabinet 11. The bill entry 60 is electrically connected to the PTS device 700, and when a genuine bill is received, transmits to the PTS device 700 an input signal based on the value of the bill. The input signal includes information on credit data or the like related to the received bill.

The PTS device 700 is a unit in which an LCD (liquid crystal display), a human detection camera, a microphone, and the like are integrated. The human detection camera has a camera function which enables detection of the presence or absence of the player. The microphone is used for the player's participation in a game by voice and the authentication of the player by voice recognition. Further, the PTS device 700 has a card insertion slot into which an IC card can be inserted. With this, the player is able to insert an IC card into the card insertion slot and use the credits stored in the IC card in the slot machine 1.

Figure 6:
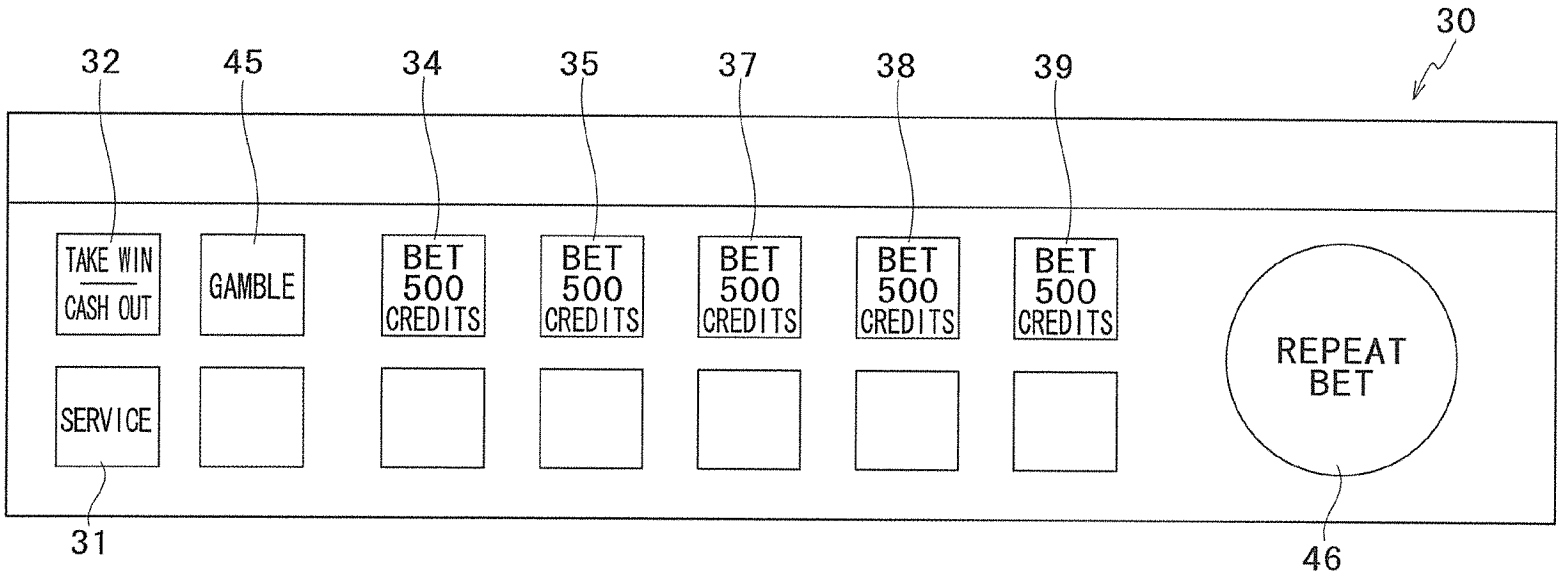
FIG. 6 is an explanatory diagram of the button configuration of a control panel.

As shown in FIG. 6, on the control panel 30, there are a plurality of buttons arranged in two stages, i.e., the upper and lower stages. On the right end portion, a repeat bet button 46 is provided. Specifically, in the upper stage of the control panel 30, there are arranged a cash-out button 32, a gamble button 45, a first bet button 34, a second bet button 35, a third bet button 37, a fourth bet button 38, and a fifth bet button 39, from the left side. In the lower stage of the control panel 30, a service button 31 is provided. It should be noted that the control panel 30 may be arranged so that the design of buttons is changeable in accordance with the type of the game.

The service button 31 is an operation button to be used when temporarily leaving the seat, or when requesting a staff person of the gaming facility for an exchange. The cash-out button 32 is a so-called settlement button by which credit data concerning credits obtained in games is added to the credit data stored in an IC card inserted into the PTS terminal 700.

Each of the bet buttons 34, 35, 37, 38, and 39 is a button for starting the base game with a bet of credits, the amount of which is a product of a basic bet amount and a multiplying factor value set to each bet button. In the present embodiment, by default, the first bet button 34 is associated with 50 credits, the second bet button 35 is associated with 100 credits, the third bet button 37 is associated with 150 credits, the fourth bet button 38 is associated with 250 credits, and the fifth bet button 39 is associated with 500 credits. The repeat bet button 46 is used for starting the game with the previously set bet amount.

Thus, the first to fifth bet buttons 34, 35, 37, 38, and 39, and the repeat bet button 46 each has a function of selecting the bet amount, and also has a function of starting the spin of the symbol arrays in the symbol display area 150. In addition, the repeat bet button 46 also functions as a button for starting a bonus game and for adding the amount of payout awarded in the bonus game to the credits.

The gamble button 45 is an operation button used for, for example, shifting to the gamble game after the bonus game or the like ends. The gamble game is a game played using obtained credits.

(Electrical Structure of Slot Machine)

Figure 7:
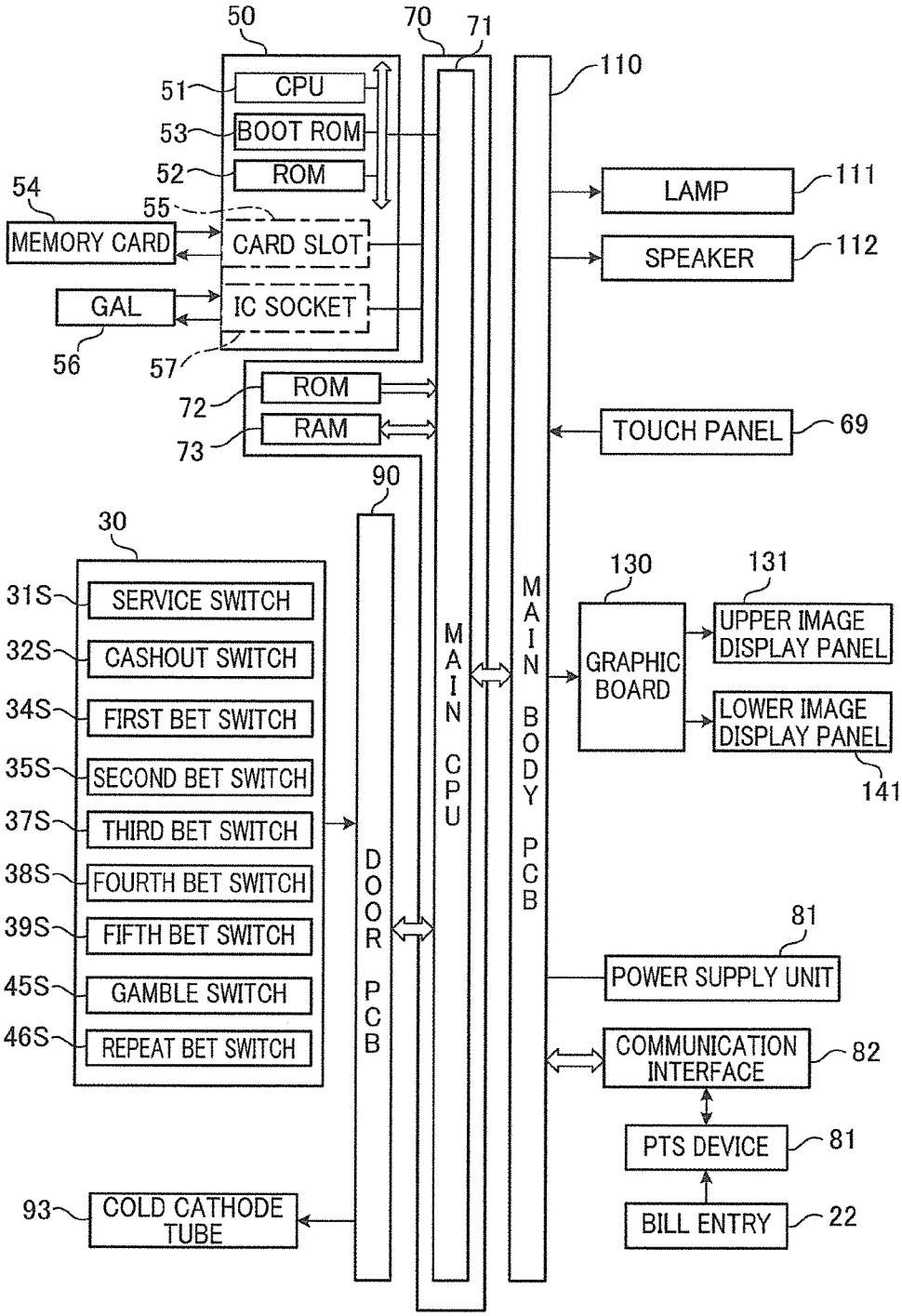
FIG. 7 is an electrical block diagram of the gaming machine.

Now, referring to FIG. 7, the configuration of a circuit in the slot machine 1 will be described.

A gaming board 50 is provided with: a CPU 51, a ROM 52, and a boot ROM 53, which are mutually connected by an internal bus; a card slot 55 corresponding to a memory card 54; and an IC socket 57 corresponding to a GAL (Generic Array Logic) 56.

The memory card 54 includes a nonvolatile memory, and stores a game program. The game program includes a program related to game progression and an effect program for producing effects by images and sounds.

Further, the card slot 55 is configured so that the memory card 54 can be inserted thereinto and removed therefrom, and is connected to a motherboard 70 by an IDE bus. The type and contents of the game to be played on the slot machine 1 can be changed by drawing out the memory card 54 from the card slot 53S, writing another game program into the memory card 54, and inserting the memory card 54 into the card slot 53S.

The GAL 56 is a type of PLD (programmable logic device) having a fixed OR array structure. The GAL 56 is provided with a plurality of input ports and output ports, and predetermined input into the input port causes output of the corresponding data from the output port.

Further, the IC socket 57 is configured so that the GAL 56 can be inserted thereinto and removed therefrom, and is connected to the motherboard 70 by a PCI bus. The contents of the game to be played on the slot machine 1 can be changed by replacing the memory card 54 with another memory card 54 having another program written therein or by rewriting the program written into the memory card 54 as another program.

The CPU 51, the ROM 52, and the boot ROM 53 mutually connected by the internal bus are connected to the motherboard 70 by a PCI bus. The PCI bus enables a signal transmission between the motherboard 70 and the gaming board 50, and power supply from the motherboard 70 to the gaming board 50.

The ROM 52 stores an authentication program. The boot ROM 53 stores a preliminary authentication program, a program (boot code) to be used by the CPU 51 for activating the pre-authentication program, and the like. The authentication program is a program (falsification check program) for authenticating the game program. The pre-authentication program is a program for authenticating the aforementioned authentication program. The authentication program and the pre-authentication program are written along a procedure (authentication procedure) for proving that the program to be the subject has not been falsified.

The motherboard 70 is constituted by a motherboard for market use (printed circuit board with fundamental parts of a personal computer built thereon), and includes the main CPU 71, a ROM (Read Only Memory) 72, a RAM (Random Access Memory) 73, and a communication interface 82. This motherboard 70 corresponds to a game controller 100 of the present embodiment.

The ROM 72 includes a memory device such as a flash memory, and stores a program such as BIOS (Basic Input/Output System) to be executed by the main CPU 71, and permanent data. When the BIOS is executed by the main CPU 71, processing for initializing predetermined peripheral devices is conducted. Further, through the gaming board 50, a process of loading the game program stored in the memory card 54 is started. In the present invention, the ROM 72 may be rewritable or not rewritable.

The RAM 73 stores data used for the operation of the main CPU 71 (later-described various tables and the like) and programs such as a symbol determination program. For example, when the process of loading the aforementioned game program or authentication program is executed, the RAM 73 can store the program. The RAM 73 is provided with working areas used for operations when these programs are executed. Examples of the areas include: an area that stores a counter which manages the number of plays of games, the bet amount, the payout amount, the credit amount, and the like; and an area that stores symbols (code numbers) randomly determined.

The communication interface 82 is for communicating with the PTS device 700 or a not-shown external controller. The PTS device 700, upon reception of an input signal from the bill entry 22, transmits credit data contained in the input signal to the main CPU 71 via the communication interface 82. Further, when an IC card is inserted into the card insertion slot, the PTS device 700 transmits credit data stored in the IC card to the main CPU 71 via the communication interface 82. The PTS device 700 also writes credit data into the IC card inserted into the card insertion slot, based on a control signal received from the main CPU 71 via the communication interface 82.

Further, the motherboard 70 is connected with a later-described door PCB (Printed Circuit Board) 90 and a main body PCB 110 by respective USBs. The motherboard 70 is also connected with a power supply unit 81. When the power is supplied from the power supply unit 81 to the motherboard 70, the main CPU 71 of the motherboard 70 is activated, and then power is supplied to the gaming board 50 through the PCI bus so as to activate the CPU 51.

The door PCB 90 and the main body PCB 110 are connected with input devices such as a switch and a sensor, and peripheral devices the operations of which are controlled by the main CPU 71. The door PCB 90 is connected with the control panel 30, and a cold cathode tube 93.

The control panel 30 is provided with a service switch 31S, a cash-out switch 32S, a first bet switch 34S, a second bet switch 355, a third bet switch 37S, a fourth bet switch 38S, a fifth bet switch 39S, a gamble switch 455, and a repeat bet switch 46S which correspond to the above mentioned buttons, respectively. Each of the switches outputs a signal to the main CPU 71 upon detection of the pressing of the button corresponding thereto by the player.

The cold cathode tube 93 functions as a backlight installed on the rear face sides of the upper image display panel 131 and the lower image display panel 141, and lights up based on a control signal output from the main CPU 71.

The main body PCB 110 is connected with the upper image display panel 131, the lamp 111, the speaker 112, the touch panel 69, the bill entry 22, and a graphic board 130. The speaker 112 outputs BGM sound or the like in accordance with a control signal output from the main CPU 71.

The touch panel 69 detects a place on the lower image display panel 141 touched by the player's finger or the like, and outputs to the main CPU 71 a signal corresponding to the detected place.

The bill entry 22 authenticates the bills and receives genuine bills into the cabinet 11. The amount of credit corresponding to the bills received by the cabinet 11 is added to the player-owned credit.

The graphic board 130 controls display of images on the upper image display panel 131 and lower image display panel 141, based on a control signal output from the main CPU 71. The graphic board 130 is provided with a VDP (Video Display Processor) generating image data, the video RAM storing the image data generated by the VDP, and the like. It is to be noted that the image data used in generation of image data by the VDP is included in the game program that has been read from the memory card 54 and stored into the RAM 73.

The graphic board 130 is provided with the VDP (Video Display Processor) generating image data based on the control signal output from the main CPU 71, a video RAM temporarily storing the image data generated by the VDP, and the like. It is to be noted that the image data used in generation of image data by the VDP is included in the game program that has been read from the memory card 54 and stored into the RAM 73.

The controller in the present invention includes the main CPU 71, the ROM 72, the RAM 73, and the memory card 54 storing the game program and the game system program. The controller is configured to control the slot machine by executing the game program and the game system program through the main CPU 71. The controller does not have to be configured as above. It is a matter of course that the configuration may be altered such that the game program and the game system program are stored in the ROM 72 instead of the memory card 54.

(Symbols)

With reference to FIG. 8, a description will be given for the types of the symbols 501 and payouts associated with each combination of the symbols 501. As shown in FIG. 8, the symbols 501 include: wild symbols 505 ("WILD"); woman symbols ("WOMAN"); coin symbols ("COIN"); mirror symbols ("MIRROR"); bowl symbols ("BOWL"): bracelet symbols ("BRACELET"); ace symbols ("ACE"); king symbols ("KING"); queen symbols ("QUEEN"); jack symbols ("JACK"); "ten" symbols ("TEN"); "nine" symbols ("NINE"); and bonus symbols ("BONUS"). In the following description, the woman symbols, the coin symbols, the mirror symbols, the bowl symbols, and the bracelet symbols are collectively referred to as "picture symbols". Further, the ace symbols, the king symbols, the queen symbols, the jack symbols, the "ten" symbols, and the "nine" symbols are collectively referred to as "royal symbols".

The wild symbol 505 is a symbol substitutable for any type of symbols in determination for the line payout. Further, when a predetermined number or more of wild symbols 505 are rearranged on an active line, a line payout is provided. As shown in FIG. 8, the wild symbol 505 is the top symbol, which can cause the line payout the amount of which is higher than that of the other types of symbols 501 considered in the determination for the line payout, if comparison is made under the condition that the number of symbols of a kind is the same.

The picture symbols and the royal symbols are the symbols 501 considered in the determination for the line payout. That is, when a predetermined number or more of any one kind of the picture symbols and the royal symbols are rearranged on an active line, the line payout is awarded. In the present embodiment, out of the picture symbols and the royal symbols, the symbols which cause the line payout when two or more symbols of a kind are rearranged are the top symbols only. As for the other type of symbols, three or more of the symbols of a kind are needed to be rearranged to cause the line payout.

Determination for the bonus symbols is made in a scattered way. Specifically, when three bonus symbols are rearranged in the symbol display area 150, irrespective of the active lines, a scatter payout is awarded to the player. When three bonus symbols are rearranged in the symbol display area 150 in the base game, a bonus game is triggered. That is, the bonus symbols has a function to trigger the bonus game. Further, when three bonus symbols are rearranged in the symbol display area 150 in the free game, an event called "re-trigger" is caused, and the number of plays of the free game is increased. That is, the bonus symbols has a function to cause "re-trigger" in the free game.

In the present embodiment, the bonus symbols in the symbol arrays are arranged so that the maximum number of the bonus symbols rearranged in the symbol display area 150 is three. Specifically, the bonus symbols are included in the symbol arrays of the video reels 151, 153, and 155. Further, in each symbol array, 11 or more other types of symbols are provided between two bonus symbols. This prevents rearrangement of more than three bonus symbols, even when the symbol display area 150 is expanded to the maximum size of 12 rows.

FIG. 8 shows the line payout and the scatter payout for each combination of the symbols 501. As shown in FIG. 8, of these symbols, only the wild symbols 505 and the woman symbols cause the line payout when two of a kind combination is achieved on an active line. As for each of the other types of symbols, the line payout is awarded when three or more symbols of a kind are rearranged on an active line. As for the bonus symbols, the scatter payout is provided only when three bonus symbols are rearranged. The scatter payout of the bonus symbols is multiplied by a total bet amount.

Now, with reference to FIG. 9, description will be given for bet patterns set on the bet buttons (the first bet button 34, the second bet button 35, the third bet button 37, the fourth bet button 38, and the fifth bet button 39) (see FIG. 6).

There are a plurality of bet pattern settings of configurations 1 to 4. In each configuration ("1" to "4" in a bet pattern table), a multiplying factor value is associated with each of the first bet button 34, the second bet button 35, the third bet button 37, the fourth bet button 38, and the fifth bet button 39. For example, in the configuration 2 set by default, "1" is associated with the first bet button 34, "2" is associated with the second bet button 35, "3" is associated with the third bet button 37, "5" is associated with the fourth bet button 38, and "10" is associated with the fifth bet button 39.

Meanwhile, in the slot machine 1 of the present embodiment, the basic bet amount is set to 50 credits. That is, the total bet amount bet by pressing down each bet button is calculated by multiplying the basic bet amount by the multiplying factor value associated with the button in the bet pattern table. To be more specific, in the setting of the configuration 2 (default), the total bet amount bet by pressing down the first bet button 34 is 50. The total bet amount bet by pressing down the second bet button 35 is 100. The total bet amount bet by pressing down the third bet button 37 is 150. The total bet amount bet by pressing down the fourth bet button 38 is 250. The total bet amount bet by pressing down the fifth bet button 39 is 500.

In the present embodiment, the number of the active lines is not changed depending on the size of the total bet amount, but the present invention is not limited to this. For example, the number of the active lines may be increased with the increase of the total bet amount.

The payout amount which has been described with reference to FIG. 8 varies depending on the bet button with which the base game is started. To be more specific, the value associated with each combination of the symbols for the line payout in the table is multiplied by the multiplying factor set on the bet button pressed, and the thus calculated credit amount is paid out as the amount of the line payout. The amount of the scatter payout caused by the bonus symbols is the credit amount calculated by multiplying the number in the table by the total bet amount. The range of the amount of money corresponding to 1 credit is 0.01 to 10 dollars, however, the present invention is not limited to this. The amount of money corresponding to 1 credit may be referred to as "denomination".

<Symbol Arrays>

As shown in FIG. 10A, FIG. 10B, FIG. 10C, FIG. 10D, FIG. 10E, FIG. 11A, FIG. 11B, FIG. 11C, FIG. 11D, and FIG. 11E, combinations of the above-described symbols 501 form symbol arrays. In the base game, the set of the symbol arrays shown in FIG. 10A to FIG. 10E is used. In the free game, the set of the symbol arrays for the free game shown in FIG. 11A to FIG. 11E is used. As shown in FIG. 10A to FIG. 10E and FIG. 11A to FIG. 11E, the bonus symbols appear only on the video reels 151, 153, and 155. Each symbol constituting the symbol array has one of the code numbers. In the base game and the free game, random determination of the code number is performed for each of the video reels 151 to 155, to determine the symbols 501 rearranged in the symbol display area 150.

(Symbol Display Area)

The symbol arrays shown in FIG. 10A to FIG. 10E and FIG. 11A to FIG. 11E are scrolled and displayed on the video reels 151 to 155, and the symbols are rearranged in the display blocks 28. As described above, the size of the symbol display area 150 in which the matrix of the display blocks 28 is formed is variable in the range from the matrix of 5 columns by 3 rows to the matrix of 5 columns by 12 rows. Which of the sizes is used is determined through random determination performed before the rearrangement of symbols. That is, "the predetermined condition (display frame expansion condition) is satisfied" means that any of the matrixes of 5 columns by 4 rows to 5 columns by 12 rows is selected as a result of the random determination before rearrangement of symbols (window number random determination). Meanwhile, "the predetermined condition (display frame expansion condition) is not satisfied" means that the matrix of 5 columns by 3 rows is selected as a result of the random determination before rearrangement of symbols (window number random determination).

(Window Number Random Determination Table)

Referring to FIG. 12 and FIG. 13, a description will be given for window number random determination tables used in the window number random determination. FIG. 12 is a base game window number random determination table used in the window number random determination in the base game. FIG. 13 is a free game window number random determination table used in the window number random determination in the free game. In tables used in random determination, including these tables, weights are set. The main CPU 71 sets, for each object of random determination, the random number range corresponding to the weight of the object, and determines which of the random number ranges includes the extracted random number. In this way, the main CPU 71 performs random determination based on the weights, to select a winning object, for example.

As shown in FIG. 12 and FIG. 13, each of ID numbers 0 to 9 is associated with the numbers of the rows of the matrix (window number) and the weight. The window number random determination is performed based on the weights, and one of the ID numbers 0 to 9 is selected. The ID number 0 is associated with the matrix of 5 columns by 3 rows. Therefore, when the ID number 0 is selected in the window number random determination, the predetermined condition (display frame expansion condition) is not satisfied. The ID numbers 1 to 9 are respectively associated with the matrixes of 5 columns by 4 rows to 5 columns by 12 rows. Therefore, when one of the ID numbers 1 to 9 is selected in the window number random determination, the predetermined condition (display frame expansion condition) is satisfied.

(Reel Position Number Table)

Referring to FIG. 14, a reel position number table will be described. As shown in FIG. 14, in the reel position number table, code numbers (reel position numbers) are set in the maximum matrix of 5 columns by 12 rows to be displayed in the symbol display area 150. Note that "R1" to "R5" respectively represent the video reels 151 to 155. Thus, in the basic matrix of 5 columns by 3 rows, the reel position number 9 is set in the upper stage, the reel position number 10 is set in the middle stage, and the reel position number 11 is set in the lower stage.

(Active Line)

Referring to FIG. 15A and FIG. 15B, an active line setting table will be described. As shown in FIG. 15A and FIG. 15B, each active line is structured by five display blocks 28 each selected from different video reels 151 to 155. The selected display blocks 28 are specified by the reel position numbers. To the active lines, code numbers 1 to 110 are respectively allocated. In the matrix of 5 columns by 3 rows, 20 basic active lines having the code numbers 1 to 20 are used. Each time a row is added to the matrix, ten active lines are added in the following order: the ten active lines 21 to 30, the ten active lines 31 to 40, the ten active lines 41 to 50, the ten active lines 51 to 60, the ten active lines 61 to 70, the ten active lines 71 to 80, the ten active lines 81 to 90, the ten active lines 91 to 100, and the ten active lines 101 to 110.

Specifically, in the matrix of 5 columns by 3 rows, 20 active lines are set; in the matrix of 5 columns by 4 rows, 30 active lines are set; in the matrix of 5 columns by 5 rows, 40 active lines are set; in the matrix of 5 columns by 6 rows, 50 active lines are set; in the matrix of 5 columns by 7 rows, 60 active lines are set; in the matrix of 5 columns by 8 rows, 70 active lines are set; in the matrix of 5 columns by 9 rows, 80 active lines are set; in the matrix of 5 columns by 10 rows, 90 active lines are set; in the matrix of 5 columns by 11 rows, 100 active lines are set; and in the matrix of 5 columns by 12 rows, 110 active lines are set.

For example, as shown in FIG. 16A, the active lines having the code numbers 21 to 30, which are added to form the matrix of 5 columns by 4 rows are determined in the following manner. Each of the basic active lines of "1" to "20" for the matrix of 5 columns by 3 is formed by a combination of the reel position numbers 9 to 11. The set of the basic active lines each formed by the reel position numbers 9 to 11 is referred to as a basic active line set. Suppose the reel position numbers forming each active line in such an active line set are 8 to 10. These lines are referred to as additional active line set candidates. That is, each additional active line set candidate is formed by the reel position numbers the range of which is shifted by 1 to the negative side from the range of the reel position numbers for the basic active line set. Then, after the active lines included in the basic active line set are excluded from the additional active line set candidates, a predetermined number of (ten) lines are selected, to function as the active lines of code numbers 21 to 30 (additional active line set), which are added when the size of the matrix is increased to the matrix of 5 columns by 4 rows.

Each of the active lines of code numbers 31 to 40, which are added together with the above additional active line set when the size is increased to the matrix of 5 columns by 5 rows, is formed by the reel position numbers, the range of which is shifted by 1 to the negative side from that of the above additional active line combinations. Each time a row is added to the matrix in the symbol display area 150, an additional active line set having the predetermined number of the active lines is added, based on the position of the added row. Note that in the actual processing, the active lines are set with reference to the active line setting table (FIG. 15A and FIG. 15B).

Figure 16B:
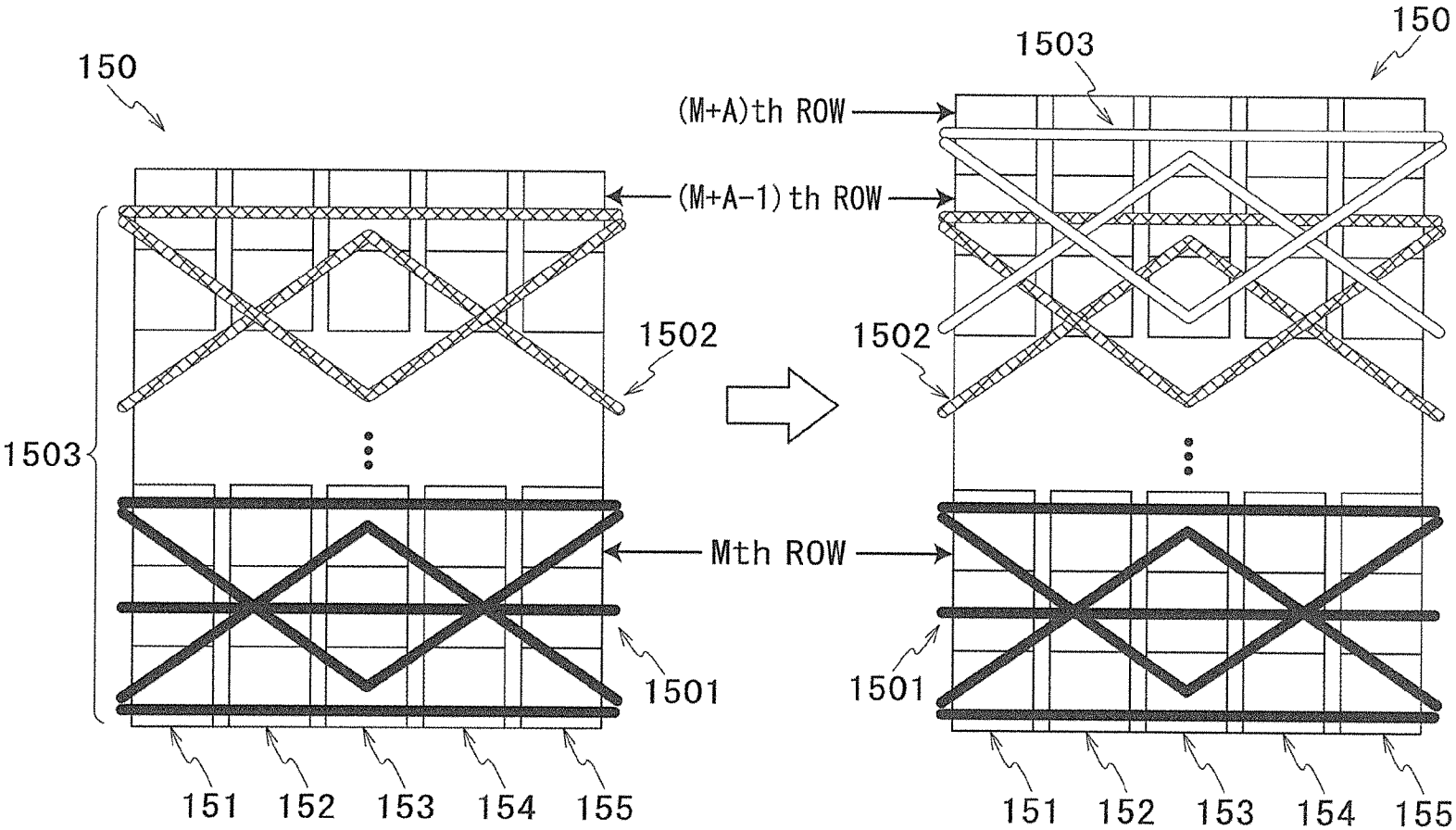
FIG. 16B is an explanatory diagram illustrating how to add the active lines.

As shown in the left part of FIG. 16B, when the matrix of M columns by N+α−1 rows is displayed in the symbol display area 150, active lines 1503 including: the basic active line set 1501; and an additional active line set 1502 selected based on the matrix of the M columns by N+α−1 rows are set. When comparing this with the case where the matrix of M columns by N+α rows is displayed in the symbol display area 150, another additional active line set 1504 arranged in the same manner as that of the additional active line combination 1502 based on the matrix of M columns by N+α−1 rows is added based on the matrix of M columns by N+α rows. As such, the active lines in the matrix of M columns by N+α rows are set by adding the predetermined number of active lines (additional active lines) to the active lines of the matrix of M columns by N+α−1 rows.

Figure 16C:
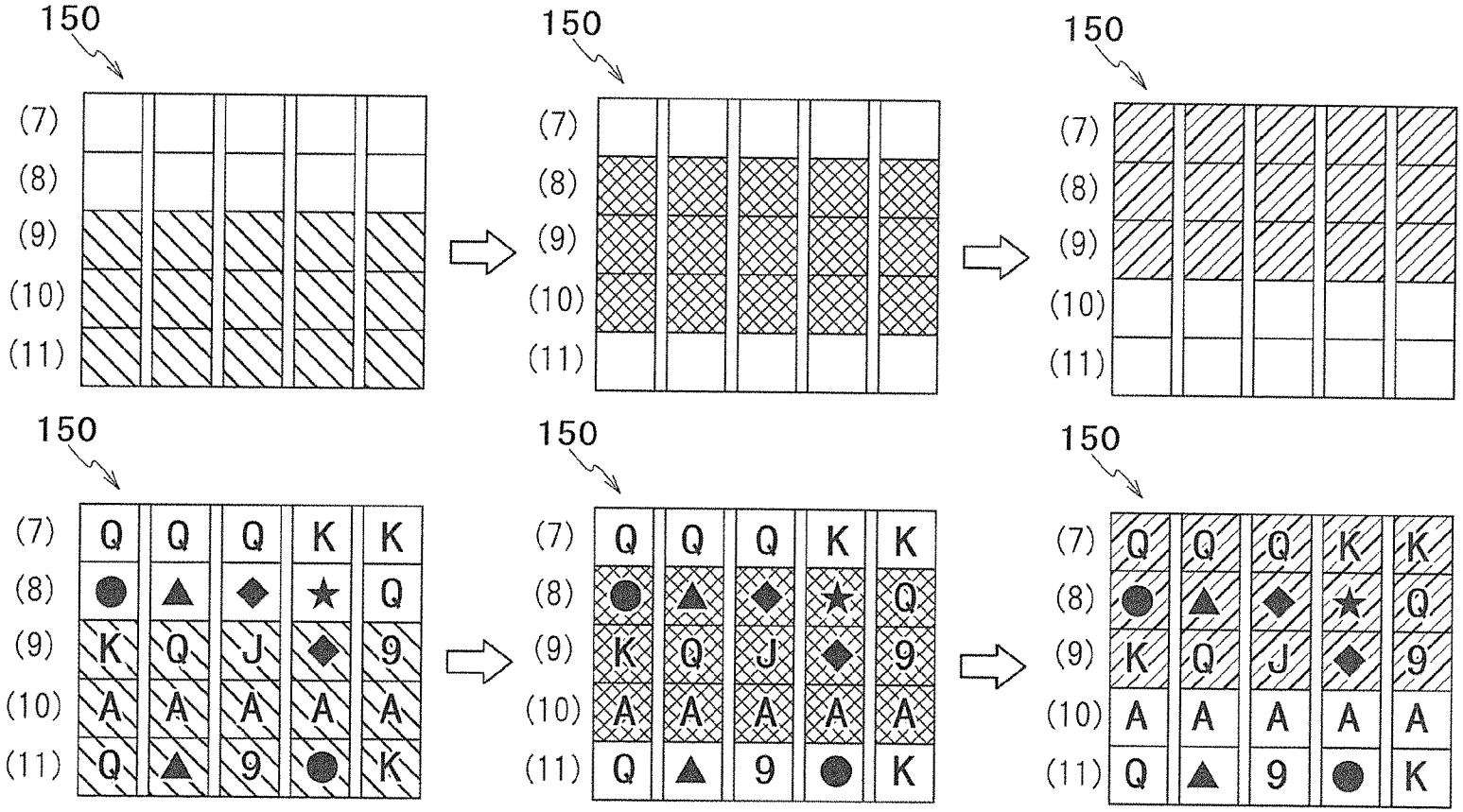
FIG. 16C is an explanatory diagram illustrating how to determine winnings on the active lines.

Referring to FIG. 16C, a description will be given on a way of making determination on the active lines. As shown in FIG. 16C, when the symbol display area 150 is defined by the matrix of 5 columns by 5 rows (reel position numbers: 7 to 11), for example, the determination for the line payout on the active lines No. 1 to No. 20 (see FIG. 15A and FIG. 15B) is performed first in the range of the rows corresponding to the reel position numbers 9 to 11 (see FIG. 14). In the example shown in FIG. 16C, a "5 of a kind" combination of the symbols "A" is achieved on the active line No. 1.

Then, the range of the determination is shifted upward, and the determination for the line payout on the active lines No. 21 to No. 30 (see FIG. 15A and FIG. 15B) is performed in the range of the rows corresponding to the reel position numbers 8 to 10 (see FIG. 14). The active line No. 1 on which the winning of the line payout has been made is included in the above range. However, the determination on this line has already been made, and therefore this line is excluded from the objects for the determination at this stage.

Then, the range of the determination is shifted further upward, and the determination for the line payout on the active lines No. 31 to No. 40 (see FIG. 15A and FIG. 15B) is performed in the range of the rows corresponding to the reel position numbers 7 to 9 (see FIG. 14). In the example shown in FIG. 16C, a "3 of a kind" combination of the symbols "Q" is achieved on the active line No. 31.

In this way, the range of the determination is shifted correspondingly to the number of rows added to the basic matrix in the symbol display area 150, and the determination for the payout is performed on the active lines of the additional active line set(s), which have been described with reference to FIG. 16B.

Figure 16D:
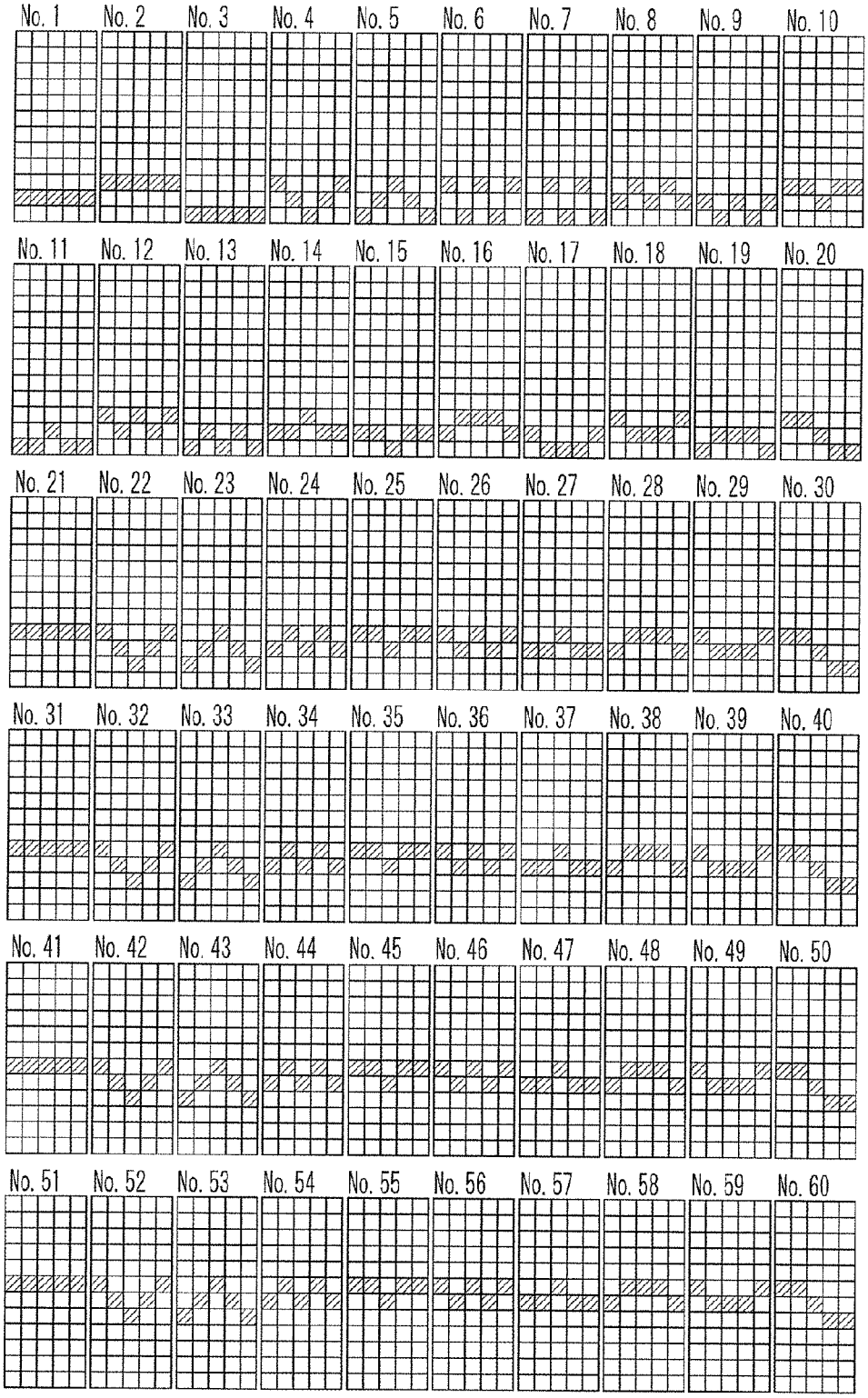
FIG. 16D is an explanatory diagram illustrating the types of the active lines.
Figure 16E:
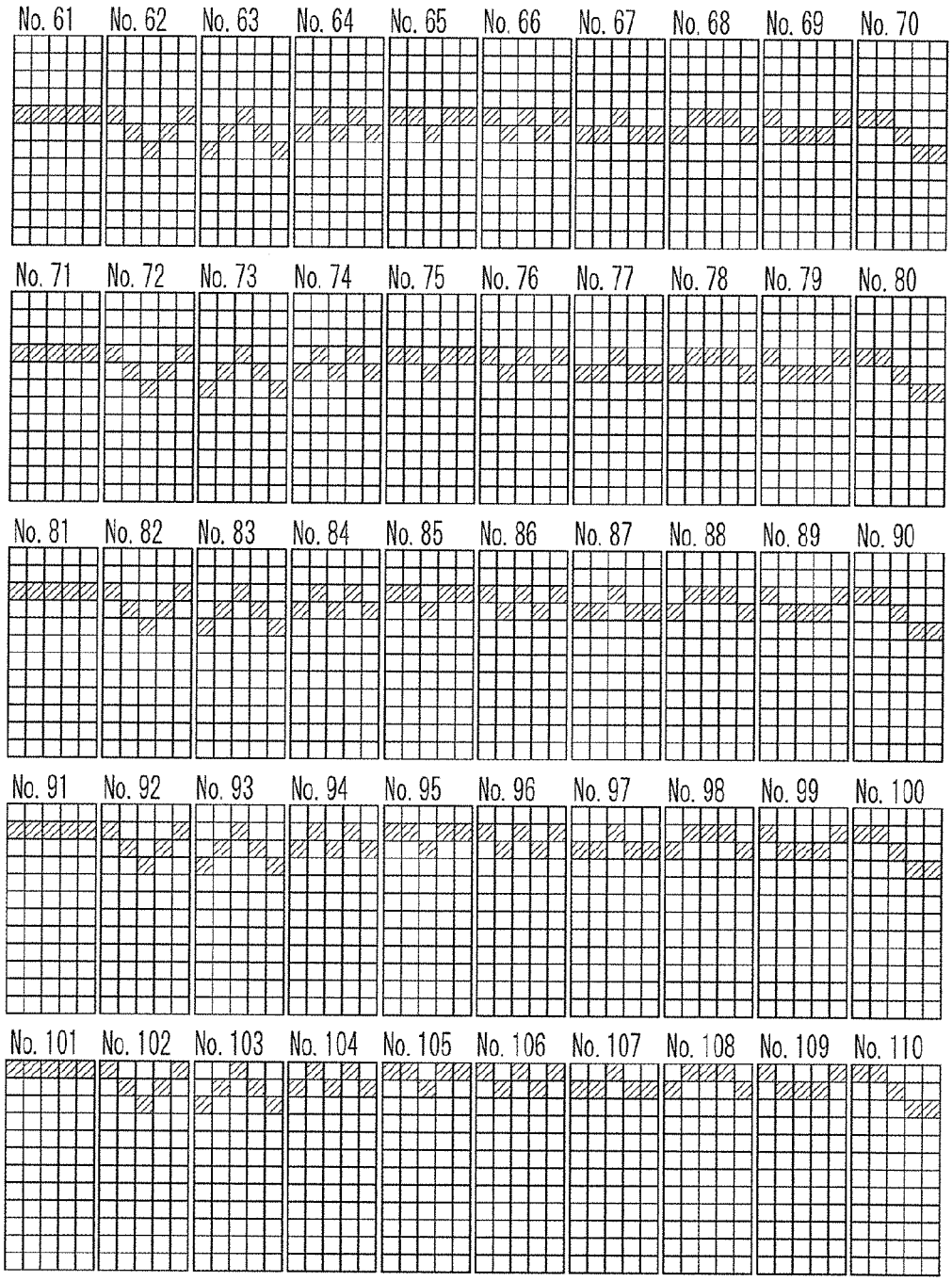
FIG. 16E is an explanatory diagram illustrating the types of the active lines.

FIG. 16D and FIG. 16E show all the active lines (No. 1 to No. 110) corresponding to the lines in the active line setting table (see FIG. 15A and FIG. 15B). In FIG. 16D and FIG. 16E, each matrix of 5 columns by 12 rows is the matrix of the display blocks 28 in the symbol display area 150. The shaded areas are display blocks 28 forming the active line. As shown in FIG. 16D and FIG. 16E, the additional active line sets to be added with the increase in the number of rows (No. 21 to No. 30; No. 31 to No. 40; No. 41 to No. 50; No. 51 to No. 60; No. 61 to No. 70; No. 71 to No. 80; No. 81 to No. 90; No. 91 to No. 100; No. 101 to No. 110) are identical in the patterns of the lines but the positions of the lines are shifted.

Thus, the difference between the active lines in the matrix of M columns by N+α rows and those of the matrix of M columns by N+α−1 rows is the predetermined number of added active lines only (the differential), and all the remaining active lines in the matrix of M columns by N+α rows are identical with those in the matrix of M columns by N+α−1 rows. With this, when the number of the rows of the matrix in the symbol display area 150 is increased and the number of the active lines is increased, there is a possibility that the active lines easily understandable are provided to the player.

As described above, even if it seems that, at a glance, the symbols are stopped randomly, it is determined that a winning has been made as long as the symbols of a kind appears on an active line successively from the video reel 151 to the video reel 155 (from "left to right"). It should be noted that the symbols 501 of a kind have to be rearranged successively from the video reel 151. Although the "left to right" way is adopted in the present embodiment, the present invention is not limited to this. The present invention may be arranged such that a payout is awarded when a predetermined number or more of symbols of a kind are rearranged on an active line irrespective the running direction of the active line. Alternatively, a scatter way may be adopted in which a payout is awarded when a predetermined number or more of symbols of a kind are rearranged anywhere in the symbol display area 150. Further alternatively, the number of the activated display blocks 28 may be changed depending on the bet amount.

(Game Flow)

Figure 17:
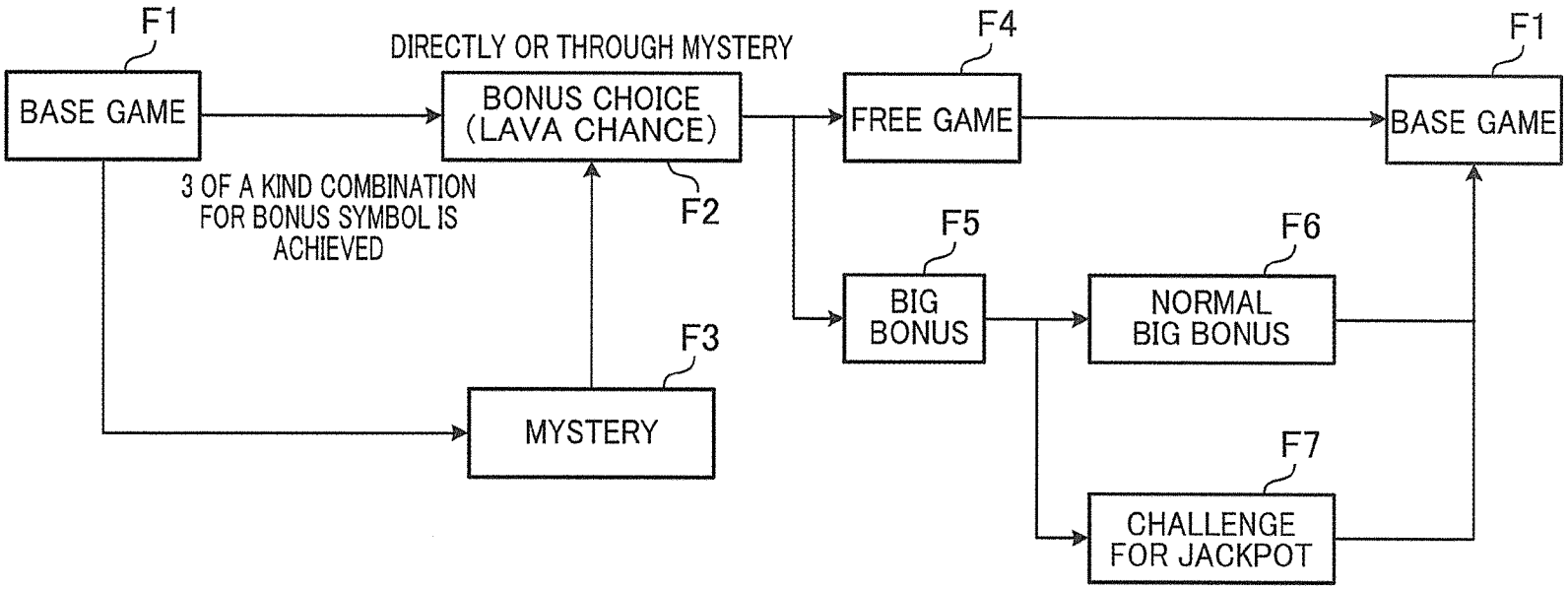
FIG. 17 is an explanatory diagram of a game flow.

Referring to FIG. 17, the flow of the game will be described. First, the base game is executed (F1). When a 3 of a kind combination of the bonus symbols is achieved in the base game, a bonus choice ("LAVA CHANCE") is executed. When the mystery feature is won simultaneously with the 3 of a kind combination of the bonus symbols, the mystery feature is executed first (F3) and then the bonus choice ("LAVA CHANCE") is executed.

The mystery feature is the above-described mystery feature. In the present embodiment, a mystery feature trigger random determination is performed when one or more rows are added to the matrix in the window number random determination in the base game or the free game. When a winning is made in the mystery feature trigger random determination after the addition of the row(s) to the matrix, either an expand wild feature or a lava wild feature occurs. In the expand wild feature and the lava wild feature, some of the symbols rearranged in the base game or the free game are changed to the wild symbols, and the thus changed symbols are treated as the wild symbols 505 in the determination for the line payout. That is, "the mystery feature is executed and then the bonus choice is executed" or "the bonus choice is executed via the mystery feature" means that the expand wild feature or the lava wild feature is adopted in the base game, and three bonus symbols are rearranged to trigger the bonus game. After each bonus symbol has been changed to the wild symbol 505, the thus changed symbol still has a function as a bonus symbol.

The bonus choice is a game in which a selection is made from two types of the bonus game. In the bonus choice, either the free game (F4) or a big bonus (F5) is selected. As for the free game, a predetermined number of plays of the free game is set. If three bonus symbols are rearranged in the free game, i.e., when the re-trigger condition is satisfied, the number of plays of the free game is increased, but transition to the big bonus does not occur. In the following description, the big bonus may be referred to as "PICK BONUS".

The big bonus is a game in which a selection is made from a plurality of options to determine the amount of payout. In the big bonus, there are "normal big bonus" (F6) and "challenge for jackpot" (F7). The normal big bonus and the challenge for jackpot are different from each other in the type of obtainable payout. Which of the normal big bonus and the challenge for jackpot is executed is determined through random determination. In the following description, the challenge for jackpot may be referred to as "challenge".

After the free game, the normal big bonus, or the challenge for jackpot ends, the processing returns back to the base game (F1).

(Display Screen)

The following describes display screens displayed, in each of the above games, on the upper image display panel 131 and the lower image display panel 141.

(Display Screen: Layout)

Figure 18:
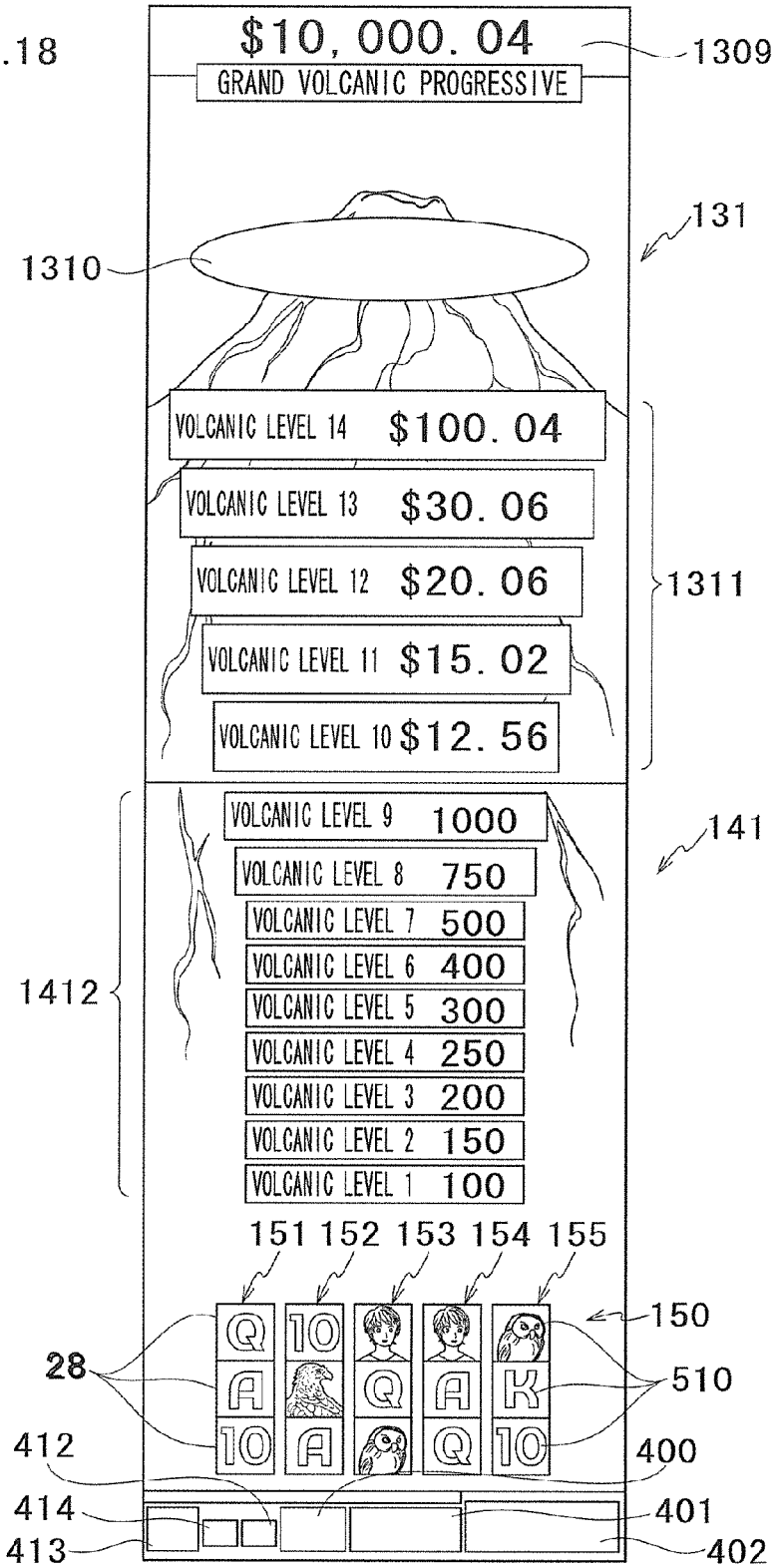
FIG. 18 is an explanatory diagram of an example display screen in a base game.

With reference to FIG. 18, the following describes a basic screen layout on the upper image display panel 131 and the lower image display panel 141. FIG. 18 illustrates an idle state before execution of the base game.

As shown in FIG. 18, the upper image display panel 131 displays thereon a grand progressive value display unit 1309 and a title logo image 1310. Further, a fixed payout display unit 1412 is displayed on an upper portion and a central portion of the lower image display panel 141. The title logo image 1310 shows the model name of the slot machine 1.

The grand progressive value display unit 1309 and the progressive value display unit 1311 indicate various progressive values. The fixed payout display unit 1412 indicates various fixed payouts. The various progressive values indicated in the grand progressive value display unit 1309 and the progressive value display unit 1311, and the various fixed payouts indicated in the fixed payout display unit 1412 are obtainable in the big bonus. These are collectively referred to as "big bonus payouts".

The big bonus payouts are ranked at levels from Level 1 to Level 15, according to the size of the payout. Level 1 is the rank for the lowest big bonus payout, while Level 15 is the rank for the highest big bonus payout. The highest big bonus payout at Level 15 is displayed in the grand progressive value display unit 1309. The rank of the level 15 may also be referred to as "grand volcanic progressive".

The big bonus payouts at Level 10 to Level 14 are displayed in the progressive value display unit 1311. The big bonus payouts at Level 1 to Level 9 are displayed in the fixed payout display unit 1412. Ranks of Level 1 to Level 14 may also be referred to as "volcanic levels 1 to 14".

(Display Screen: Mystery Feature)

The following will describe: an effect of expanding the symbol display area 150 (expansion effect) provided when the mystery feature occurs in the base game and the free game; and the expand wild feature and the lava wild feature after the expansion effect.

(Display Screen: Mystery Feature: Expansion Effect)

Figure 19:
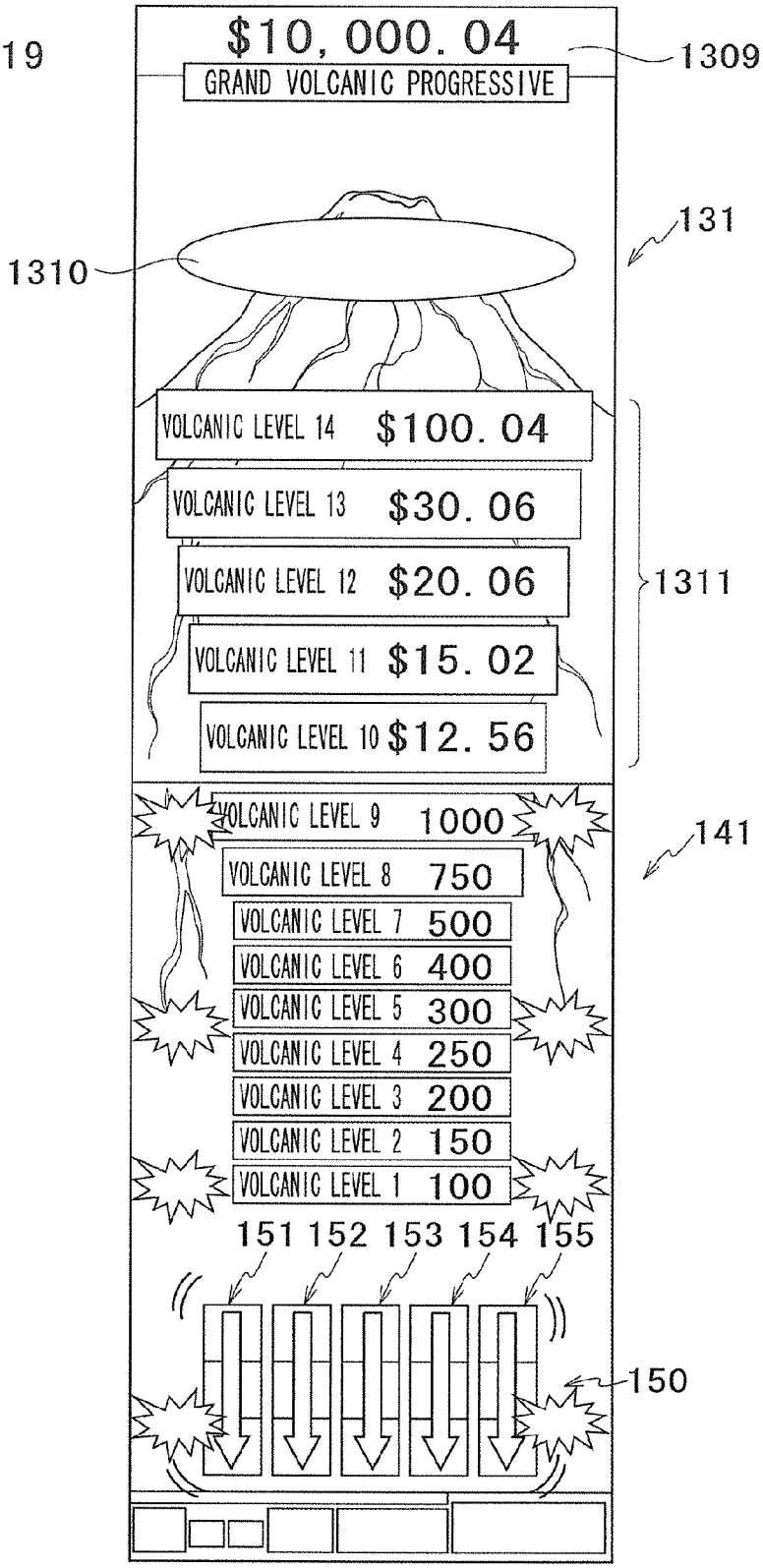
FIG. 19 is an explanatory diagram of an example display screen in a mystery feature.

As shown in FIG. 19, when it is determined that the mystery feature occurs, a shake effect in which the video reels 151 to 155 and the entire screen of the lower image display panel 141 shake is provided after the start of the scroll-display of the video reels 151 to 155. This effect shows that the mystery feature occurs, and at least the expansion of the symbol display area 150 has been determined. That is, after this effect is provided, the symbol display area 150 is always expanded and the number of the display blocks 28 is increased. Such an effect of indicating the shifting to the state more advantageous than in the normal state, or indicating that a payout the amount of which is more than a predetermined value will be obtained, is referred to as an indication effect. The indication effects other than the shake effect will be described later.

Figure 20:
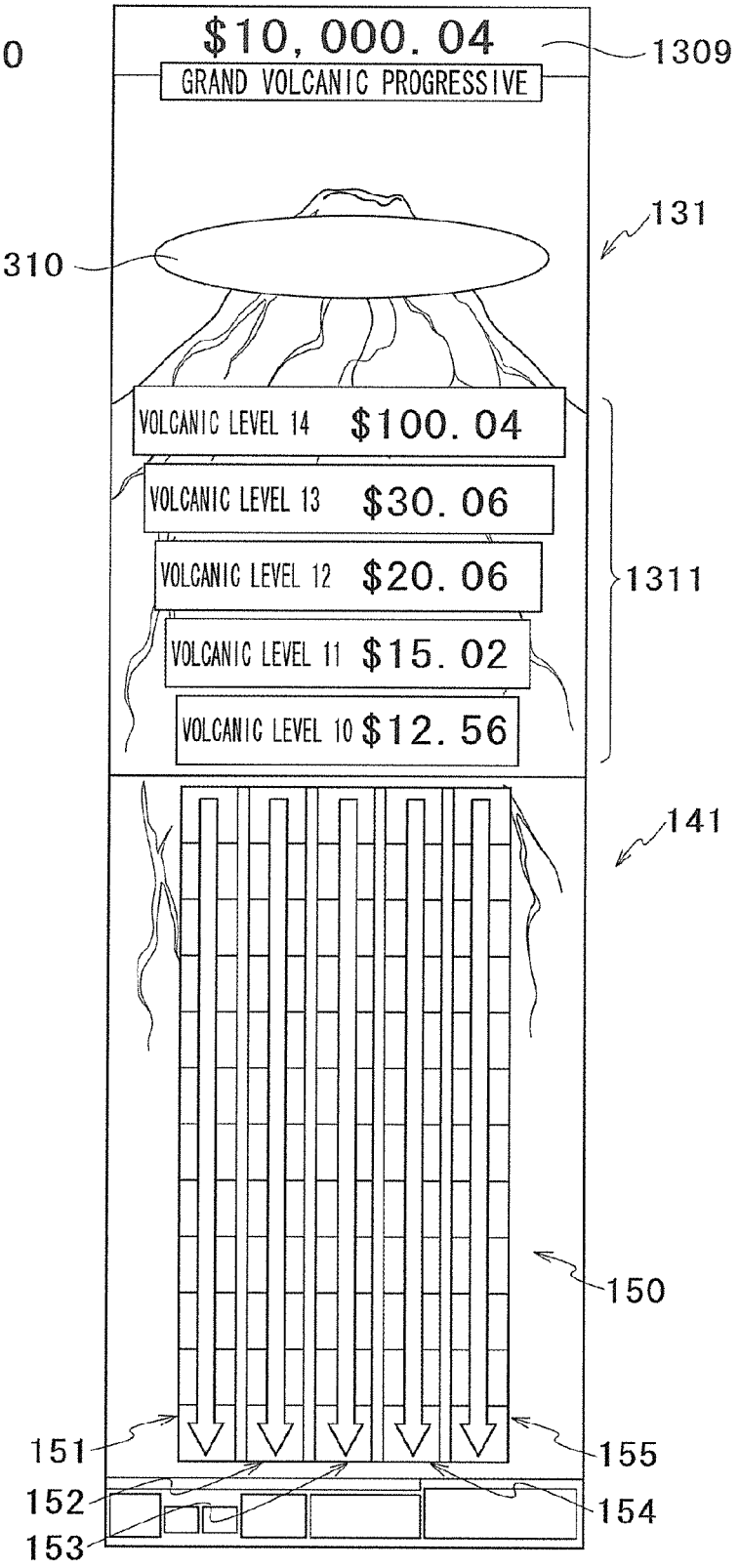
FIG. 20 is an explanatory diagram of an example display screen in the mystery feature.

Then, as shown in FIG. 20, there is provided an effect in which the symbol display area 150 is expanded in accordance with the matrix, the number of rows of which has been determined through random determination during the scrolling of the reels. It takes 0.8 seconds from the start to the end of the expansion. The fixed payout display unit 1412 displayed on the lower image display panel 141 is hidden. In the example of FIG. 20, the matrix in the symbol display area 150 has been expanded to the matrix of 5 columns by 12 rows.

Figure 21:
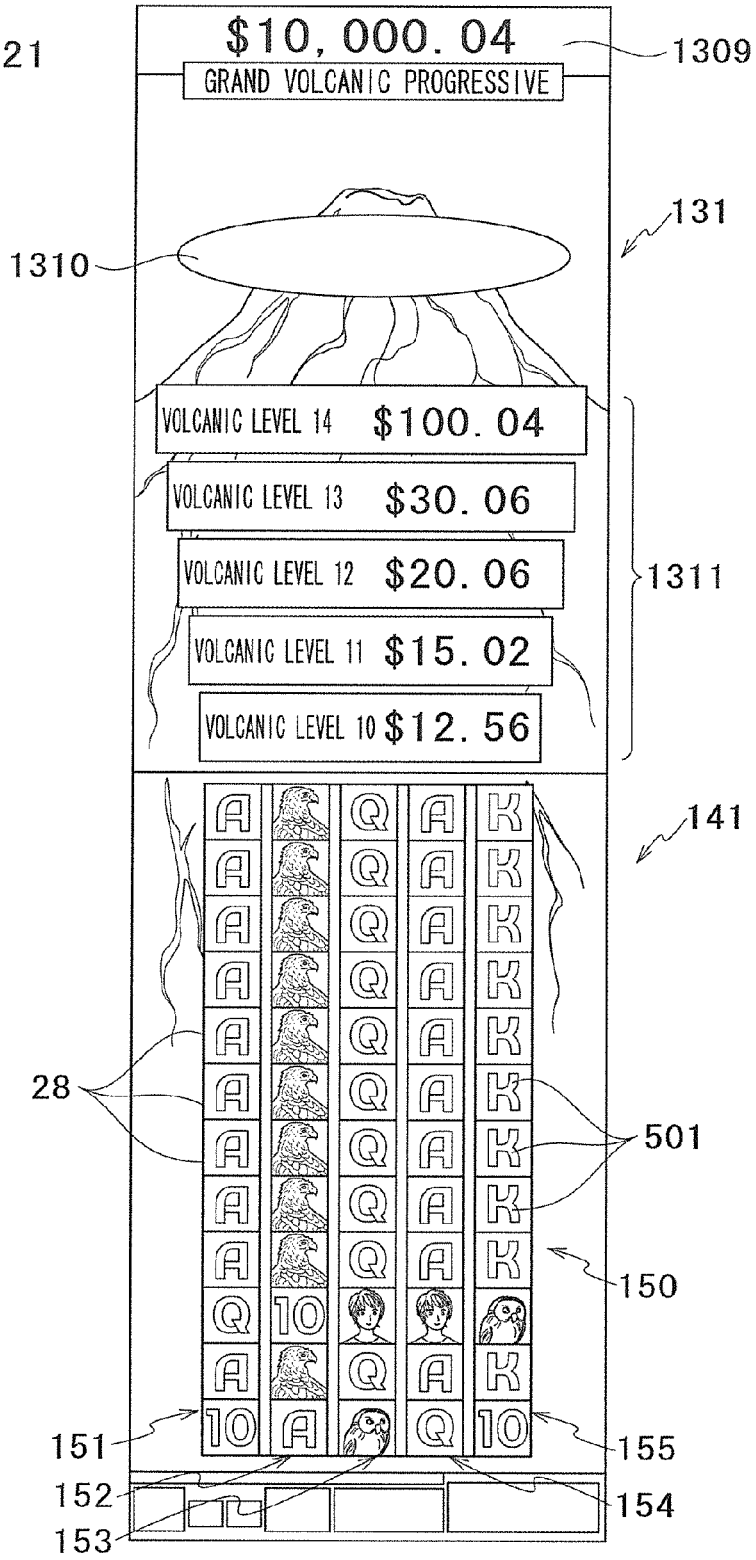
FIG. 21 is an explanatory diagram of an example display screen in the mystery feature.

Then, all the symbols on the video reels 151 to 155 are rearranged as shown in FIG. 21, and a result determination is performed. In the example of FIG. 21, there is the matrix of 5 columns by 12 rows in the symbol display area 150, and therefore the determination for the line payout is performed on 110 active lines.

In the base game, this display state is maintained until the next play is started, or until the settlement of credits is performed, after the game is over. In the free game, if the remaining number of plays of the free game is not zero, the matrix in the symbol display area 150 returns to the basic matrix of 5 columns by 3 rows (see FIG. 18), and the play of the free game is started again.

(Display Screen: Mystery Feature: Expand Wild Feature)

The following describes the case where the expand wild feature occurs in the scroll-display state shown in FIG. 20.

Figure 22:
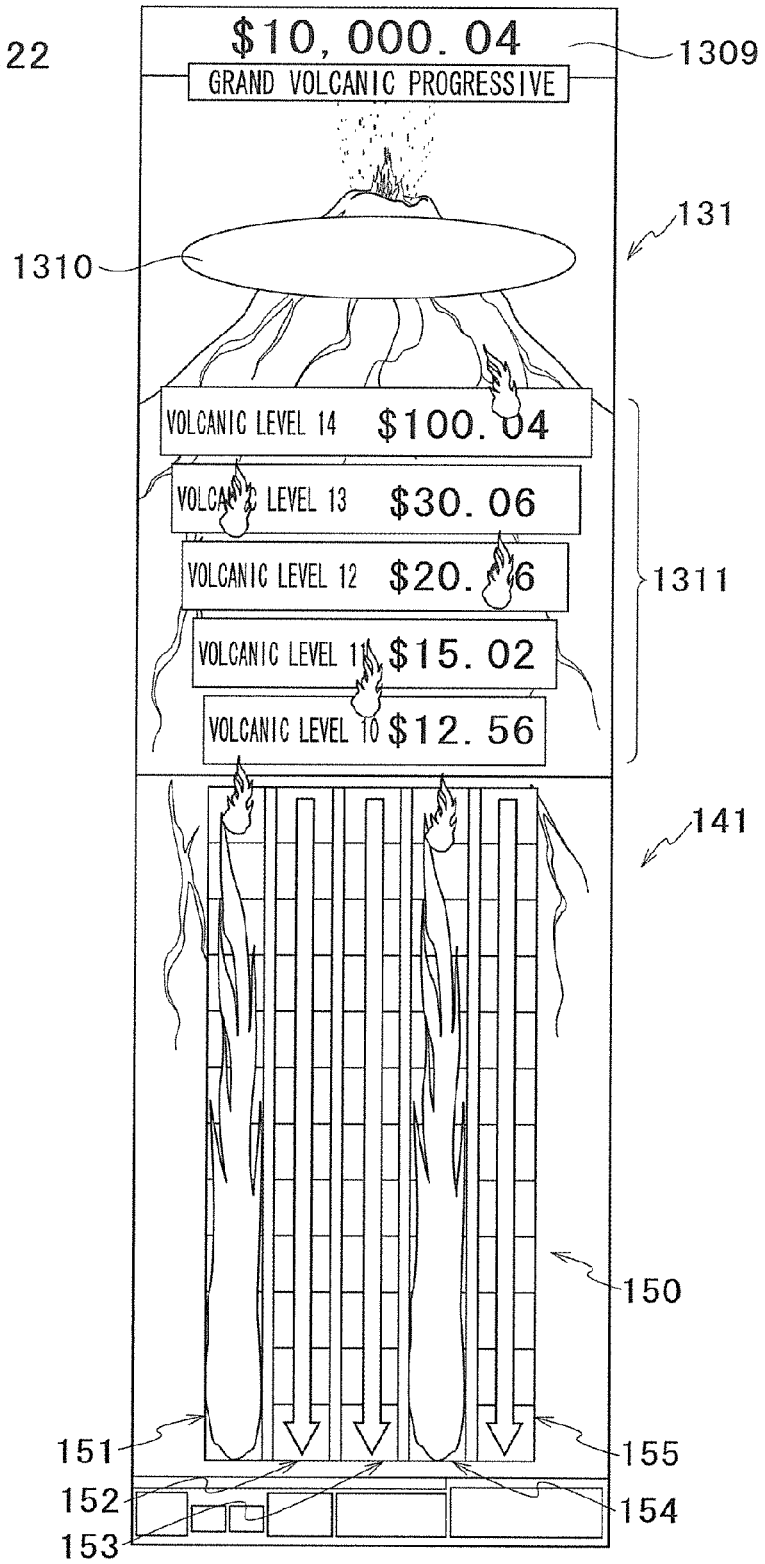
FIG. 22 is an explanatory diagram of an example display screen in the mystery feature.

As shown in FIG. 22, during the scroll-display in the expanded symbol display area 150, an effect in which a volcano erupts is provided on the upper image display panel 131. After an effect in which rocks from the volcano hit predetermined reels of the video reels 151 to 155 is provided, areas of the video reels which were hit by the rocks are covered with magma.

Figure 23:
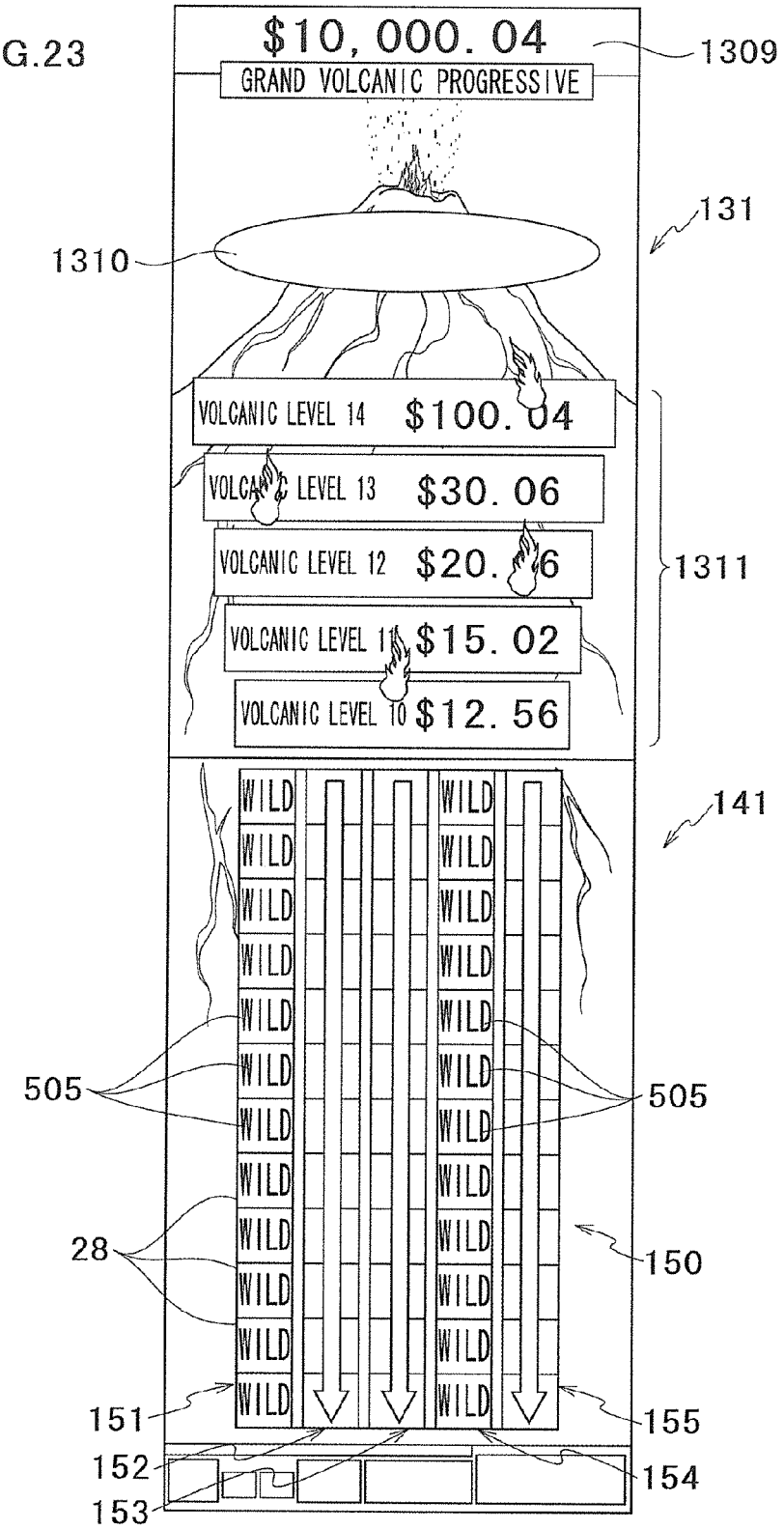
FIG. 23 is an explanatory diagram of an example display screen in the mystery feature.

Then, as shown in FIG. 23, in all the display blocks 28 of the video reel areas covered with magma, the wild symbols 505 are rearranged and displayed while the remaining reels are scrolled.

Figure 24:
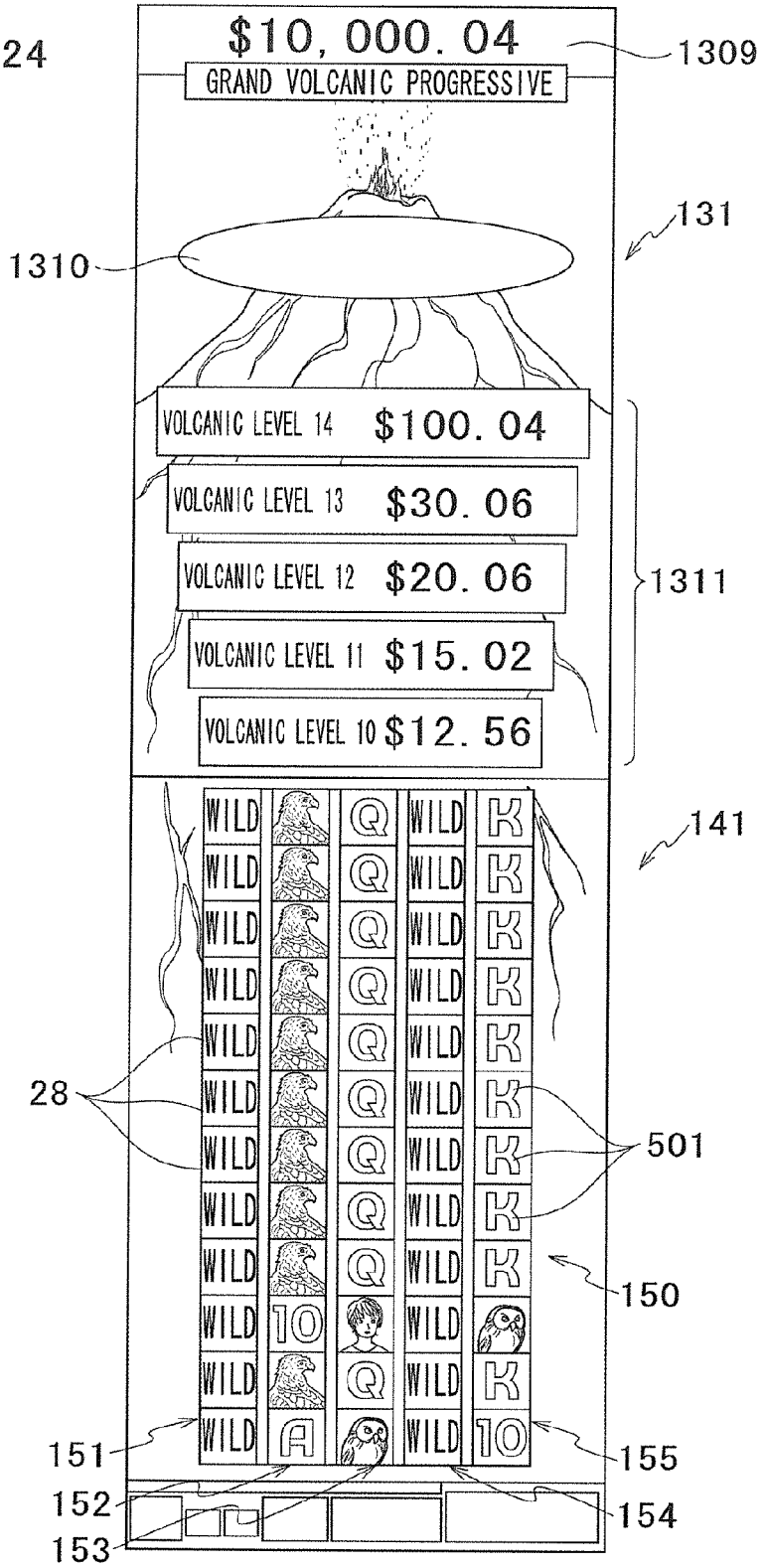
FIG. 24 is an explanatory diagram of an example display screen in the mystery feature.

Then, as shown in FIG. 24, all the symbols on the video reels 151 to 155 are rearranged, and a result determination is performed with the wild symbols 505 rearranged on the entire video reels covered with magma. Thereafter, this display state is maintained until the next play is started, or until the settlement of credits is performed, after the game is over. In the free game, if the remaining number of plays of the free game is not zero, the matrix in the symbol display area 150 returns to the basic matrix of 5 columns by 3 rows (see FIG. 18), and the play of the free game is started again.

(Display Screen: Mystery Feature: Lava Wild Feature)

The following describes the case where the lava wild feature occurs in the state where the symbols 501 have been rearranged but a payout has not been awarded, as shown in FIG. 21.

Figure 25:
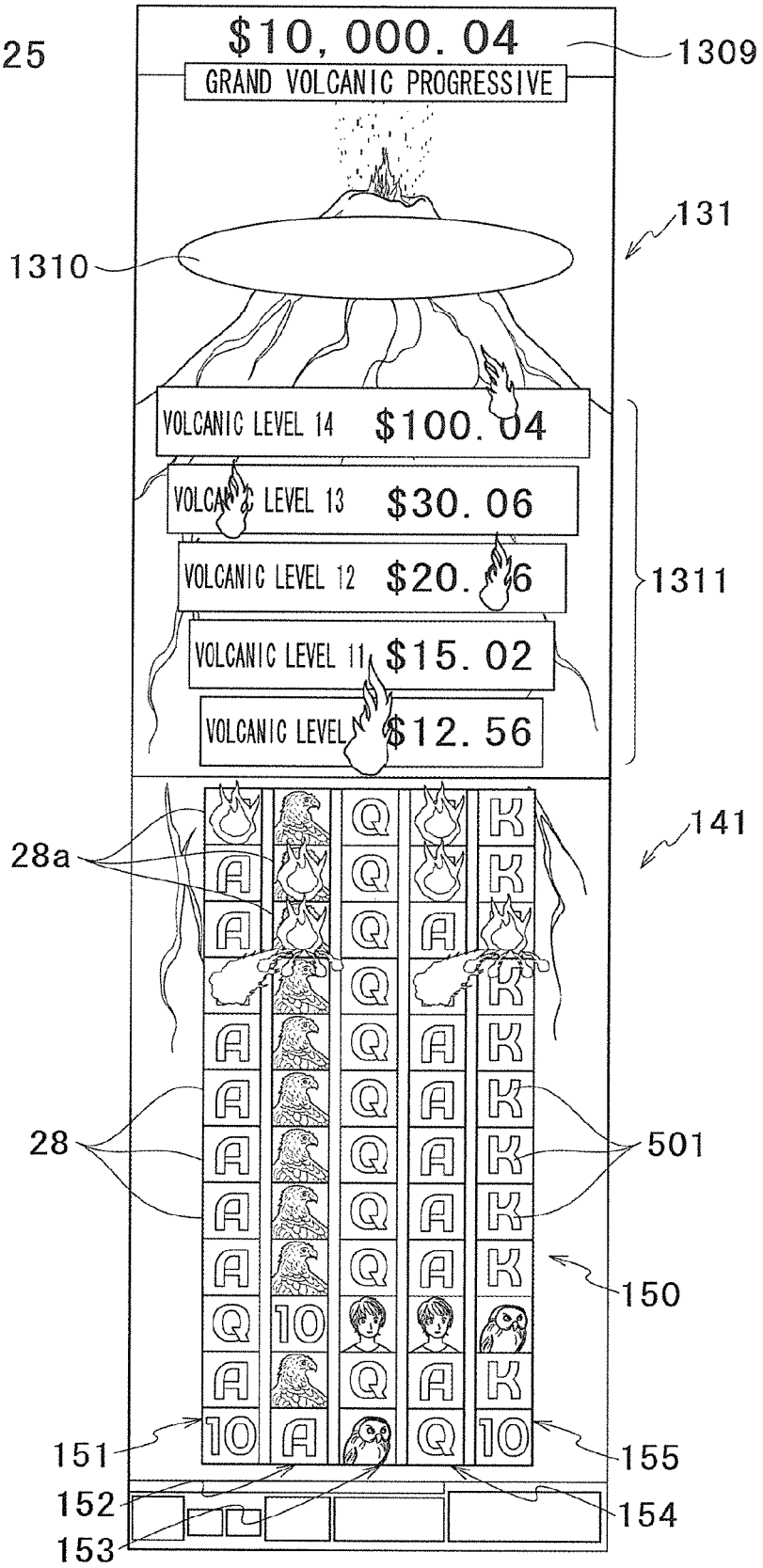
FIG. 25 is an explanatory diagram of an example display screen in the mystery feature.
Figure 26:
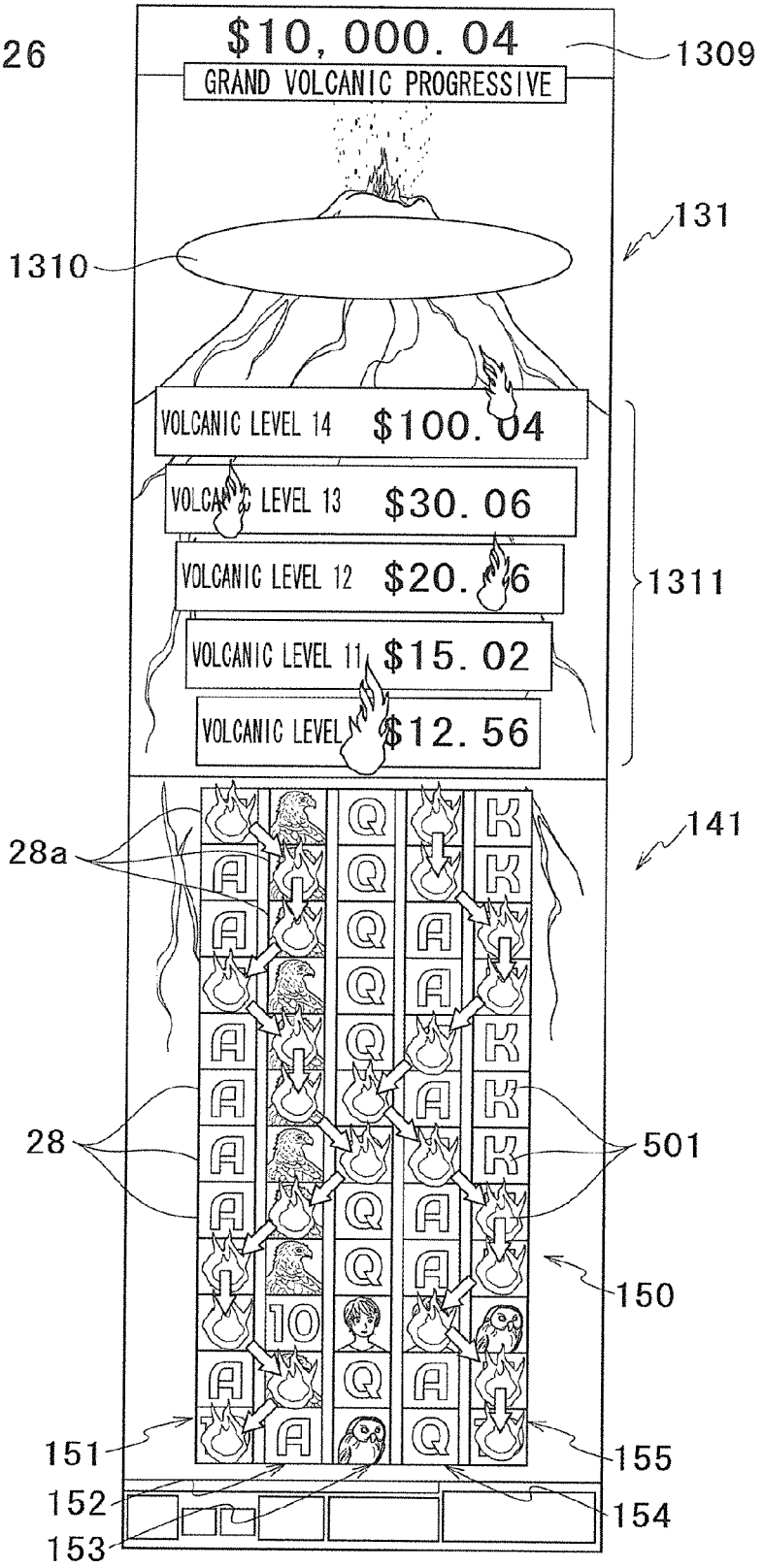
FIG. 26 is an explanatory diagram of an example display screen in the mystery feature.

As shown in FIG. 25 and FIG. 26, in the state where the symbol display area 150 has been expanded and then the symbols 501 are rearranged, an effect of eruption of the volcano is provided and explosion sound is output from the speaker 112. Then a magma effect is provided, in which magma flows in a column progression direction (downward) through the display blocks 28 in accordance with a predetermined pattern sequentially from the uppermost display block 28 (change block 28*a*) to the lowermost display block 28 (change block 28*a*) out of these blocks. In the present embodiment, the effect is provided sequentially from the change block 28*a* having a smaller reel position number toward the change block 28*a* having a larger reel position number. However, the direction in which the magma flows may be opposite to this direction. Then, provided is an effect in which the symbols 501 in the change blocks 28 along the path of the flow of the magma are changed to flame. Arrows in FIG. 26 indicate the paths of the flow of the magma.

Figure 27:
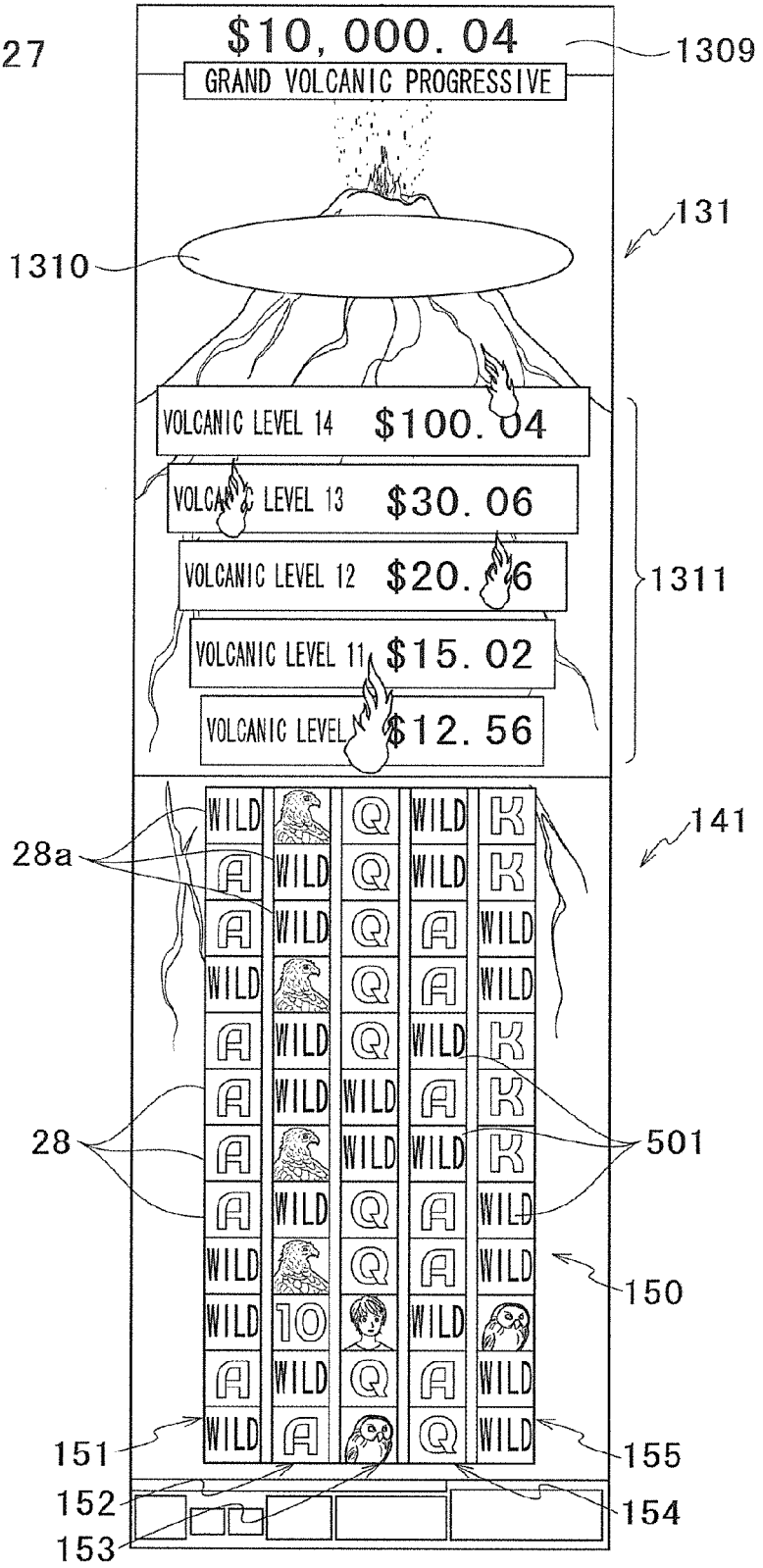
FIG. 27 is an explanatory diagram of an example display screen in the mystery feature.

Then, as shown in FIG. 27, there is provided an effect in which the wild symbols 505 are displayed in all the change blocks 28*a*. Thereafter, the result determination is performed in which the symbols 501 rearranged in the change blocks 28 are treated as the wild symbols 505.

In the base game, this display state is maintained until the next play is started, or until the settlement of credits is performed, after the game is over. In the free game, if the remaining number of plays of the free game is not zero, the matrix in the symbol display area 150 returns to the basic matrix of 5 columns by 3 rows (see FIG. 18), and the play of the free game is started again.

(Display Screen: Mystery Feature: Lava Wild Feature: Change Block)

Figure 28:
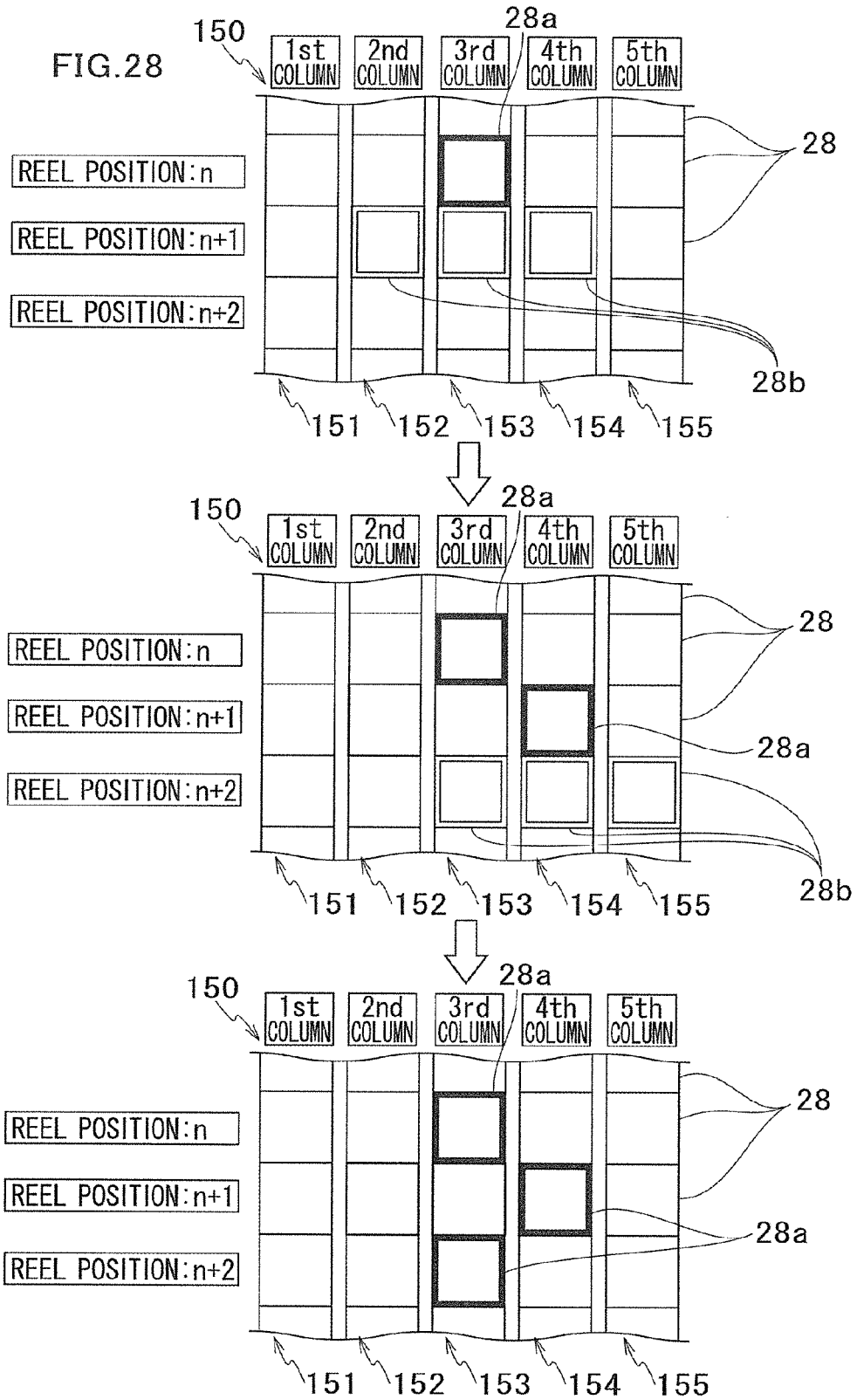
FIG. 28 is an explanatory diagram illustrating the positions of change blocks in the mystery feature.

Referring to FIG. 28, how the display blocks 28 are selected as the change blocks 28*a* will be described.

First, suppose that the display block 28 to be selected as the change block 28*a* has been determined in the row of the reel position number "n". The position of the change block 28*a* in the row of the reel position number "n+1" is determined based on the position of the change block 28*a* in the row of the reel position number "n". To be more specific, if the change block 28*a* in the row of the reel position number "n" is in the mth column, the display blocks 28 in the (m−1)th column, the mth column, and the (m+1)th column are candidate blocks 28*b* in the row of the reel position number "n+1". For example, in the example shown in FIG. 28, the change block 28*a* in the row of the reel position number "n" is positioned in the third column, and therefore, the candidate blocks 28*b* in the row of the reel position number "n+1" are the blocks in the second, third, and fourth columns.

Then, one of these candidate blocks 28*b* is selected as the change block 28*a*. In the example of FIG. 28, in the row of the reel position number "n+1", the candidate block 28*b* in the fourth column is selected as the change block 28*a*. The change block 28*a* in the row of the reel position number "n+2" is determined in the same manner, based on the position of the change block 28*a* in the row of the reel position number "n+1".

In the present embodiment, there are a plurality of patterns for selecting the display blocks 28 to be converted to the change blocks in the above-described manner. One pattern is randomly selected from these patterns, and in accordance with the selected pattern, the blocks 28 are converted to the change blocks. It should be noted that the present invention is not limited to this. For example, each time the lava wild feature is executed, the display blocks 28 to be converted to the change blocks 28*a* may be selected in the above-described manner.

(Display Screen: Mystery Feature: Lava Wild Feature: Double Symbol)

The following describes the case where one or more of the display blocks 28 in which the bonus symbols 504 are rearranged are selected as the change blocks 28*a* in the lava wild feature.

Figure 29:
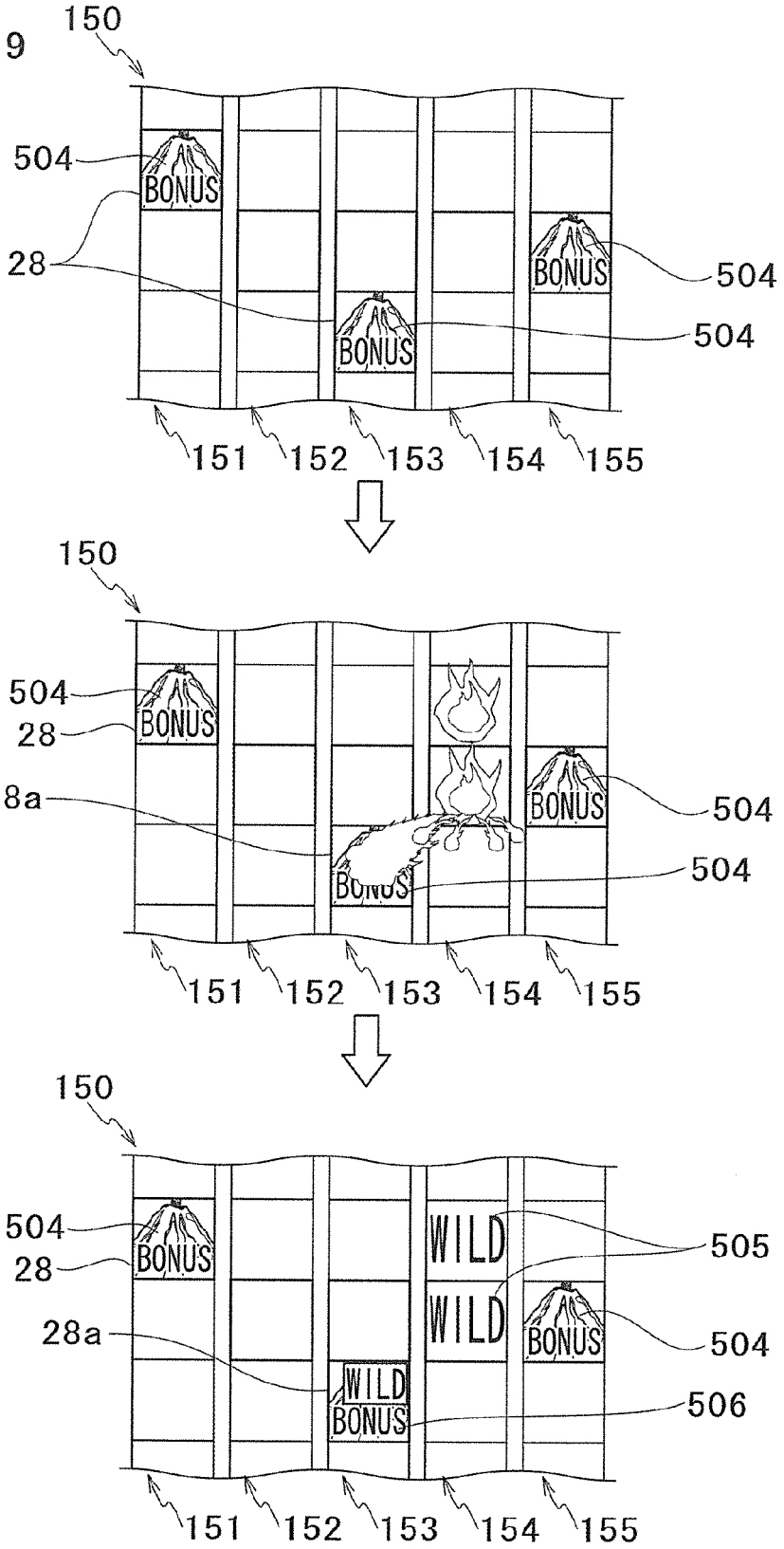
FIG. 29 is an explanatory diagram of an example display screen in the mystery feature.

As shown in an upper part of FIG. 29, before the effect of the lava wild feature is provided, three bonus symbols 504, which trigger the bonus game, are rearranged. Then, the lava wild feature occurs, and the display block 28 of in which the bonus symbol 504 is rearranged is included in the display blocks 28 selected as the change blocks 28*a*.

In this case, the bonus symbol 504 in the change block 28*a* is changed to a double symbol 507 having both the function as the wild symbol 505 and the function as the bonus symbol 504, after the effect of the lava wild feature is provided. That is, the double symbol 507 is treated as the wild symbol 505 in the determination for the line payout. Meanwhile, the double symbol 507 is treated as the bonus symbol 504 in the determination for the scatter payout of the bonus symbols 504. In the determination for the trigger condition of the bonus game during the base game, the double symbol 507 is treated as the bonus symbol 504. In the determination for the re-trigger condition in the free game, the double symbol 507 is treated as the bonus symbol 504.

(Display Screen: Animal Indication Effect)

The indication effect will be specifically described. In addition to the above-described indication effect provided when the symbol display area 150 is expanded, there is an animal indication effect indicating the bonus game or the payout the amount of which is 20 times or more of the bet amount. There are two types of animal indication effects, ranked according to the reliability. The reliability is the probability that the bonus game or the payout the amount of which is 20 times or more of the bet amount is actually awarded after the indication effect is produced. It should be noted that the bet amount in the indication effect in the free game is the bet amount placed in the base game having triggered that free game. The animal indication effect is provided after the shake effect (FIG. 19) and before the expansion effect of the symbol display area 150.

Figure 30:
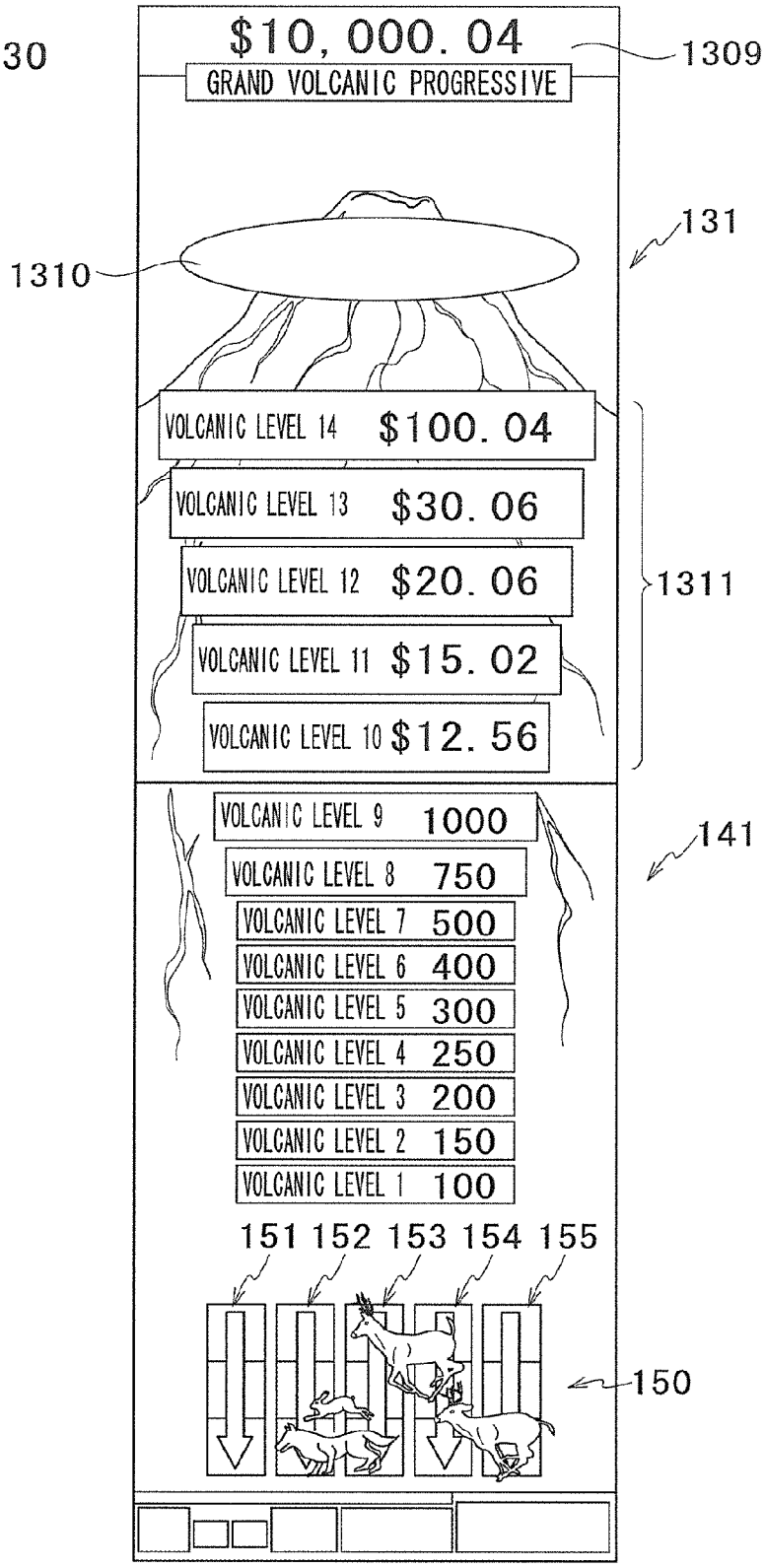
FIG. 30 is an explanatory diagram of an example display screen in an indication effect.

As shown in FIG. 30, in the animal indication effect with the reliability of 35% (low-reliability animal indication effect), animals cross over the symbol display area 150 while scroll-display is performed on the video reels 151 to 155. That is, after the low-reliability animal indication effect, the bonus game or the payout the amount of which is 20 times or more of the bet amount will be awarded with the probability of 35%.

Figure 31:
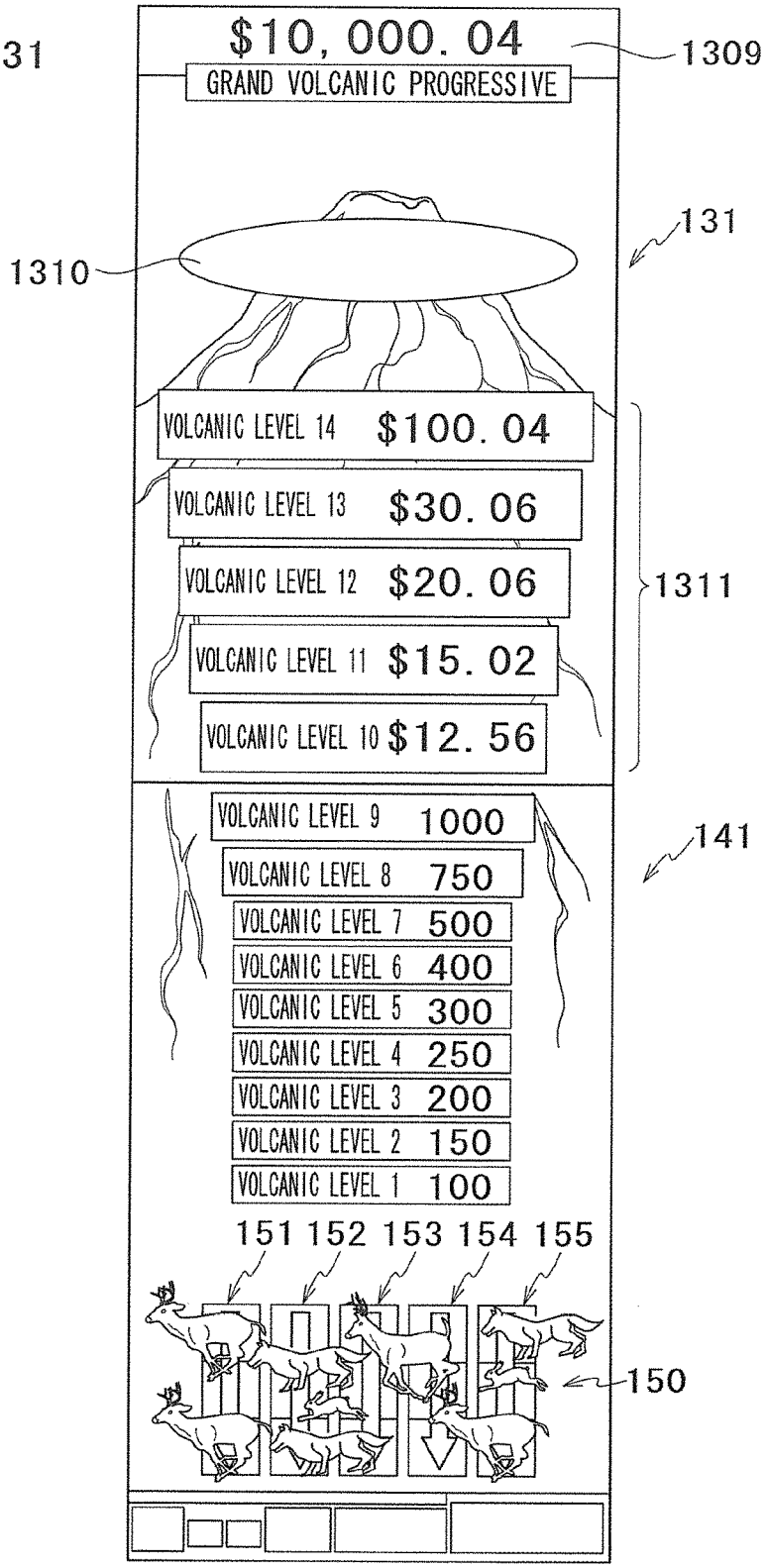
FIG. 31 is an explanatory diagram of an example display screen in the indication effect.

As shown in FIG. 31, in the animal indication effect with the reliability of 50% (high-reliability animal indication effect), animals the number of which is larger than that in the low-reliability animal indication effect cross over the symbol display area 150 while the scroll-display is performed on the video reels 151 to 155. That is, after the high-reliability animal indication effect, the bonus game or the payout the amount of which is 20 times or more of the bet amount will be awarded with the probability of 50%.

(Display Screen: Win Effect)

Figure 32:
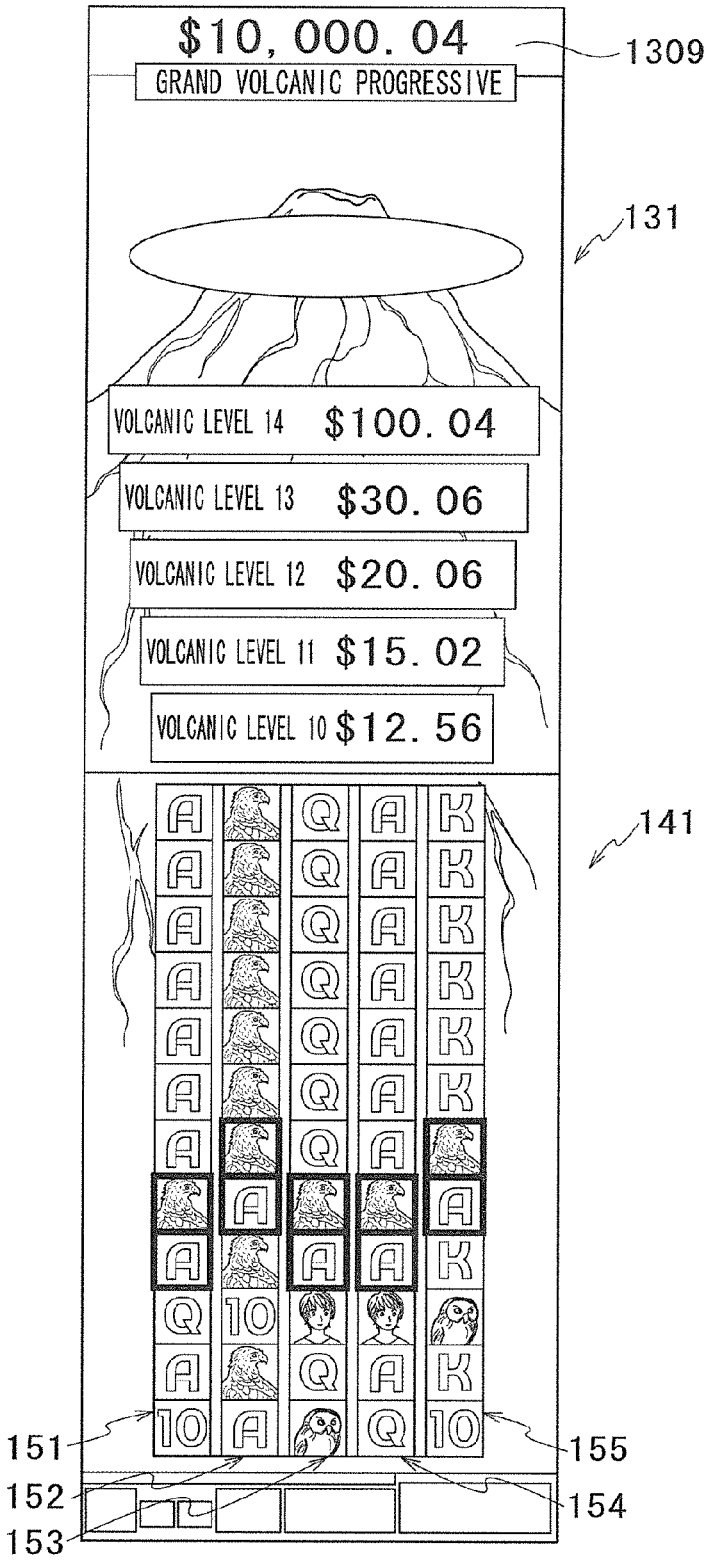
FIG. 32 is an explanatory diagram of an example display screen in a win effect.

Referring to FIG. 32 to FIG. 36, the following describes an win effect provided when the line payout is obtained. When, as shown in FIG. 32, the symbols 501 are rearranged and then the line payouts are awarded on a plurality of active lines, an effect of enclosing each of the symbols 501 causing the line payouts with frames of a single color is provided for 1 second. Simultaneously with this, in the areas of the display blocks 28 of the symbols 501 causing the line payouts, animation is started, the type of which animation is set according to the type of the symbols 501. At this time, increment display of the payout amount is performed on a win meter 402. Note that, a win signboard which will be described later is not displayed at this timing.

Figure 33:
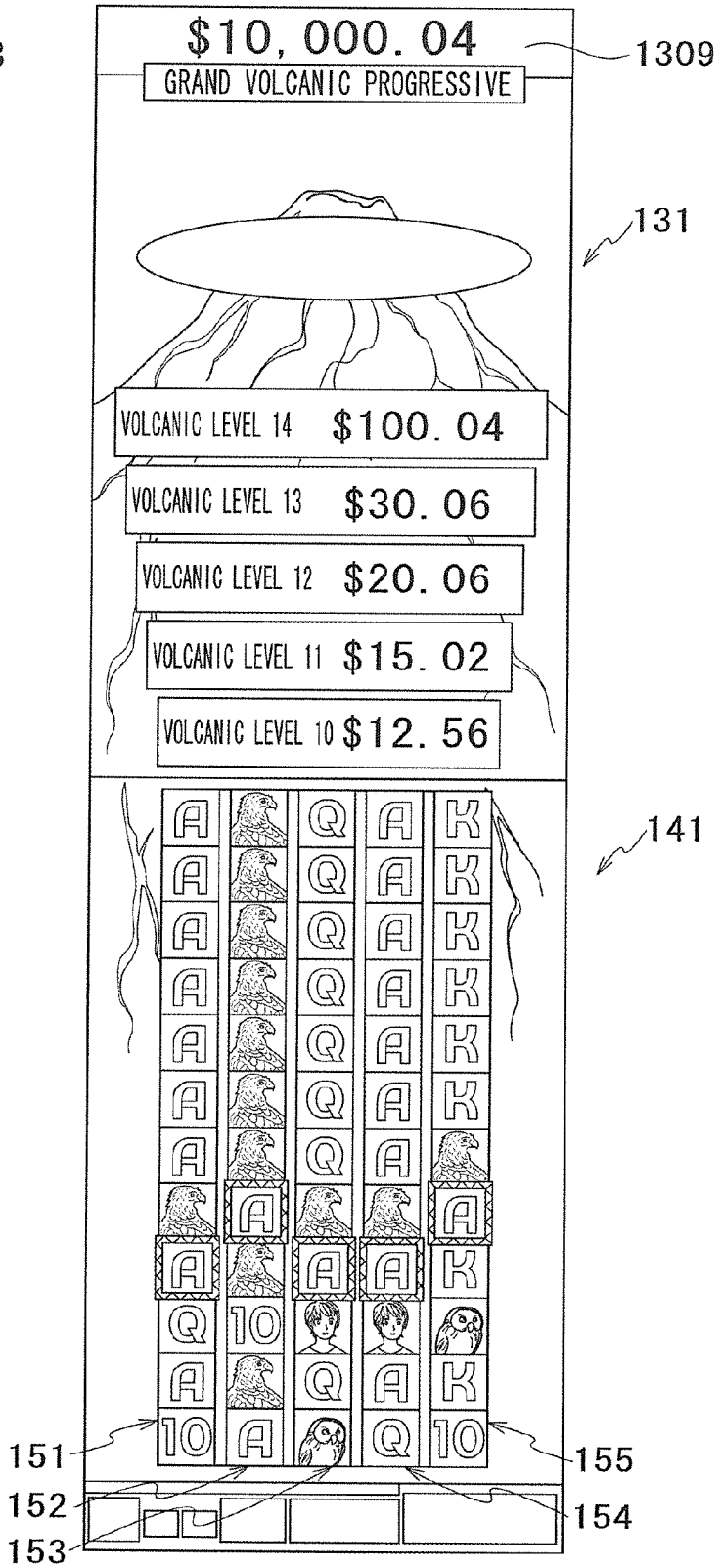
FIG. 33 is an explanatory diagram of an example display screen in the win effect.

Then, as shown in FIG. 33, there is provided an effect of enclosing all the symbols 501 causing one of the line payouts with frames of a color which is different from that in FIG. 32 This effect is performed sequentially from the symbols on the active line having the smallest code number (see FIG. 15A, FIG. 15B, FIG. 16D, and FIG. 16E).

Figure 34:
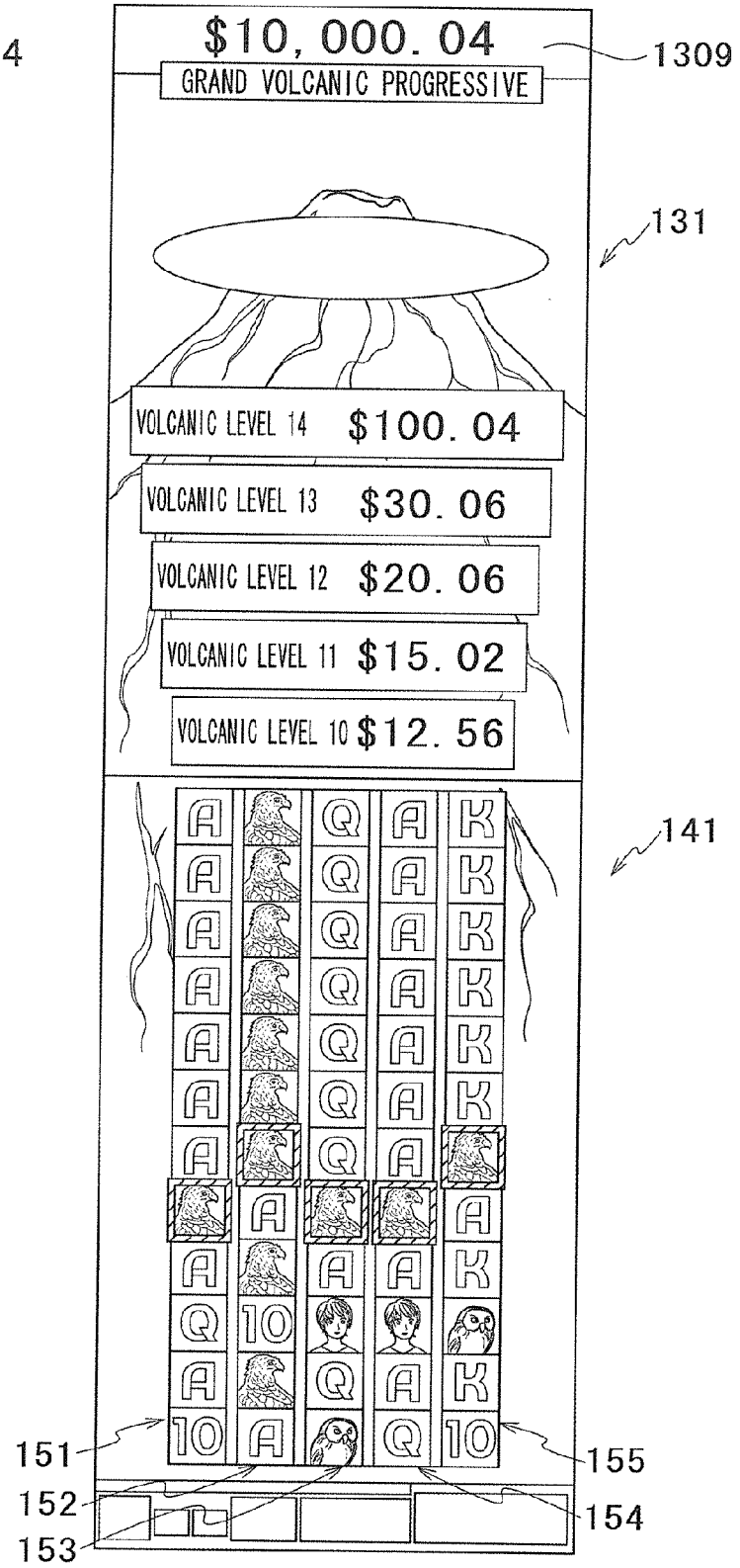
FIG. 34 is an explanatory diagram of an example display screen in the win effect.

As shown in FIG. 34, the display for the line payout on each active line is performed, sequentially, after the display of FIG. 33. After the display of all the line payouts is completed, the display is repeated again from the line payout on the first active line having the smallest code number.

Figure 35:
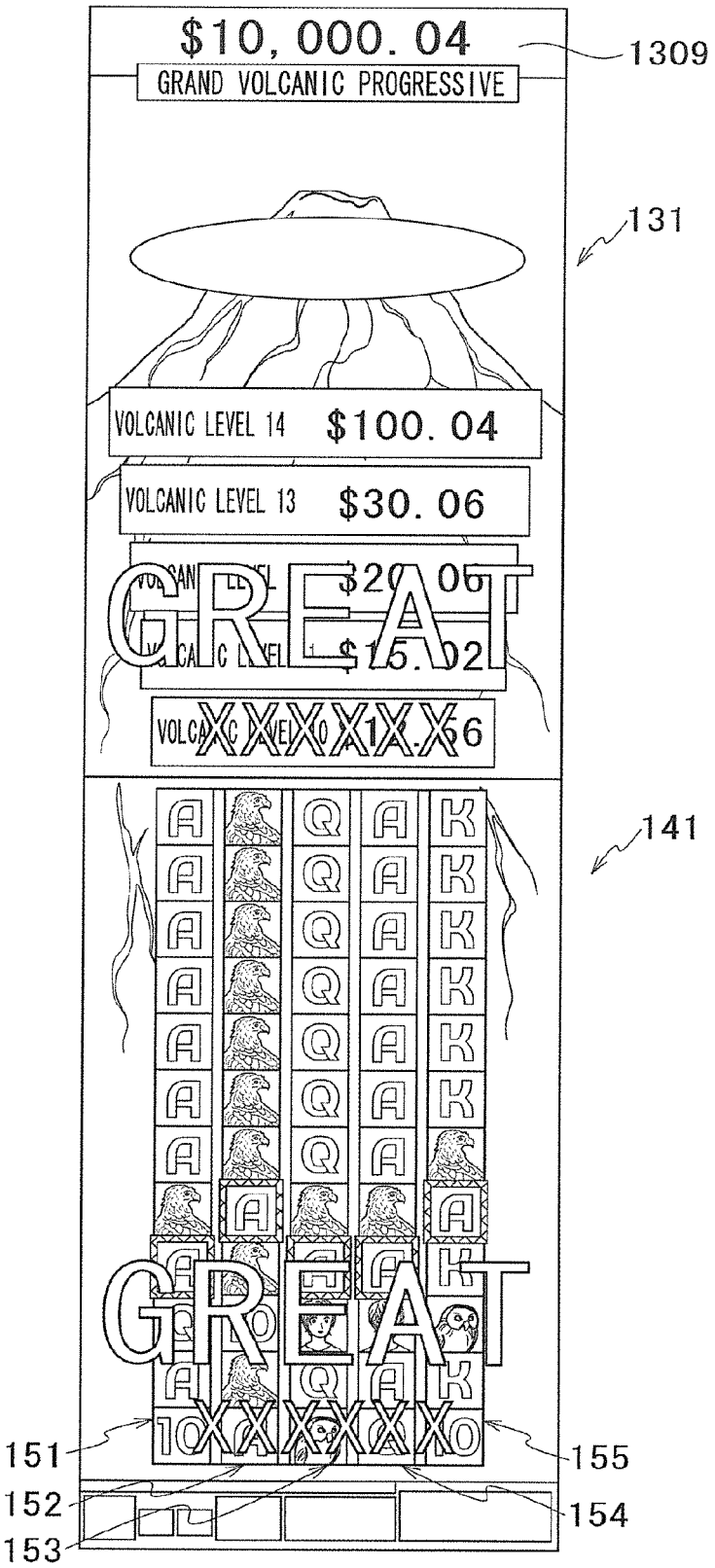
FIG. 35 is an explanatory diagram of an example display screen in the win effect.

As shown in FIG. 35, when the amount of winning is 50 times of more of the bet amount, a meter exclusive to such a winning is displayed with characters of "GREAT" at the time of the display of the individual line payout, and increment display of the payout amount is performed. When the amount of winning is 25 times or more and less than 50 times of the bet amount, characters of "BIG WIN" are displayed. Further, when the amount of winning is 25 times or more of the bet amount, there is provided an effect in which coins fall on the display screen. Furthermore, when the amount of winning is 50 times or more of the bet amount, there is provided an effect in which coins and jewels fall on the display screen. It should be noted that the bet amount in the free game is the bet amount placed in the base game having triggered that free game.

Figure 36:
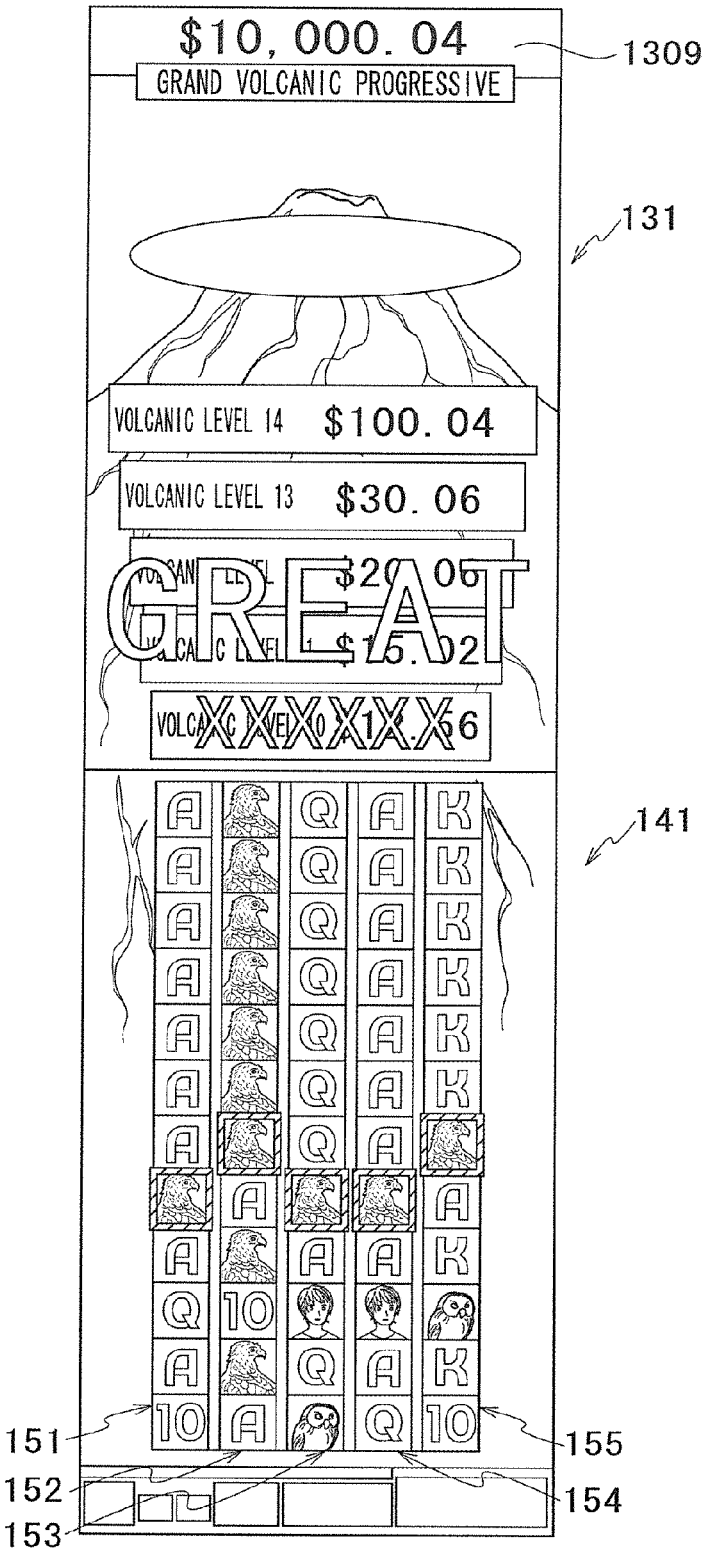
FIG. 36 is an explanatory diagram of an example display screen in the win effect.

As shown in FIG. 36, after 3 seconds from the end of the increment display, the characters of "GREAT" or "BIG WIN" and the meter exclusive to the achieved winning on the lower image display panel 141 are hidden.

Note that after all the plays of free game have been completed, results of all the plays of the free game are displayed.

(Display Screen: Free Game: Layout)

Figure 37:
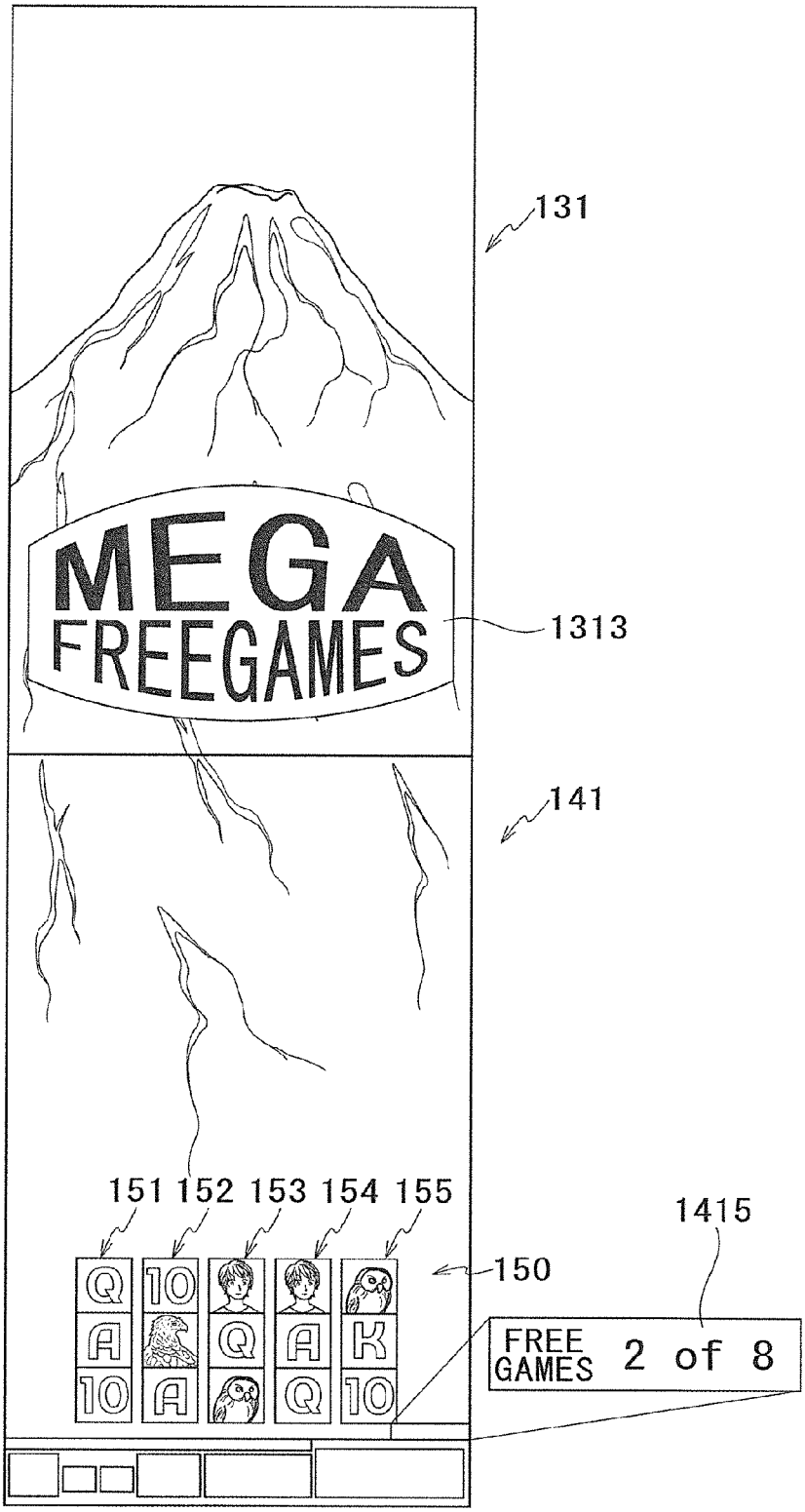
FIG. 37 is an explanatory diagram of an example display screen in a free game.

As shown in FIG. 37, during the free game, the grand progressive value display unit 1309, the title logo image 1310, the progressive value display unit 1311, and the fixed payout display unit 1412 are not displayed. Instead, a free game logo image 1313 is displayed on the upper image display panel 131. Further, a free game counter 1415 is displayed in a lower-right portion of the lower image display panel 141 relative to the symbol display area 150. The free game counter 1415 displays thereon the number of plays of the free game which have been completed, and the total number of plays of the free game obtained. When the re-trigger condition is satisfied by the bonus symbols, a predetermined number is added to the total number of plays of the free game. When the number of plays of the free game which have been completed becomes equal to the total number of plays of the free game obtained in the free game counter 1415, the free game counter 1415 indicates that all the plays of the free game have been consumed. After the free game, the processing returns back to the base game.

(Display Screen: Free Game: Display of Results)

Figure 38:
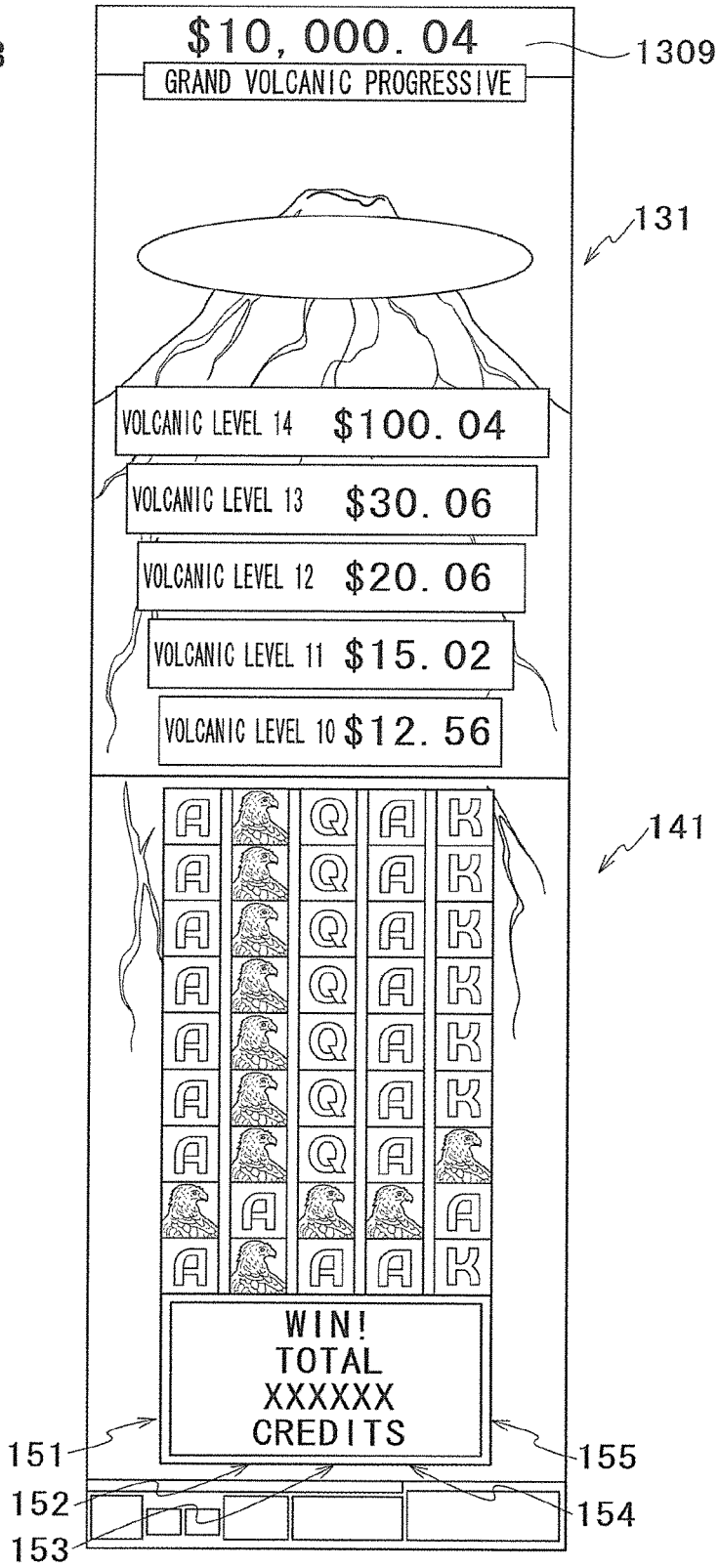
FIG. 38 is an explanatory diagram of an example display screen in the free game.

As shown in FIG. 38, when the total win amount at the end of the free game is less than 25 times of the bet amount in the base game having triggered the free game, a silver signboard having a background color of silver is displayed. On the silver signboard, there is displayed the total sum of the amounts of winnings obtained in the free game.

Figure 39:
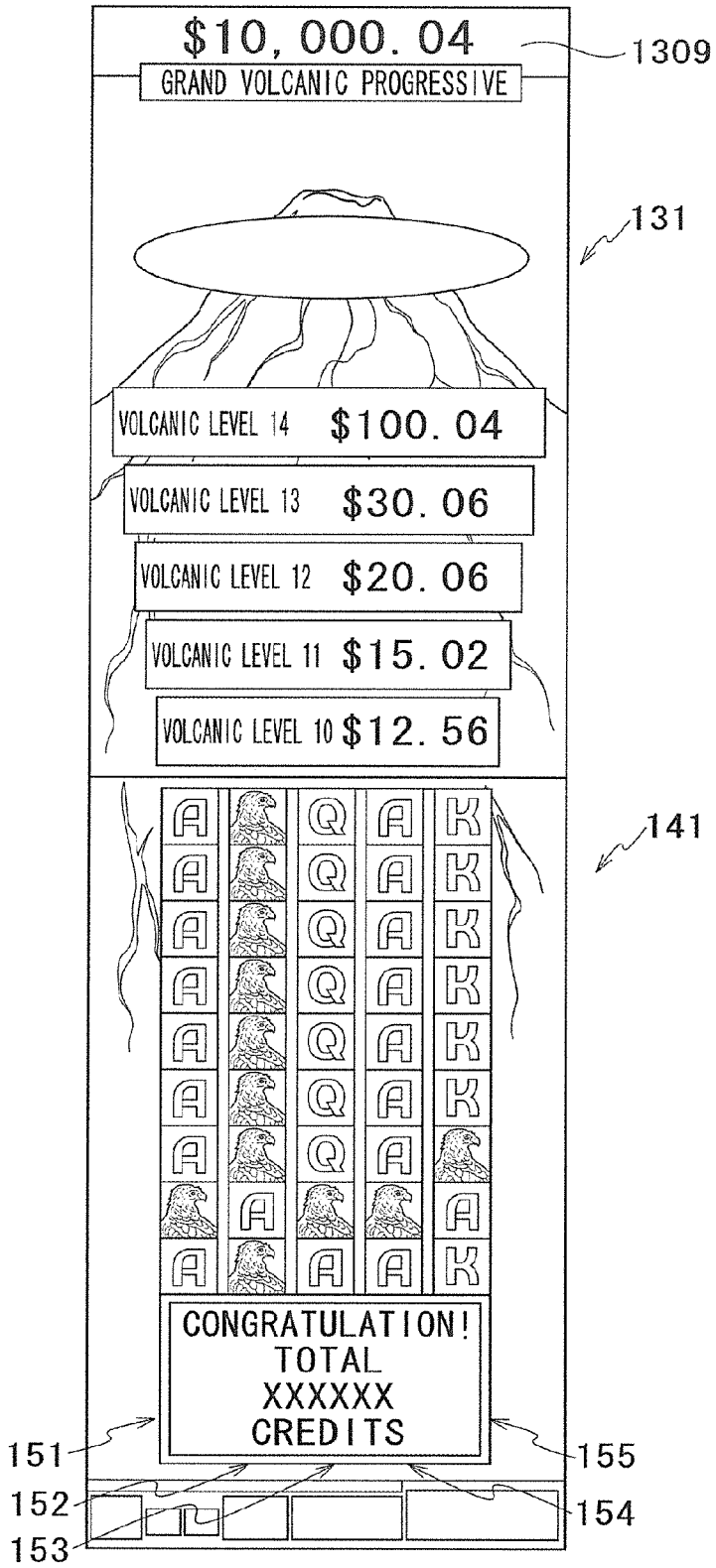
FIG. 39 is an explanatory diagram of an example display screen in the free game.

As shown in FIG. 39, when the total win amount at the end of the free game is 25 times or more of the bet amount in the base game having triggered the free game, a gold signboard having a background color of gold is displayed. On the gold signboard, there is displayed the total sum of the amounts of winnings obtained in the free game.

(Display Screen: Bonus Choice)

When three bonus symbols 504 are rearranged as shown in FIG. 29, the bonus game is triggered. When the bonus game is triggered, the bonus choice is executed. In the bonus choice, which types of the bonus game, i.e., which of the free game and the big bonus is to be executed is determined.

Figure 40:
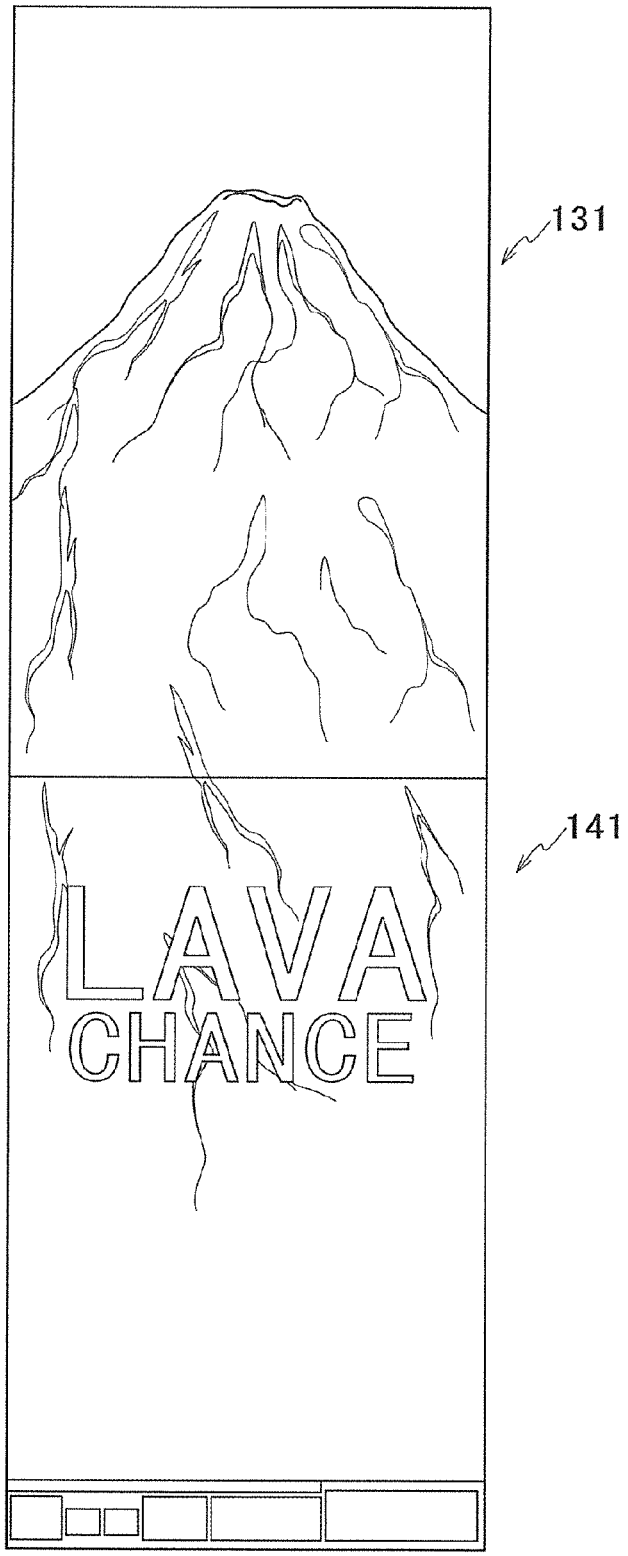
FIG. 40 is an explanatory diagram of an example display screen in a bonus choice.

As shown in FIG. 40, when the bonus choice is started, an introduction movie is started, and a logo of LAVE CHANCE, indicating the bonus choice, is displayed on the upper image display panel 131.

Figure 41:
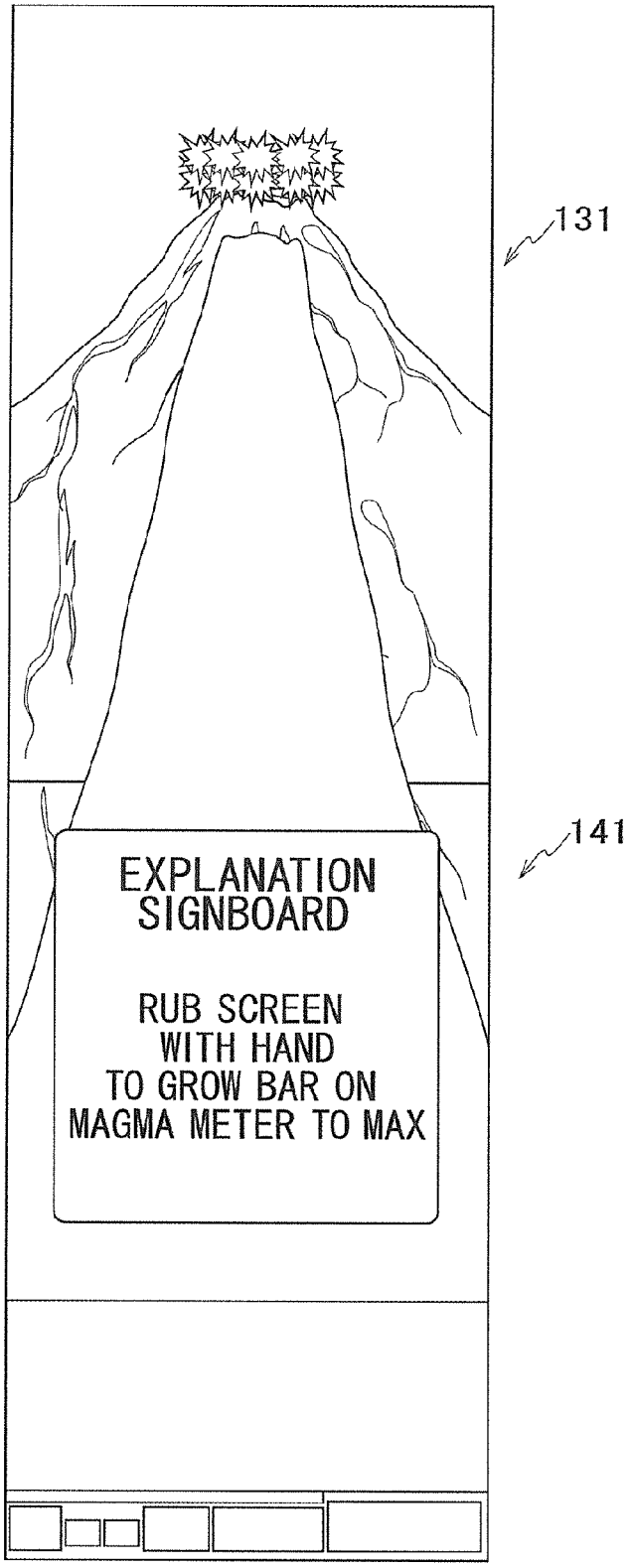
FIG. 41 is an explanatory diagram of an example display screen in the bonus choice.

Then, as shown in FIG. 41, the logo is hidden, and a signboard showing the explanation of the bonus choice is displayed.

Figure 42:
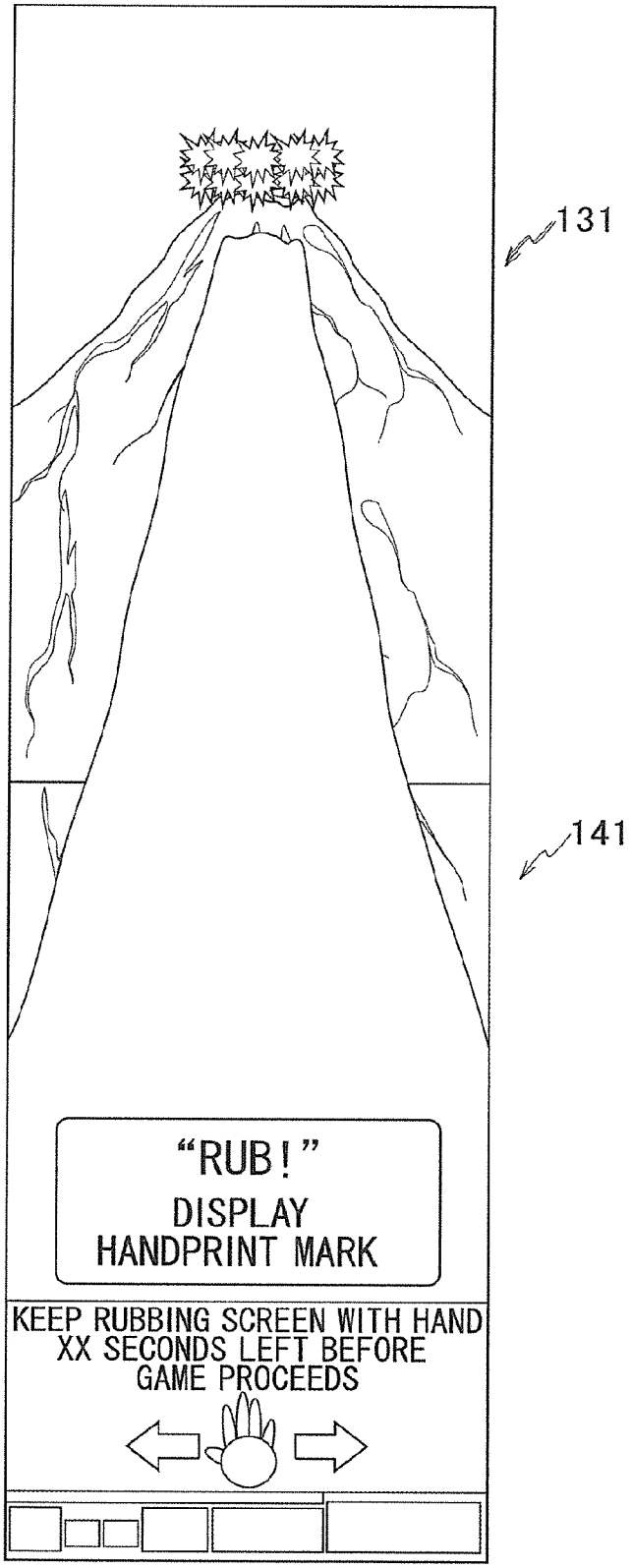
FIG. 42 is an explanatory diagram of an example display screen in the bonus choice.

Then, as shown in FIG. 42, after the signboard of the explanation is hidden, a mark of a handprint is displayed with an inciting text such as "keep rubbing!". Then, the game of the bonus choice is started.

Figure 43:
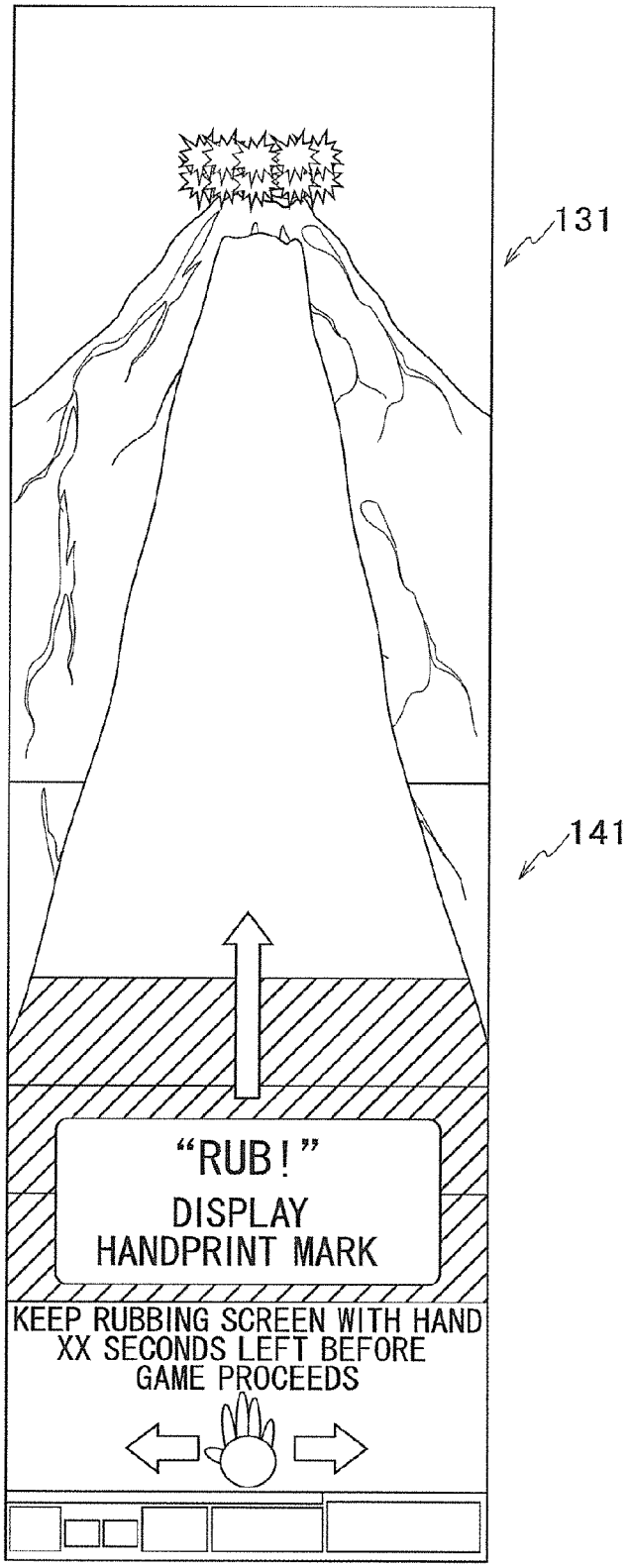
FIG. 43 is an explanatory diagram of an example display screen in the bonus choice.

As shown in FIG. 43, in the bonus choice, when the player's operation of rubbing the screen is input, displayed is the image in which the bar on a magma meter grows upward with this input. The magma meter is displayed across the border between the upper image display panel 131 and the lower image display panel 141. In other words, there is displayed the image in which the bar on the magma meter grows upward by one segment at a time, as the player rubs a lower portion of the lower image display panel 141 from side to side. The bar on the magma meter has 10 segments, i.e., there are 10 levels. When the bar on the magma meter has not reached the 10th level, the free game is executed. When the bar on the magma meter has reached the 10th level, the big bonus is executed. Note that which of the bonuses is selected in the bonus choice has been determined in advance. Thus, if the free game has been selected as the bonus game, control is made so that the bar on the magma meter reaches the 9th level, at the highest. While the bar on the magma meter grows, an effect like an earthquake shake is provided on the entire screen. When the bar on the magma meter reaches the 5th level, the effect is enhanced. The period during which the input by the player is acceptable is set to a predetermined number of seconds, and countdown is started 10 seconds before the end of the period.

(Display Screen: Bonus Choice: Free Game Selected)

Figure 44:
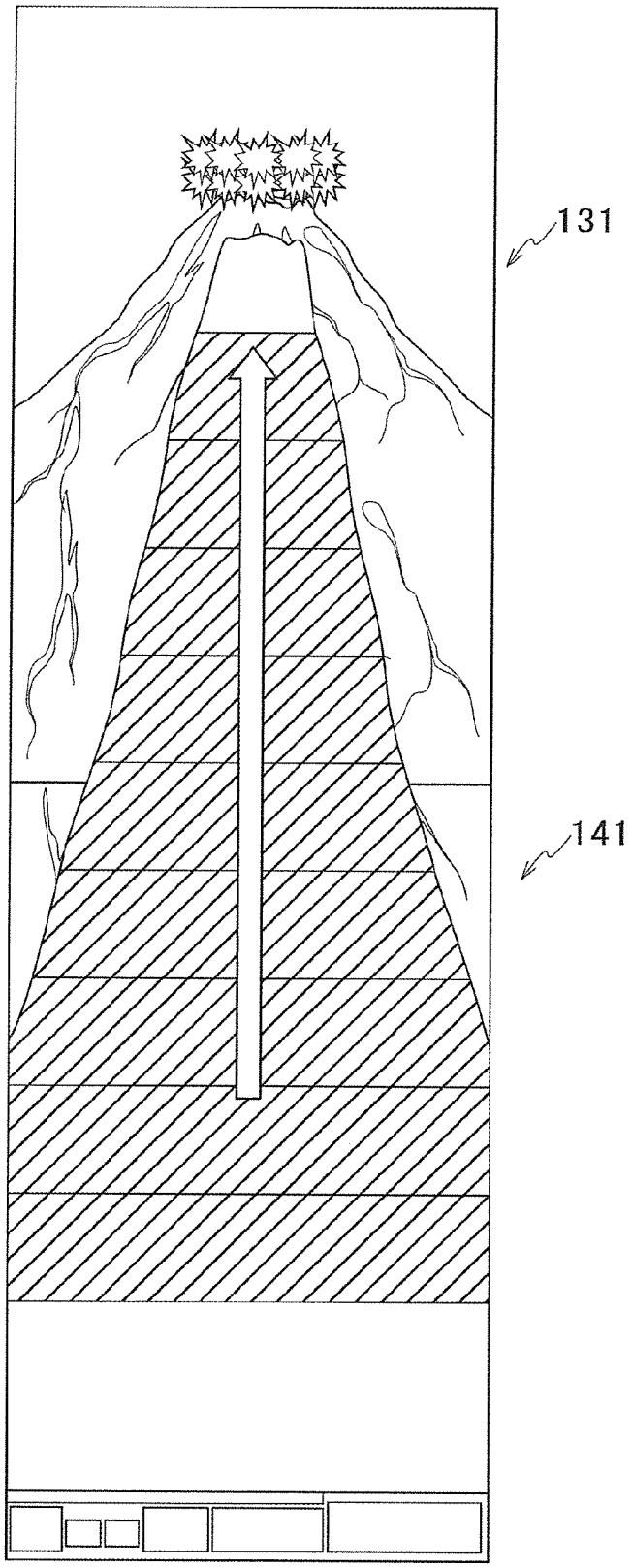
FIG. 44 is an explanatory diagram of an example display screen in the bonus choice.

When the free game has been selected as the bonus game, as shown in FIG. 44, there is provided an effect in which the bar on the magma meter grows upward by one segment at a time to reach the 9th level, irrespective of the state of the magma meter after the elapse of predetermined number of seconds. Note that the result of the bonus choice may be displayed with the magma meter kept in the state at the end of the countdown.

Figure 45:
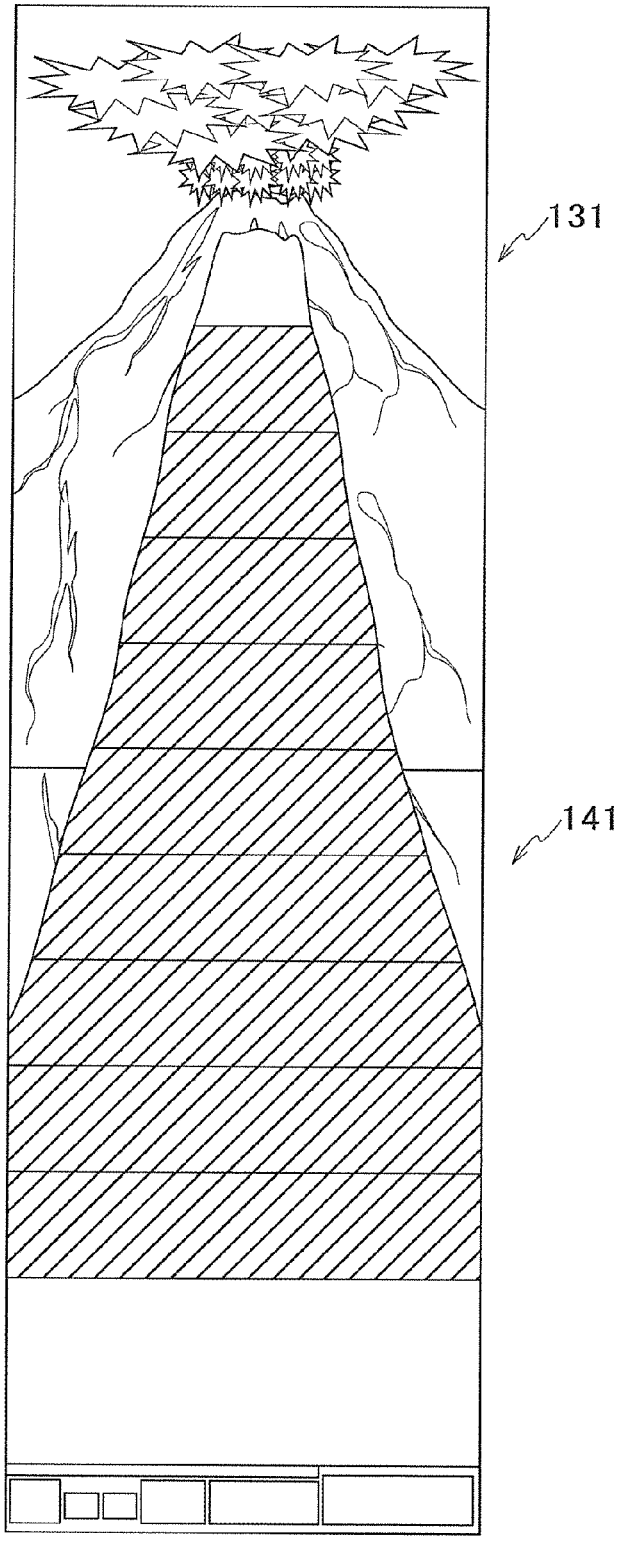
FIG. 45 is an explanatory diagram of an example display screen in the bonus choice.

Then, as shown in FIG. 45, an effect in which smoke is emitted from a vent of the volcano with a small explosion is provided on the upper image display panel 131.

Figure 46:
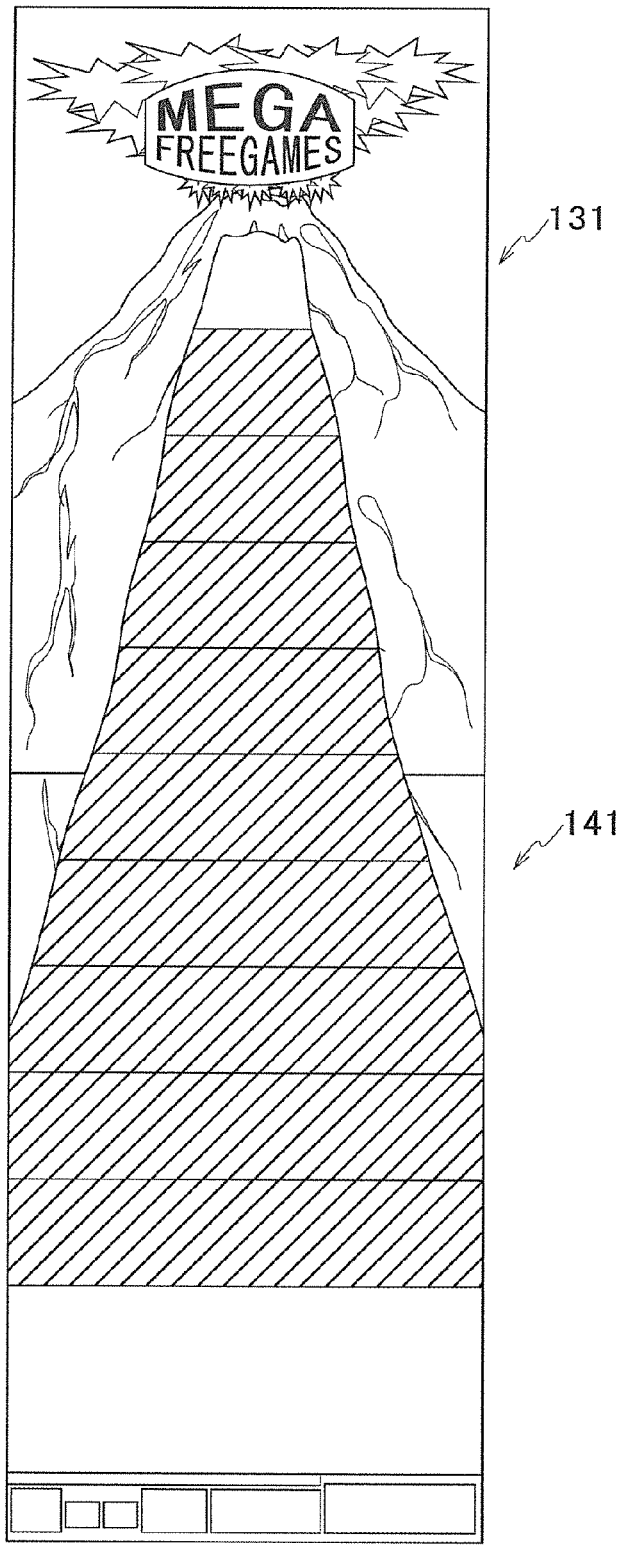
FIG. 46 is an explanatory diagram of an example display screen in the bonus choice.

Thereafter, as shown in FIG. 46, there is provided an effect in which the logo of the free game jumps out of the vent of the volcano.

Figure 47:
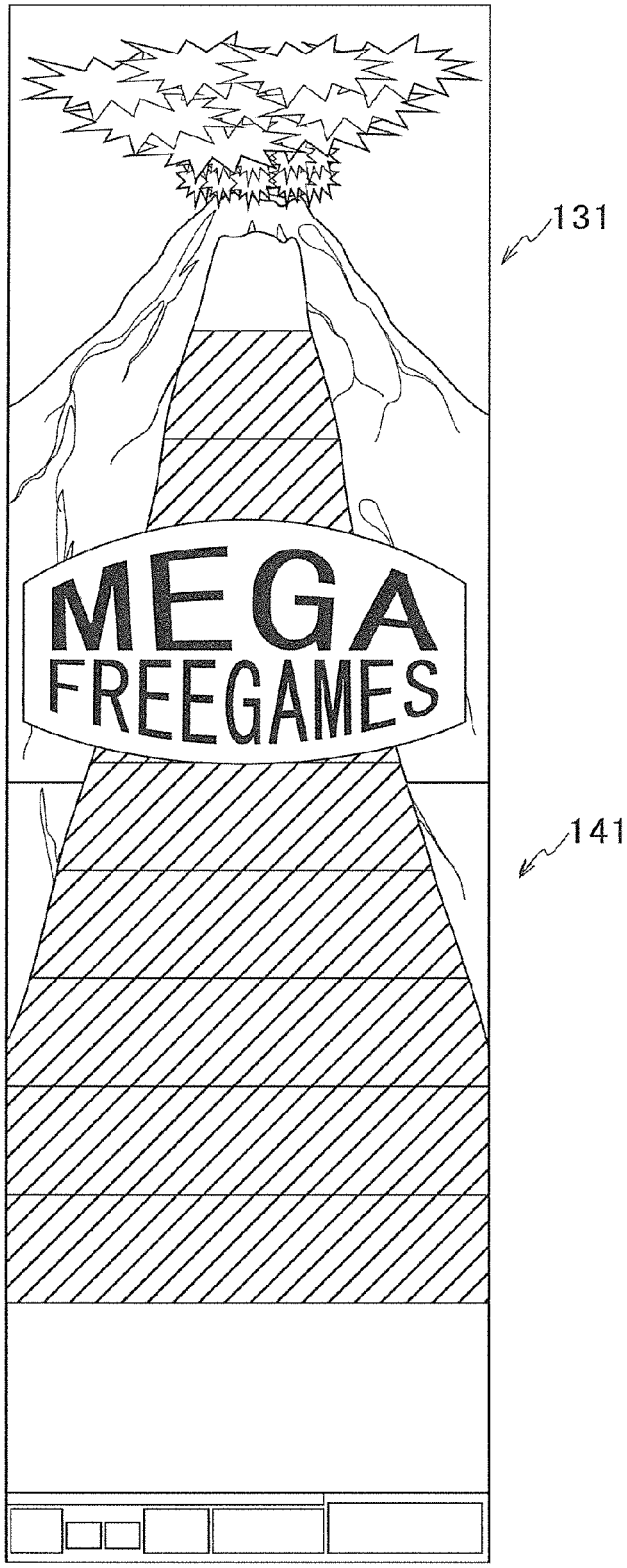
FIG. 47 is an explanatory diagram of an example display screen in the bonus choice.

Then, as shown in FIG. 47, the logo of the free game is displayed on the upper image display panel 131. There is further provided an effect in which the logo of the free game displayed on the upper image display panel 131 is moved to and stopped on the lower image display panel 141.

(Display Screen: Bonus Choice: Big Bonus Selected)

Figure 48:
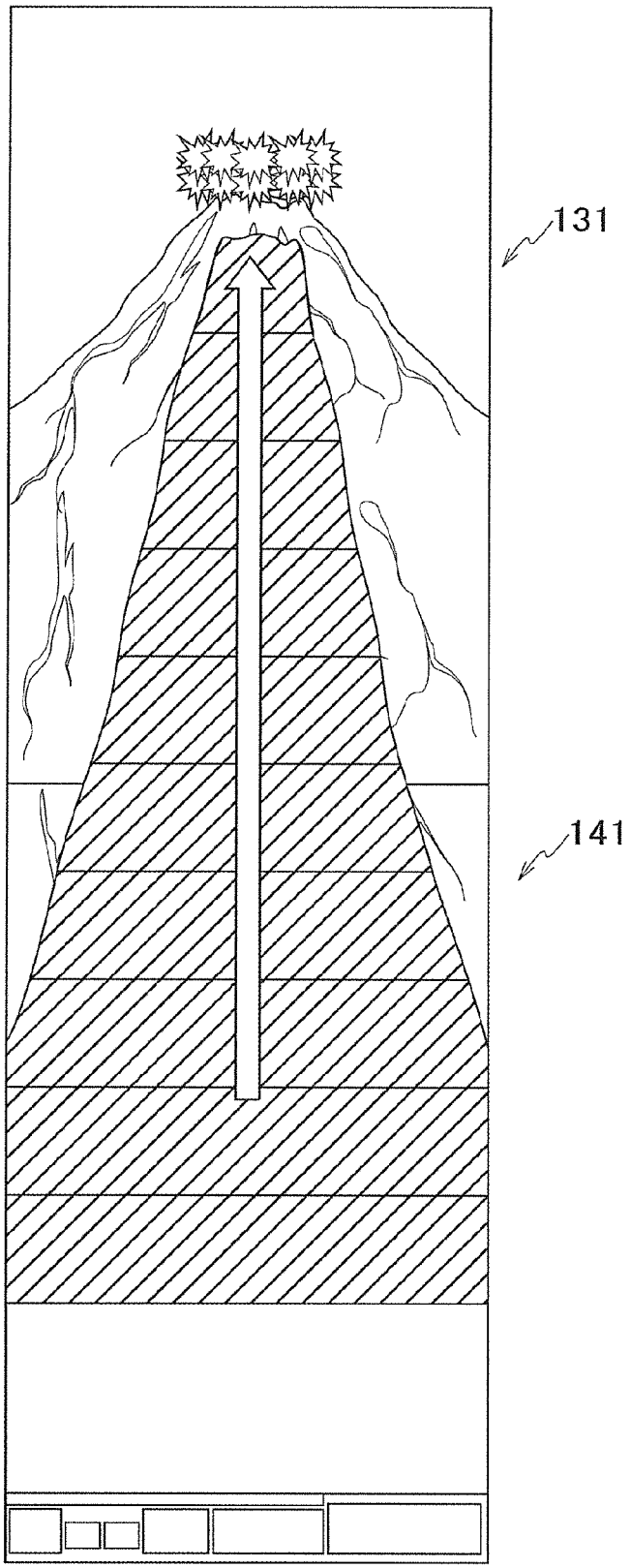
FIG. 48 is an explanatory diagram of an example display screen in the bonus choice.

When the big bonus has been selected as the bonus game, as shown in FIG. 48, there is provided an effect in which the bar on the magma meter grows upward by one segment at a time to reach the 10th level, irrespective of the state of the magma meter after the elapse of the predetermined number of seconds. If the bar on the magma meter has already reached the 10th level, shifting to the next effect occurs.

Figure 49:
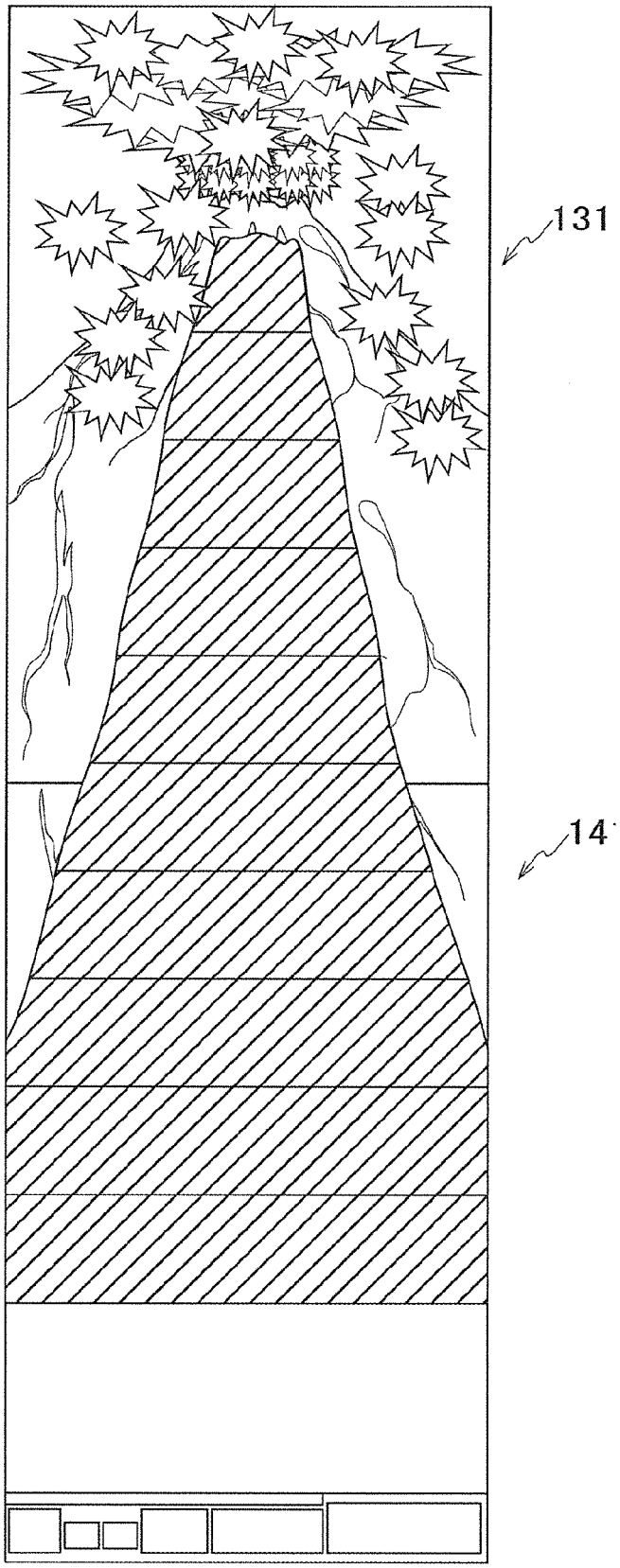
FIG. 49 is an explanatory diagram of an example display screen in the bonus choice.

Then, as shown in FIG. 49, an effect in which magma erupts from the vent of the volcano with a big explosion is provided on the upper image display panel 131.

Figure 50:
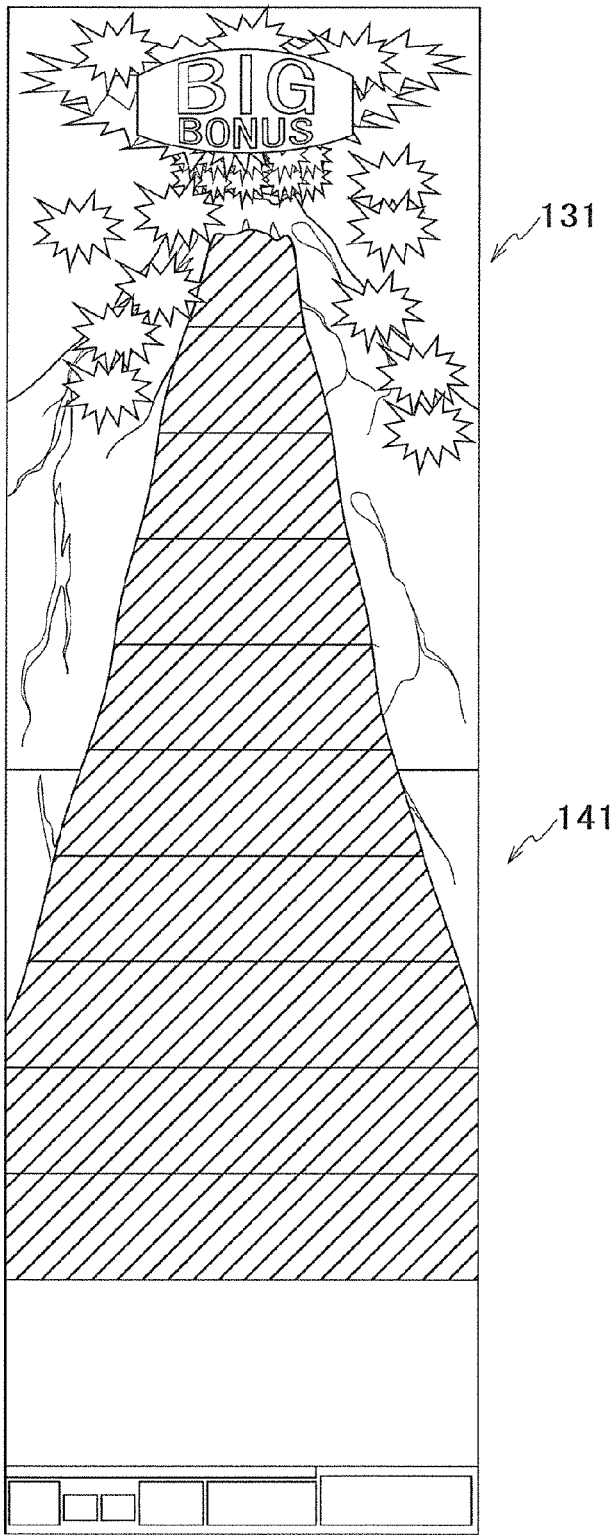
FIG. 50 is an explanatory diagram of an example display screen in the bonus choice.

Thereafter, as shown in FIG. 50, there is provided an effect in which the logo of the big bonus jumps out of the vent of the volcano.

Figure 51:
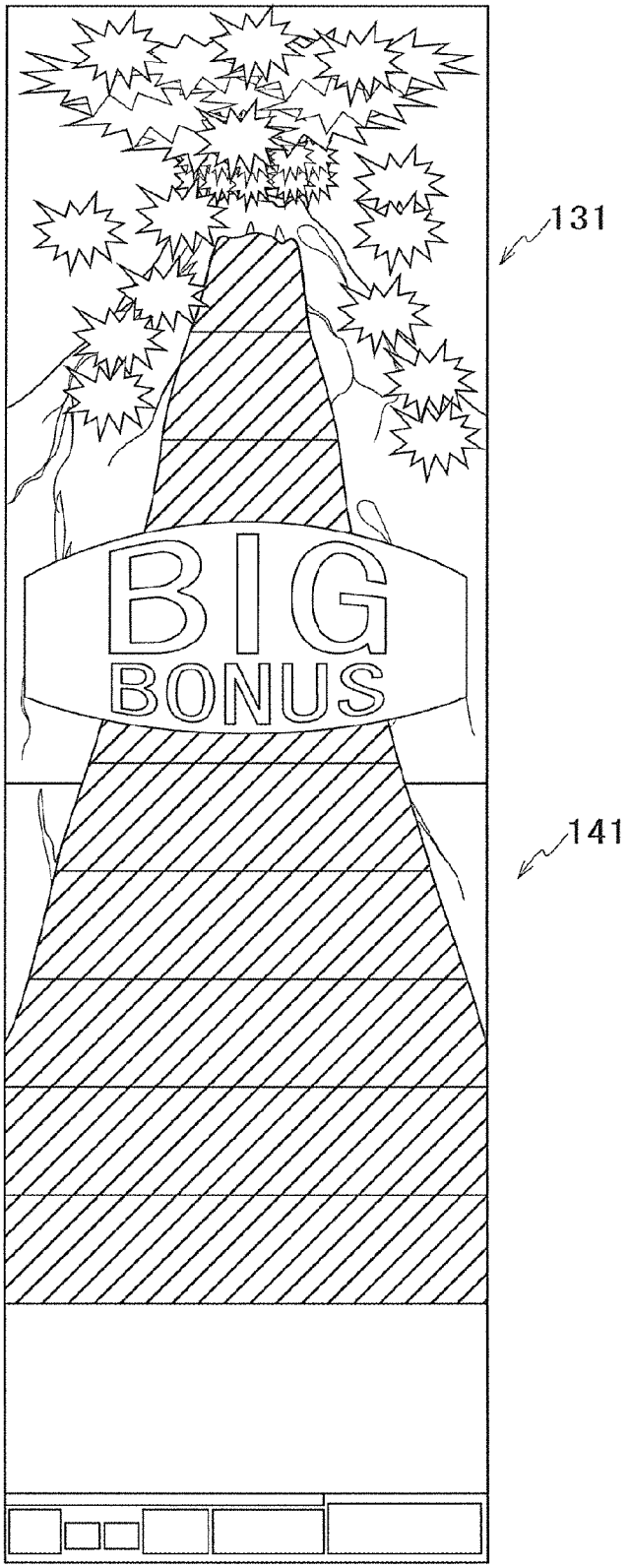
FIG. 51 is an explanatory diagram of an example display screen in the bonus choice.

Then, as shown in FIG. 51, the logo of the big bonus is displayed on the upper image display panel 131. There is further provided an effect in which the logo of the big bonus displayed on the upper image display panel 131 is moved to and stopped on the lower image display panel 141.

In this way, the effect to notify the player of the predetermined bonus game type is provided. When one of the bonus games is started after the bonus choice, a bonus introduction movie is reproduced. During this, random determination for the result of the bonus game and the like are performed.

(Data Table)

The following will describe tables used in the games in the present embodiment. The data table used in the pick bonus will be described later.

(Mystery Feature Trigger Random Determination Table)

Referring to FIG. 52 and FIG. 53, a description will be given for mystery feature trigger random determination tables. FIG. 52 illustrates a base game mystery feature trigger random determination table. FIG. 53 illustrates a free game mystery feature trigger random determination table.

In each mystery feature trigger random determination table, the weight for the loss in the random determination for the mystery feature and the weight for the winning in the random determination for the mystery feature are defined for each number of the rows (window number) in the matrix displayed in the symbol display area 150. That is, in the random determination for determining whether the mystery feature is triggered or not, weights for each number of the rows in the matrix displayed in the symbol display area 150 are referred to. Whether the mystery feature is triggered or not is determined through the random determination based on these weights.

(Feature Random Determination Table)

Referring to FIG. 54 and FIG. 55, feature random determination tables will be described. FIG. 54 illustrates a base game feature random determination table. FIG. 55 illustrates a free game feature random determination table.

In each feature random determination table, the weight for winning in the random determination table for the expand wild feature and the weight for winning in the random determination for the lava wild feature are defined for each number of the rows in the matrix displayed in the symbol display area 150. That is, when a winning is made in the random determination for the mystery feature, the above weights are referred to. Then, through the random determination based on the above weights, which of the features: expand wild feature and the lava wild feature is triggered is determined.

(Wild Reel Random Determination Table)

Referring to FIG. 56 and FIG. 57, wild reel random determination tables will be described. FIG. 56 illustrates a base game wild reel random determination table. FIG. 57 illustrates a free game wild reel random determination table.

Each wild reel random determination table includes a plurality of patterns each defines which of the video reels 151 to 155 are subjected to the change to the wild symbols. Each pattern is associated with a weight. When the expand wild feature is triggered, the above weight is referred to. Then, through the random determination based on the above weights, which of the patterns is used is determined. Based on the setting for each of the video reels 151 to 155 defined in the thus determined pattern, it is determined which of the video reels 151 to 155 are subjected to the change to the wild symbols. On the thus determined video reels, all the symbols are changed to the wild symbols. In each pattern of the table, "WI" means that the symbols are changed to the wild symbols, and "\WI" means that the symbols are not changed to the wild symbols.

(Wild Change Position Random Determination Table)

Referring to FIG. 58 and FIG. 59, wild change position random determination tables will be described. FIG. 58 illustrates a base game wild change position random determination table. FIG. 59 illustrates a free game wild change position random determination table.

Each wild change position random determination table includes a plurality of patterns in each of which the video reel number (151 to 155) on which the symbol 501 is to be changed to the wild symbol 505 is defined for each reel position number (see FIG. 14). The plurality of patterns are associated with weights. As shown in FIG. 58 and FIG. 59, there are patterns in each of which one change position is set per reel position number, and patterns in each of which two change positions are set per reel position number.

The weights defined in each wild change position random determination table are referred to when the lava wild feature is triggered. Then, through the random determination based on the above weights, which of the patterns is used is determined. As a result, which of the display blocks 28 in the symbol display area 150 are set as the change blocks 28*a* is determined.

(Bonus Random Determination Table)

Referring to FIG. 60, a bonus random determination table will be described. In the bonus random determination table, a weight is defined for each of the free game and the big bonus. When the bonus game is triggered, the above weights are referred to. Then, through the random determination based on the above weights, it is determined which of the free game and the big bonus is to be executed.

(Contents of Program)

Next, programs executed by the slot machine 1 will be described.

(Main Control Process)

Figure 61:
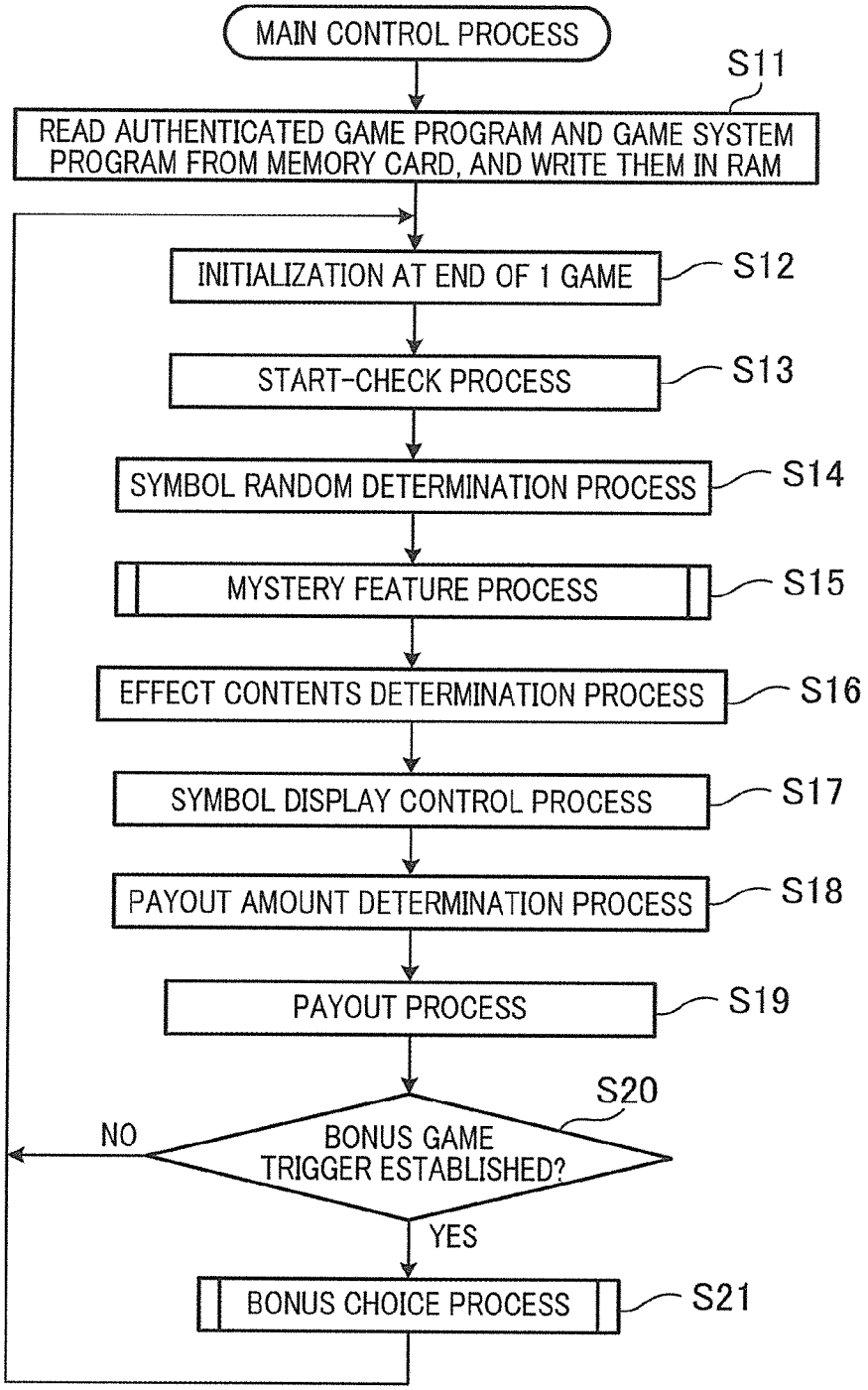
FIG. 61 is a flowchart of a main control process.

First, referring to FIG. 61, a main control process will be described.

First, when the slot machine 1 is powered on, the main CPU 71 reads an authenticated game program and a game system program from the memory card 54 via the gaming board 50, and then write them in the RAM 73 (S11).

Next, the main CPU 71 executes an initializing process at the end of each play of the game (S12). This process clears data in a working area of the RAM 73, which becomes unnecessary at the end of each play of game, e.g., the amount of bet, symbols randomly determined, and the like.

Then, the main CPU 71 executes a start-check process (S13). In this process, an input check for the switches corresponding to the variety of buttons, subtraction of credits, and the like are executed. In the present embodiment, the bet buttons 34, 35, 37, 38, and 39 each has a function of a spin button. When any of the bet buttons 34, 35, 37, 38, and 39 is pressed down, transition to step S14 occurs.

Then, the main CPU 71 executes a symbol random determination process (S14). In this process, to-be-stopped symbols are determined based on random numbers for symbol determination.

Specifically, the main CPU 71 first extracts a random number for symbol determination. Then, the main CPU 71 determines the to-be-stopped symbols on the video reels 151 to 155 through random determination. The main CPU 71 executes random determination for each of the video reels 151 to 155, and determines the code number of the symbol to be stopped on a reference position on each of the video reels 151 to 155. In fact, the symbols to be rearranged in the symbol display area 150 are fixed after the size of the display frame on the video reels 151 to 155 is determined in the next process, i.e., mystery feature process. Then, the main CPU 71 stores the symbol to be stopped at the reference position on each of the video reels 151 to 155 in the symbol storing area provided in the RAM 73. In this process, each of the symbols may be determined with an equal probability, or may be determined based on the weights respectively associated with the symbols. In the latter case, the probability that a symbol is selected is calculated by dividing the weight of the symbol by the total sum of the weights of the symbols on the reel.

Subsequently, the main CPU 71 executes the mystery feature process (S15). The mystery feature process will be described later with reference to FIG. 62.

Then, the main CPU 71 executes an effect contents determination process (S16). The main CPU 71 extracts an effect-use random number and randomly selects one of a plurality of predetermined effect contents. When the execution of the expansion of the display frame and the expand wild feature or the lava wild feature is determined in the mystery feature process, the main CPU 71 selects the effect corresponding to this. Further, the main CPU 71 determines whether the indication effect is provided.

Then, the main CPU 71 executes a symbol display control process (S17). In this process, scrolling of the symbol arrays on the video reels 151 to 155 is started, and some of the symbols, determined based on the to-be-stopped symbols determined in the symbol random determination process in step S14, are stopped within the display frame the size of which has been determined in the mystery feature process in step S15. In addition, a variety of effects determined in the mystery feature process are provided, such as the expansion effect of the display frame, the indication effect, the expand wild feature effect, and the lava wild feature effect (magma effect) are provided.

Then, the main CPU 71 executes a payout amount determination process (S18). In this process, the main CPU 71 refers to the symbol combination table stored in the RAM 73, and determines whether a winning combination is achieved, in the symbols stopped in the symbol display area 150, by a combination of a predetermined number of symbols of a kind arranged successively from the video reel 151 to the video reel 155. Further, the main CPU 71 determines whether a scattered winning is achieved by the bonus symbols 504. The payout amount to be awarded is stored in a payout amount storage area provided in the RAM 73.

Then, the main CPU 71 executes a payout process (S19). The main CPU 71 adds a value stored in the payout amount storage area to a value in a credit counter stored in a credit amount storage area provided in the RAM 73.

Subsequently, the main CPU 71 determines whether the bonus game trigger condition has been satisfied (S20). In the present embodiment, the bonus game trigger condition is satisfied when three or more bonus symbols 504 are stopped in the symbol display area 150. When the main CPU 71 determines that the bonus game trigger condition has been satisfied (S20: YES), the main CPU 71 executes a bonus choice process, which will be described later (S21). The free game and the big bonus are to be called in the bonus choice process.

When the main CPU 71 determines that the bonus game trigger condition has not been satisfied in step S20 (S20: NO), or after the completion of a bonus choice process in step S21 ends, the processing returns back to step S12.

(Mystery Feature Process)

Figure 62:
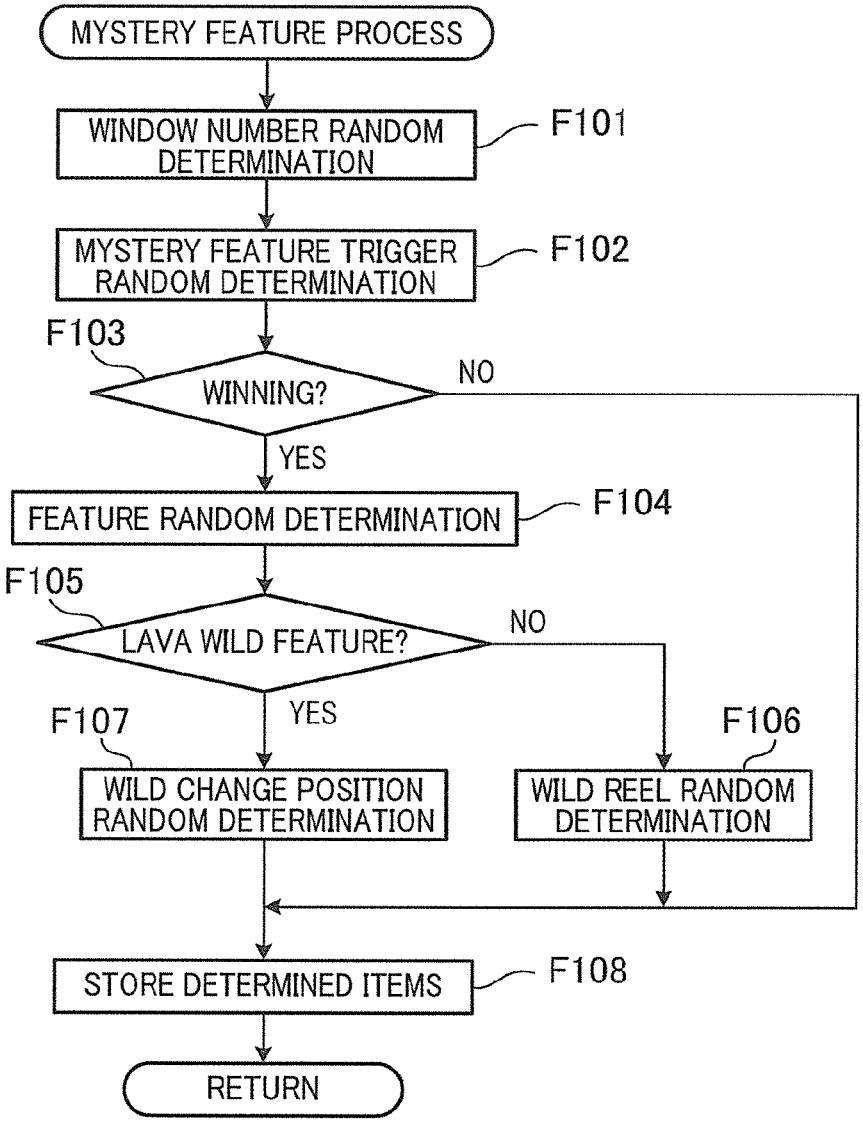
FIG. 62 is a flowchart of a mystery feature process.

Now, with reference to FIG. 62, a specific description will be given for the mystery feature process executed in step S15 of the main control process (see FIG. 61). Note that the mystery feature process is executed also in the free game process (see FIG. 64) which will be described later.

To begin with, the main CPU 71 executes a window number random determination (F101). In the window number random determination, the main CPU 71 refers to the window number random determination table. To be more specific, when this routine is called in the base game, the main CPU 71 executes the random determination with reference to the base game window number random determination table (see FIG. 12), and determines the number of windows (number of rows) of the matrix in the symbol display area 150 to be used. Meanwhile, when this routine is called in the free game, the main CPU 71 refers to the free game window number random determination table (see FIG. 13), and determines the number of windows (number of rows) of the matrix in the symbol display area 150 to be used.

Thereafter, the main CPU 71 executes the mystery feature trigger random determination (F102). In the mystery feature trigger random determination, the main CPU 71 refers to the mystery feature trigger random determination table. To be more specific, when this routine is called in the base game, the main CPU 71 executes the random determination with reference to the base game mystery feature trigger random determination table (see FIG. 52), and determines whether the mystery feature is triggered. Meanwhile, when this routine is called in the free game, the main CPU 71 executes the random determination with reference to the free game mystery feature trigger random determination table (see FIG. 53), and determines whether the mystery feature is triggered.

When it is determined that the mystery feature is triggered (F103: YES), the main CPU 71 executes a feature random determination process (F104). In the feature random determination process, the main CPU 71 refers to the feature random determination table. To be more specific, when this routine is called in the base game, the main CPU 71 executes the random determination with reference to the base game feature random determination table (see FIG. 54), and determines which of the expand wild feature and the lava wild feature is triggered. Meanwhile, when this routine is called in the free game, the main CPU 71 executes the random determination with reference to the free game feature random determination table (see FIG. 55), and determines which of the expand wild feature and the lava wild feature is triggered.

Then, the main CPU 71 determines whether the triggered mystery feature is the lava wild feature (F105). When the lava wild feature is not executed (F105: NO), the main CPU 71 executes wild reel random determination (F106). That is, the main CPU 71 selects the expand wild feature as the mystery feature to be triggered. In the wild reel random determination, the main CPU 71 refers to the wild reel random determination table. To be more specific, when this routine is called in the base game, the main CPU 71 executes the random determination with reference to the base game wild reel random determination table (see FIG. 56), and determines the video reel(s) on which the symbols are changed to the wild symbols 505 in the expand wild feature. Meanwhile, when this routine is called up in the free game, the main CPU 71 executes the random determination with reference to the free game wild reel random determination table (see FIG. 57), and determines the video reel(s) on which the symbols are changed to the wild symbols 505 in the expand wild feature.

Meanwhile, when the lava wild feature is executed (F105: YES), the main CPU 71 executes wild change position random determination (F107). In the wild change position random determination, the main CPU 71 refers to the wild change position random determination table. To be more specific, when this routine is called in the base game, the main CPU 71 executes the random determination with reference to the base game wild change position random determination table (see FIG. 58), and determines the display blocks 28 functioning as the change blocks 28*a* in the lava wild feature. Meanwhile, when this routine is called in the free game, the main CPU 71 executes the random determination with reference to the free game wild change position random determination table (see FIG. 59), and determines the display blocks 28 functioning as the change blocks 28*a* in the lava wild feature.

When a winning is not made in the mystery feature trigger random determination in step F103 (F103: NO), after the wild reel random determination in step F106, or after the wild change position random determination in step F107, the main CPU 71 executes a determined items storing process (F108). In the determined items storing process, the items determined in various random determinations in the mystery feature process are stored in a storage unit such as the RAM 73. The thus stored items are referred to in the effect contents determination process, the symbol display control process, the payout amount determination process, and the like in the main control process (see FIG. 61) and in the free game process (see FIG. 64, which will be described later). Then the main CPU 71 terminates the present routine.

(Bonus Choice Process)

Figure 63:
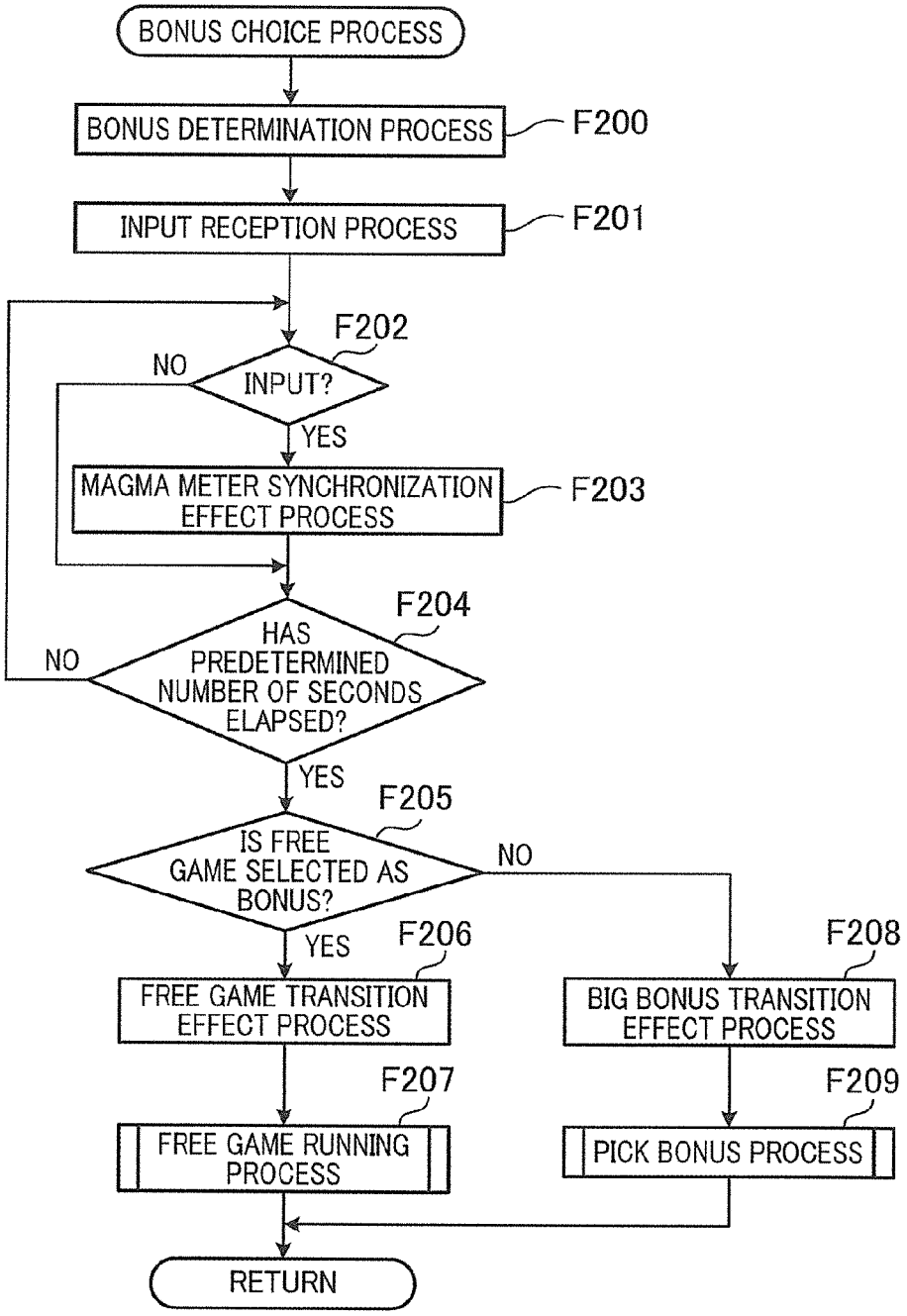
FIG. 63 is a flowchart of a bonus choice process.

Now, with reference to FIG. 63, a specific description will be given for the bonus choice process executed in step S21 in the main control process (see FIG. 61).

To begin with, the main CPU 71 executes a bonus determination process (F200). In the bonus determination process, the main CPU 71 executes random determination with reference to the bonus random determination table, and determines which of the free game and the big bonus is triggered as the bonus game. Then, the main CPU 71 executes an input reception process (F201). That is, the main CPU 71 displays the mark of a handprint on the lower image display panel 141 (see FIG. 42), and starts input by the player to the touch panel 69.

Then the main CPU 71 determines whether the input by the player has been received (F202). When the input by the player to the touch panel 69 has been received (F202: YES), the main CPU 71 executes a magma meter synchronization effect process (F203). In the magma meter synchronization effect process, an effect in which the bar on the magma meter grows upward along with the input by the player is provided, and the growth of the bar on the magma meter is limited in accordance with the type of the bonus game determined in the step F200.

When the input by the player is not received in step F202 (F202: NO), or after the magma meter synchronization effect process in the step F203 is completed, the main CPU 71 determines whether a predetermined number of seconds have elapsed (F204). When the predetermined number of seconds have not elapsed (F204: NO), the main CPU 71 returns the processing back to step F202, to keep the state for receiving the input by the player.

Meanwhile, when the predetermined number of seconds have elapsed (F204: YES), the main CPU 71 determines whether the free game is selected as the bonus game in step F200 (F205). When the free game is selected as the bonus game (F205: YES), the main CPU 71 executes a free game transition effect process (F206). That is, the main CPU 71 displays the display screen described with reference to FIG. 44 to FIG. 47. Then, the main CPU 71 executes the free game process (F207), and terminates this routine.

When the free game is not selected as the bonus game (F205: NO), the main CPU 71 executes a big bonus transition effect process (F208). That is, the main CPU 71 displays the display screen described with reference to FIG. 48 to FIG. 51. Then, the main CPU 71 executes a pick bonus process (F209), and terminates this routine.

(Free Game Process)

Figure 64:
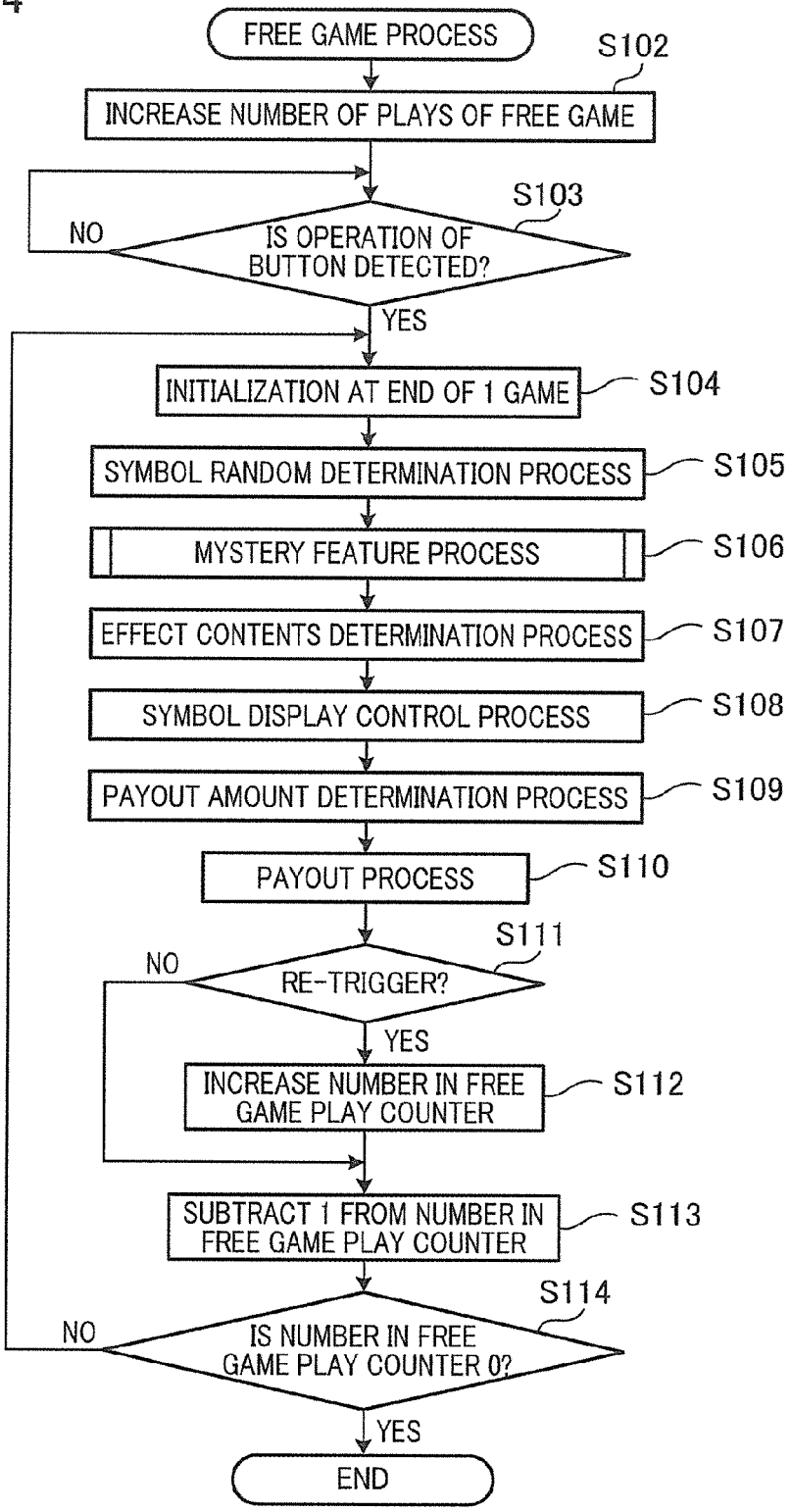
FIG. 64 is a flowchart of a free game process.

Now, with reference to FIG. 64, a specific description will be given for free game process executed in step F207 in the bonus choice process (see FIG. 63).

First, the main CPU 71 sets a predetermined number of plays of the free game (eight in the present embodiment) in the free game play counter in the RAM 73 (S102).

Then, the main CPU 71 determines whether an operation of a button is detected (S103). The button to start the free game may be any button. When the main CPU 71 determines that the operation of a button is not detected (S103: NO), the main CPU 71 waits the operation. This step may be arranged such that the processing goes to the next step after it is determined, based on measurement of time, that a predetermined period of time has elapsed.

Meanwhile, when the main CPU 71 determines that the operation of a button is detected (S103: YES), the main CPU 71 executes an initializing process at the end of each play of the game, in the same way as in the main control process (S104). Subsequently, the main CPU 71 performs a symbol random determination process similar to that in the main control process (S105).

Then, the main CPU 71 executes the mystery feature process (S106) which has been described with reference to FIG. 62. In this mystery feature process, the tables for the free game are referred to.

Then, the main CPU 71 executes an effect contents determination process (S107) similarly to that in the main control process. Then, the main CPU 71 executes a symbol display control process (S108) similarly to that in the main control process. Then, the main CPU 71 executes a payout amount determination process (S109) similarly to that in the main control process.

Then, the main CPU 71 executes a payout process (S110). In the payout process, the main CPU 71 adds the amount of the payout awarded in the payout amount determination process in S108 to the value stored in the free game payout counter. The free game payout counter is an area for storing the total of the payout amounts determined in the free game. After the free game process is completed, the main CPU 71 adds the value stored in the free game payout counter to the value stored in the credit counter provided in the RAM 73. That is, the total sum of the payout amounts determined in the free game is collectively paid out.

Subsequently, the main CPU 71 determines whether the re-trigger condition has been satisfied (S111). In the present embodiment, the re-trigger condition is that three or more bonus symbols 504 are stopped irrespective of the active lines. When the main CPU 71 determines that the re-trigger condition has been satisfied (S111: YES), the main CPU 71 adds a predetermined number (8 in the present embodiment) to the number of plays of the free game already stored in the free game play counter in the RAM 73, and updated the stored number (S112).

When the main CPU 71 determines that the re-trigger condition has not been satisfied (S111: NO), or after the process of S112, the main CPU 71 subtracts 1 from the value stored in the free game play counter (S113).

Then, the main CPU 71 determines whether the value stored in the free game play counter is 0 (S114). When the main CPU 71 determines that the value stored in the free game play counter is not 0 (S114: NO), the processing returns back to step S104.

Meanwhile, when it is determined that the value stored in the free game play counter is 0 (S114: YES), the free game process ends.

(Big Bonus)

Now, a description will be given for the various tables, programs, and display screens related to the big bonus executed by the slot machine 1.

(Challenge Trigger Table)

Referring to FIG. 65, a challenge trigger table will be described. The challenge trigger table is referred to in the pick bonus process which will be described later. In the challenge trigger table, the probability of winning the challenge (Triggered) and the probability of losing the challenge (Not Triggered) are defined for each current bet value. If the challenge is won, a pick bonus challenge table having a higher expected value for the payout than that of a pick bonus normal table is referred to in the random determination to associate the options with the payout types in the later-described pick bonus process.

To be more specific, as shown in FIG. 65, when the current bet value is 1, the probability of winning the challenge is 1/1000, while the probability of losing the challenge is 999/1000. When the current bet value is 2, the probability of winning the challenge is 2/1000, while the probability of losing the challenge is 998/1000. When the current bet value is 3, the probability of winning the challenge is 3/1000, while the probability of losing the challenge is 997/1000. When the current bet value is 5, the probability of winning the challenge is 5/1000, while the probability of losing the challenge is 995/1000. When the current bet value is 10, the probability of winning the challenge is 10/1000, while the probability of losing the challenge is 990/1000. When the current bet is MAX BET, the probability of winning the challenge is 20/1000, while the probability of losing the challenge is 980/1000.

(Pick Bonus Normal Table)

Referring to FIG. 66, the pick bonus normal table will be described. The pick bonus normal table is referred to in the random determination to associate the options with the payout types in the later-described pick bonus process when the challenge is lost in the challenge random determination process which will be described later. In this pick bonus normal table, the payout types and the number of options 601 associated with each type are defined. There are 29 options, which will be described later.

To be more specific, there are following payout types: "PROG_2" (level 2 of progressive payout), "PROG_3" (level 3 of progressive payout), "PROG_4" (level 4 of progressive payout), "PROG_5" (level 5 of progressive payout), "PROG_6" (level 6 of progressive payout), "LV9 1000 credits", "LV8 750 credits", "LV7 500 credits", "LV6 400 credits", "LV5 300 credits", "LV4 250 credits", "LV3 200 credits", "LV2 150 credits", and "LV1 100 credits". Each of these types is associated with two of the 29 options 601. The option associated with the payout type "WILD" can substitute for any of the options of other payout types. The payout type "WILD" is associated with one of the 29 options 601. Consequently, the payout types are associated with the 29 options 601.

(Pick Bonus Challenge Table)

Referring to FIG. 67, the pick bonus challenge table will be described. The pick bonus challenge table is referred to in the random determination to associate the options with the payout types in the later-described pick bonus process when the challenge is won in the challenge random determination process which will be described later. In this pick bonus challenge table, the payout types and the number of options 601 associated with each type are defined. There are 29 options, which will be described later.

To be more specific, there are following payout types: "PROG_1" (level 1 of progressive payout), "PROG_2" (level 2 of progressive payout), "PROG_3" (level 3 of progressive payout), "PROG_4" (level 4 of progressive payout), "PROG_5" (level 5 of progressive payout), "PROG_6" (level 6 of progressive payout), "LV9 1200 credits", "LV8 750 credits", "LV7 500 credits", "LV6 400 credits", "LV5 300 credits", "LV4 250 credits", "LV3 200 credits", and "LV2 150 credits". Each of these types is associated with two of the 29 options 601. The option associated with the payout type "WILD" can substitute for any of the options of other payout types. The payout type "WILD" is associated with one of the 29 options 601. Consequently, the payout types are associated with the 29 options 601.

In the pick bonus challenge table, the payout type "LV1 100 credits" in the pick bonus normal table is replaced by "PROG_1" (level 1 of progressive payout). In addition, the payout amount of "LV9" is increased from "1000 credits" to "1200 credits". Thus, the pick bonus challenge table is set to have an expected value for the payout higher than that of the pick bonus normal table. Because of this, if the challenge is won in the later-described challenge random determination process, the game progress advantageous for the player is provided.

(Pick Bonus Process)

Figure 68:
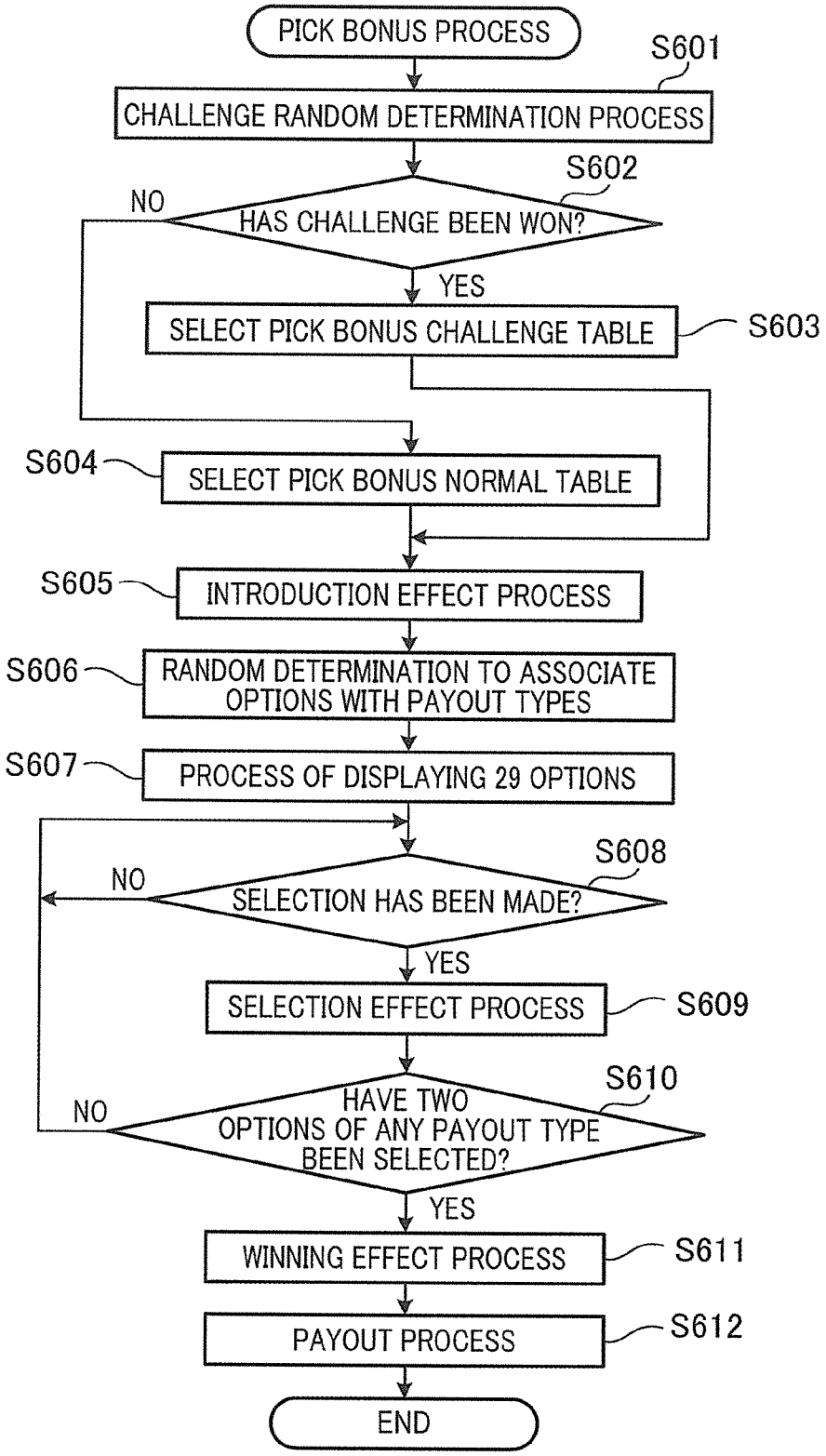
FIG. 68 is a flowchart of a pick bonus process.

Now, with reference to FIG. 68, a description will be given for the pick bonus process executed in step F209 in the bonus choice process (see FIG. 63).

To begin with, the main CPU 71 executes the challenge random determination process (S601). In the challenge random determination process, it is determined whether the challenge is won through random determination, based on the challenge trigger table and the current bet value. Then, the main CPU 71 determines whether or not the challenge has been won (S602).

When the challenge has been won (S602: YES), the pick bonus challenge table is selected (S603) as the table referred to in the later-described random determination to associate the options with the payout types (S606).

Meanwhile, when the challenge has not been won (S602: NO), the pick bonus normal table is selected (S604) as the table referred to in the later-described random determination to associate the options with the payout types (S606).

Figure 69:
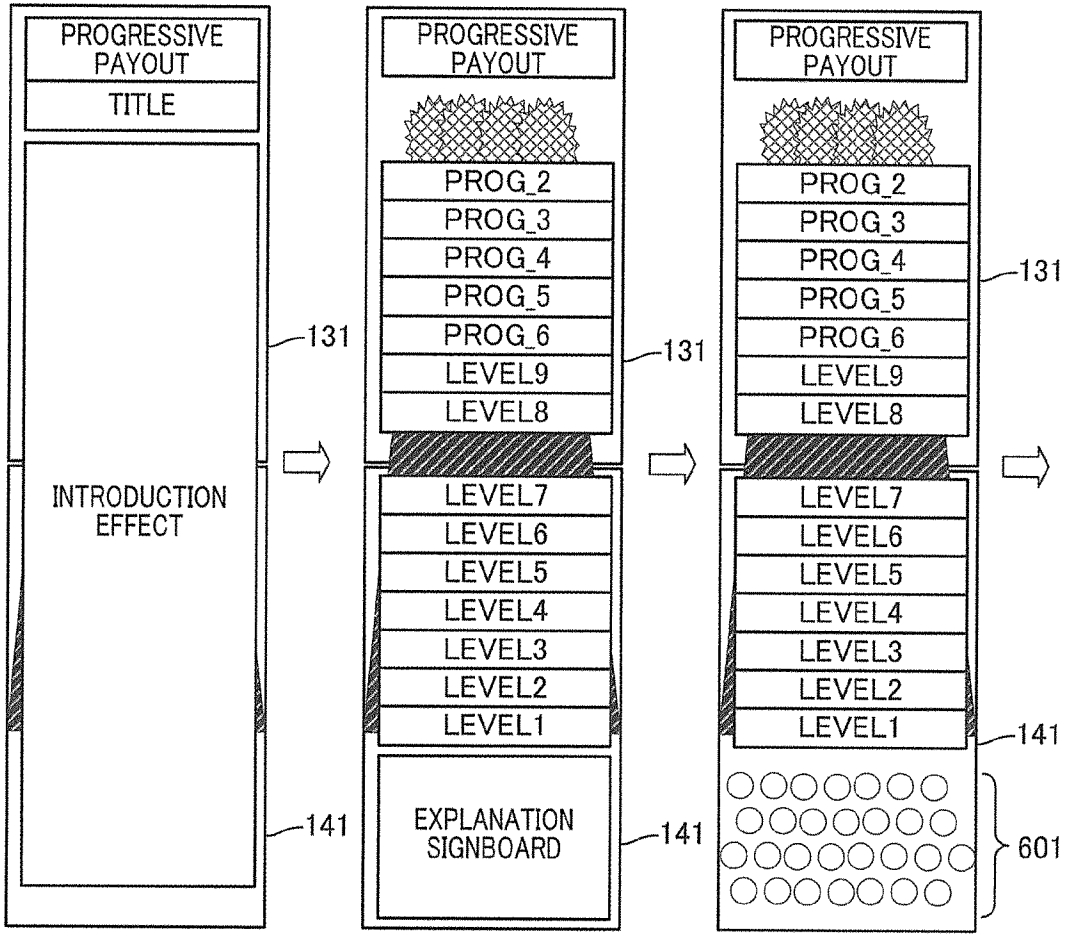
FIG. 69 is an explanatory diagram of an example display screen in a big bonus.

After the process of S603 or the process of S604, the main CPU 71 executes an introduction effect process (S605). In the introduction effect process, as shown in FIG. 69, an introduction effect image reporting the execution of the pick bonus is displayed on the upper image display panel 131 and the lower image display panel 141. Then, on a lower portion of the lower image display panel 141, there is displayed an explanation signboard explaining the contents of the pick bonus game. Further, on the upper image display panel 131 and the lower image display panel 141, there are displayed the payout types corresponding to the table determined in S603 or S604 (the pick bonus challenge table or the pick bonus normal table).

Figure 78:
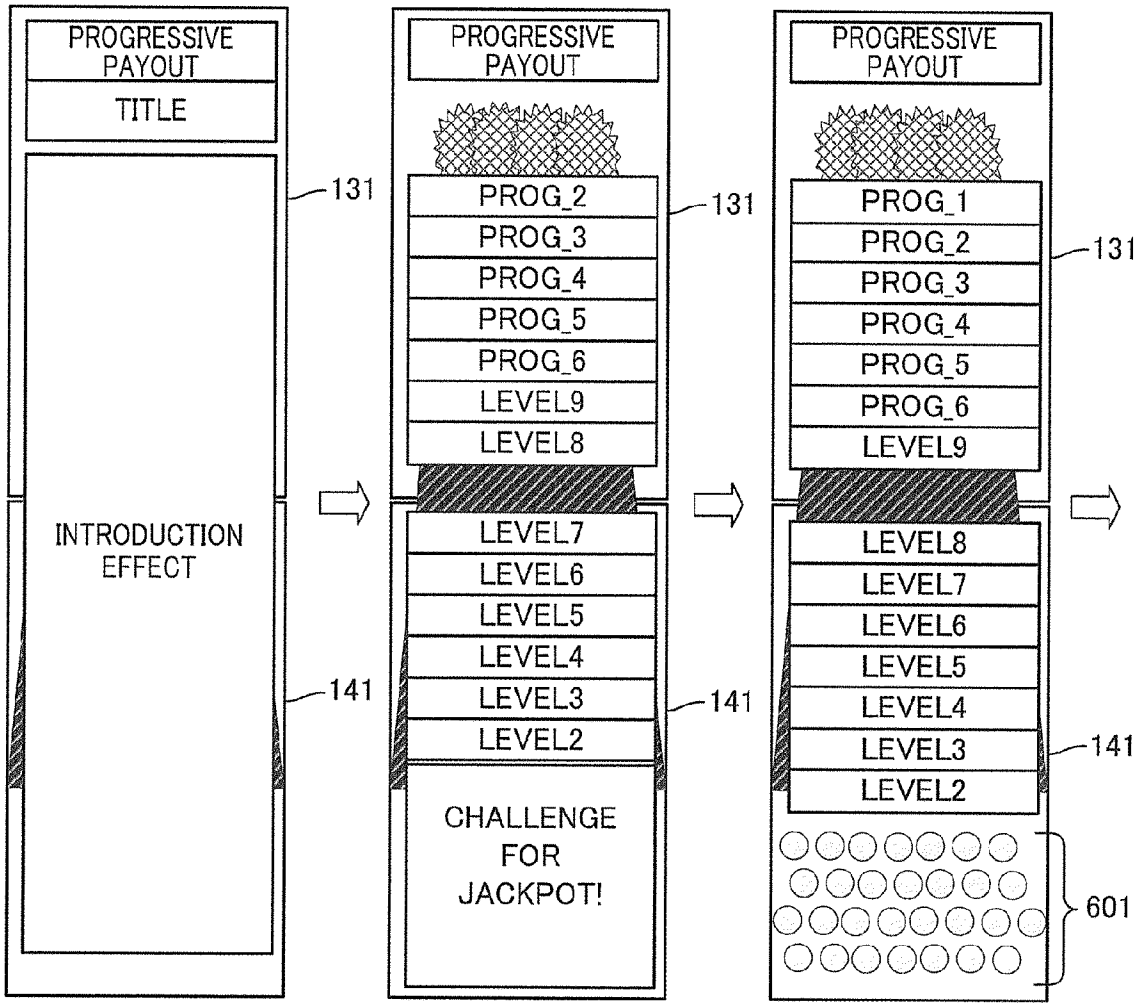
FIG. 78 is an explanatory diagram of an example display screen in the big bonus.

When the pick bonus normal table has been selected in step S604, as shown in FIG. 69, the payout types corresponding to the pick bonus normal table are displayed (see FIG. 66). Meanwhile, when the pick bonus challenge table has been selected in step S603, as shown in FIG. 78, a message reporting the winning of the challenge ("CHALLENGE FOR JACKPOT!") is displayed, and the payout types corresponding the pick bonus challenge table are displayed (see FIG. 67).

Then, the main CPU 71 executes the random determination to associate the options with the payout types (S606). In the random determination to associate the options with the payout types, based on the table selected in S603 or S604 (the pick bonus challenge table or the pick bonus normal table), the 29 options 601 are associated with the payout types, through random determination. Then, as shown in FIG. 69, the 29 options 601 thus associated with the payout types in the process in S606 are displayed on the lower portion of the lower image display panel 141. Further, on the lower image display panel 141, there is displayed a signboard to encourage the player to select any of the options 601.

Then, the main CPU 71 determines whether any of the 29 options 601 displayed on the lower image display panel 141 has been selected (S608). When no option is selected (S608: NO), the main CPU 71 waits for the selection.

Figure 70:
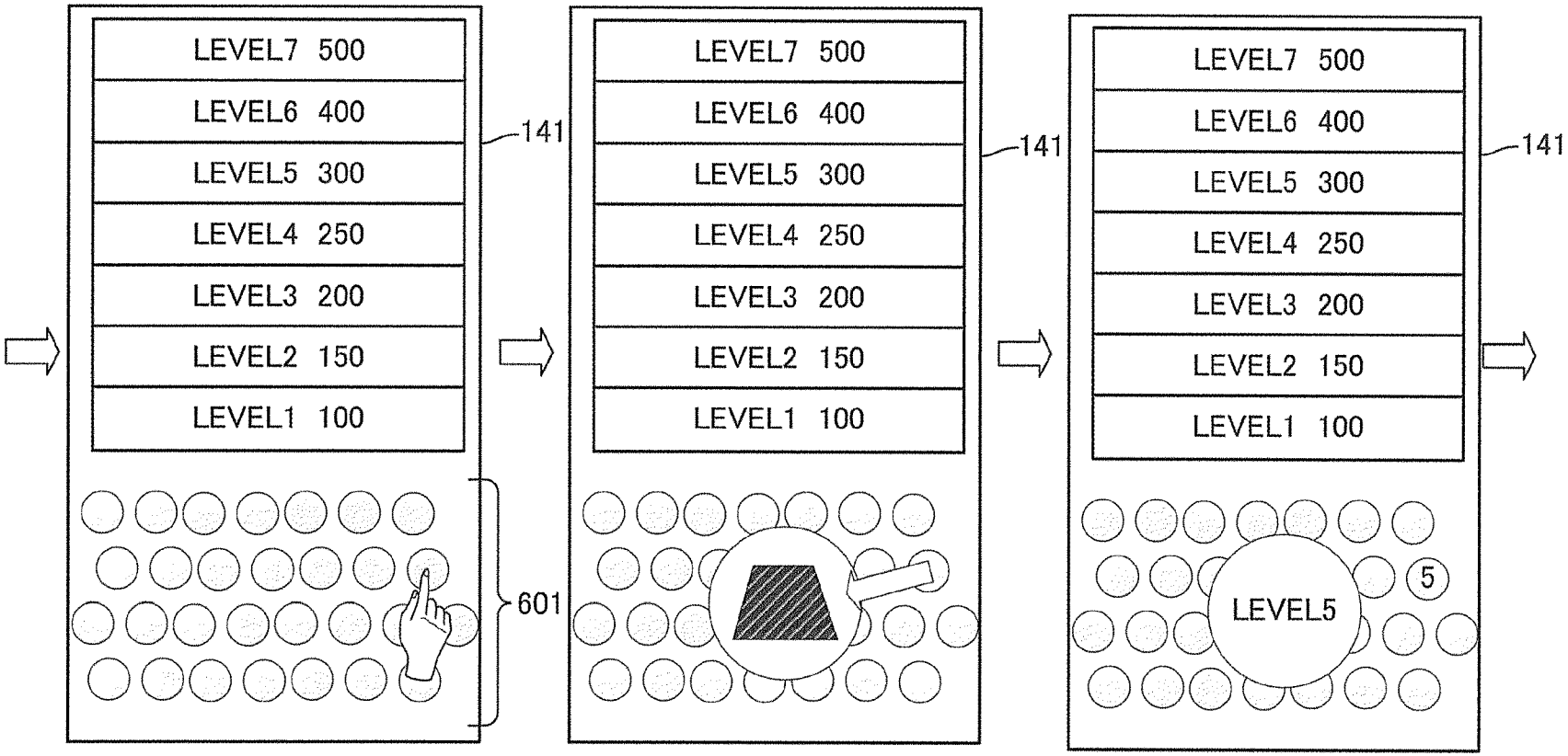
FIG. 70 is an explanatory diagram of an example display screen in the big bonus.
Figure 71:
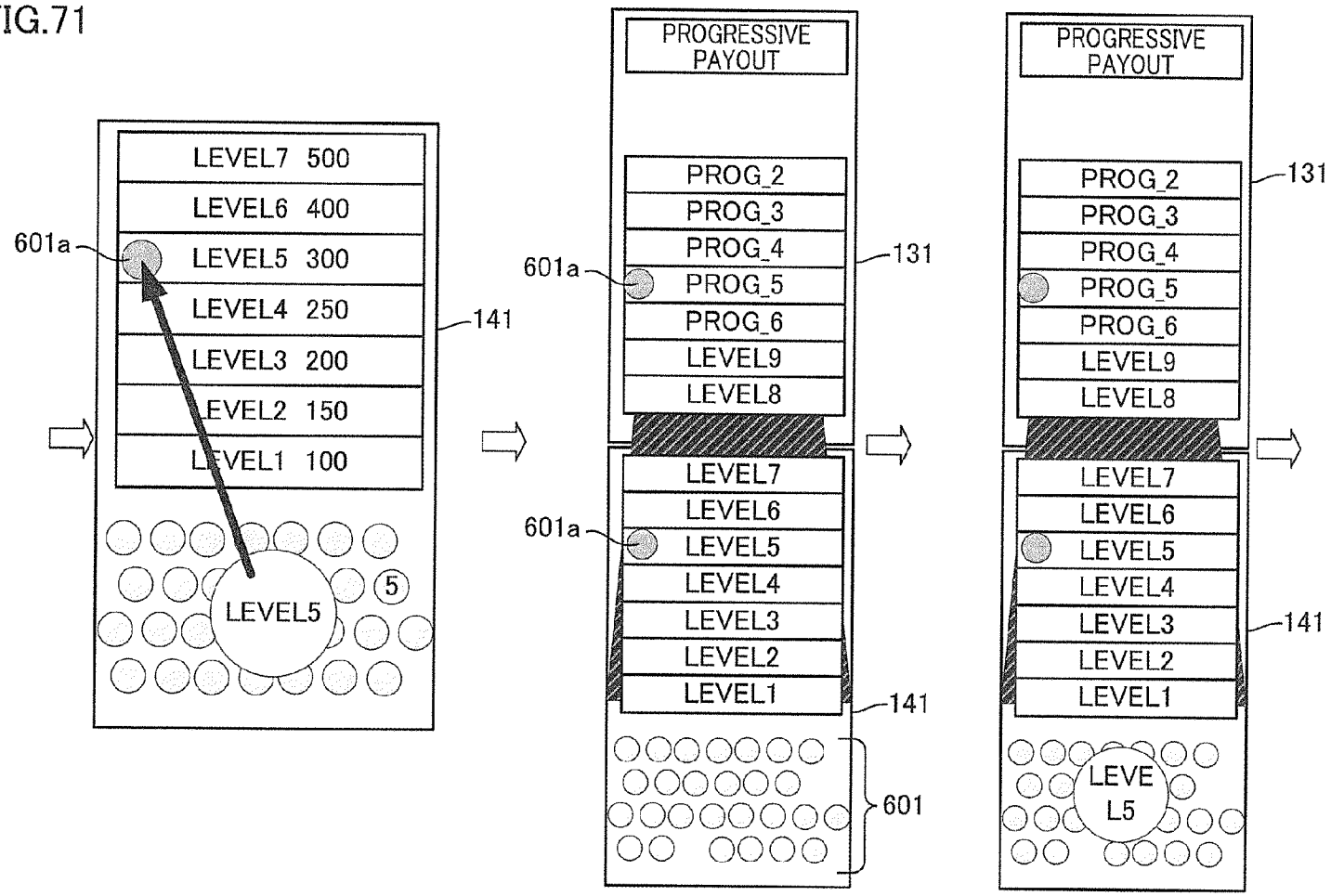
FIG. 71 is an explanatory diagram of an example display screen in the big bonus.
Figure 75:
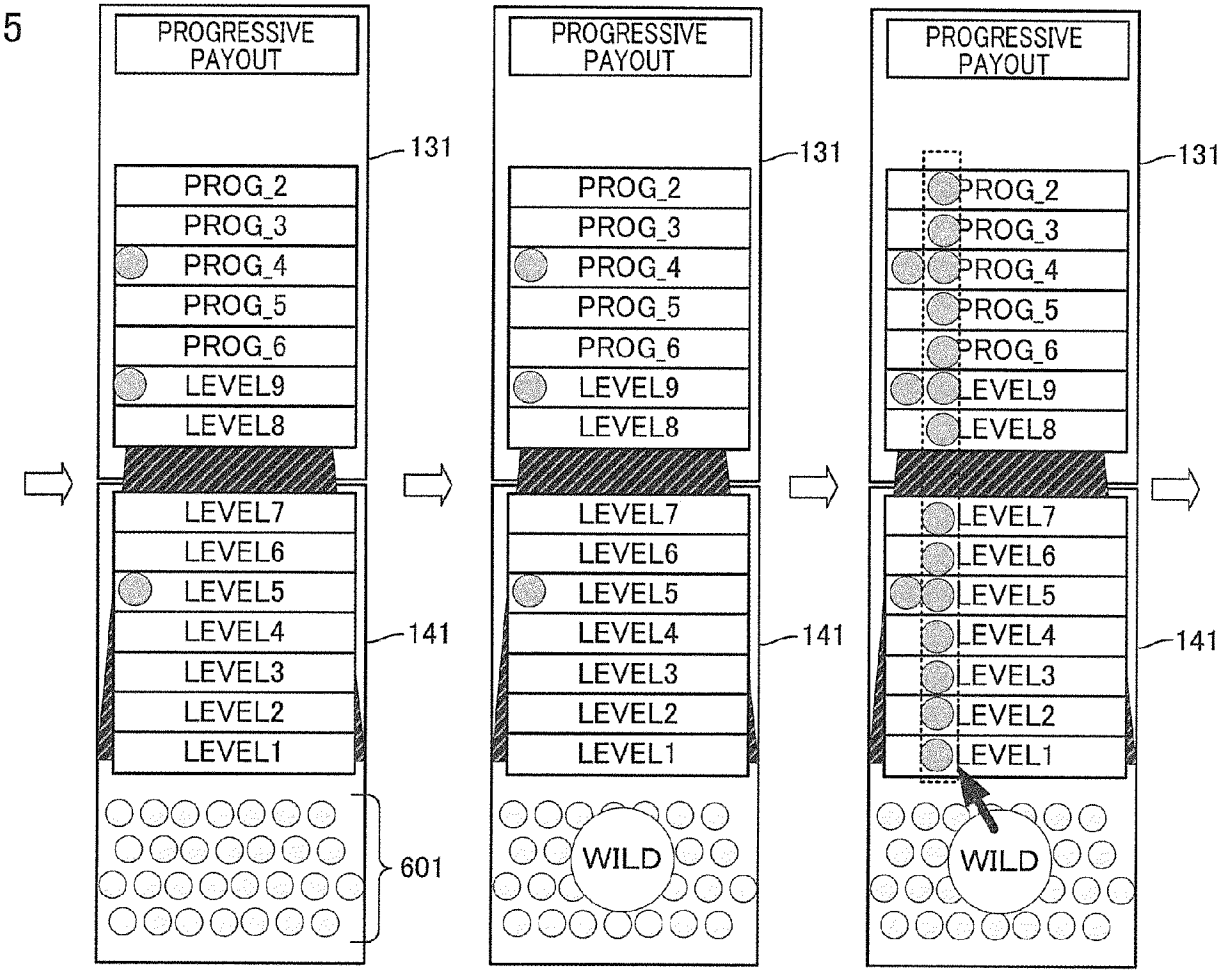
FIG. 75 is an explanatory diagram of an example display screen in the big bonus.

When any of the 29 options 601 has been selected (S608: YES), the main CPU 71 executes a selection effect process (S609). In the selection effect process, as shown in FIG. 70, the option selected from the 29 options 601 is moved to the center and enlarged, and the payout type associated with the selected option 601 is displayed. For example, if the selected option 601 is associated with the payout type of "LV5 300 credits", the message of "LEVEL 5" is displayed, as shown in FIG. 70. Subsequently, there is provided an effect in which an icon 601*a* of the selected option 601 is moved to the field of the payout type displayed on the lower image display panel 141. For example, as shown in FIG. 71, if the selected option 601 is associated with "LV5 300 credits", the icon 601*a* of the selected option 601 is moved to the field of the "LEVEL 5 300" displayed on the lower image display panel 141. Note that, if the selected option 601 is associated with "WILD", as shown in FIG. 75, icons 601*a* corresponding to the selected option 601 are moved to all the fields of the payout type on the lower image display panel 141.

Then, the main CPU 71 determines whether the number of selected options 601 of any payout type becomes two (S610). In the present embodiment, the first time the number of the options 601 of the same payout type becomes two, the payout amount corresponding to the options 601 is awarded.

When the number of selected options 601 of any payout type is not two (S610: NO), the processing returns back to step S608. For example, as shown in FIG. 71, suppose there is one icon 601*a* in the field of "LEVELS 300" on the lower image display panel 141, and there is one icon 601*a* in the field of "PROG_5". In this case, there are not two icons 601*a* in any of the fields of the payout type. Therefore, the processing returns back to step S608, and the player is further encouraged to select one option 601 from the 27 options 601 (see FIG. 71).

Meanwhile, two options of a payout type have been selected (S610: YES), a winning effect process is executed (S611). In this winning effect process, an effect of reporting the won payout amount is displayed.

Figure 72:
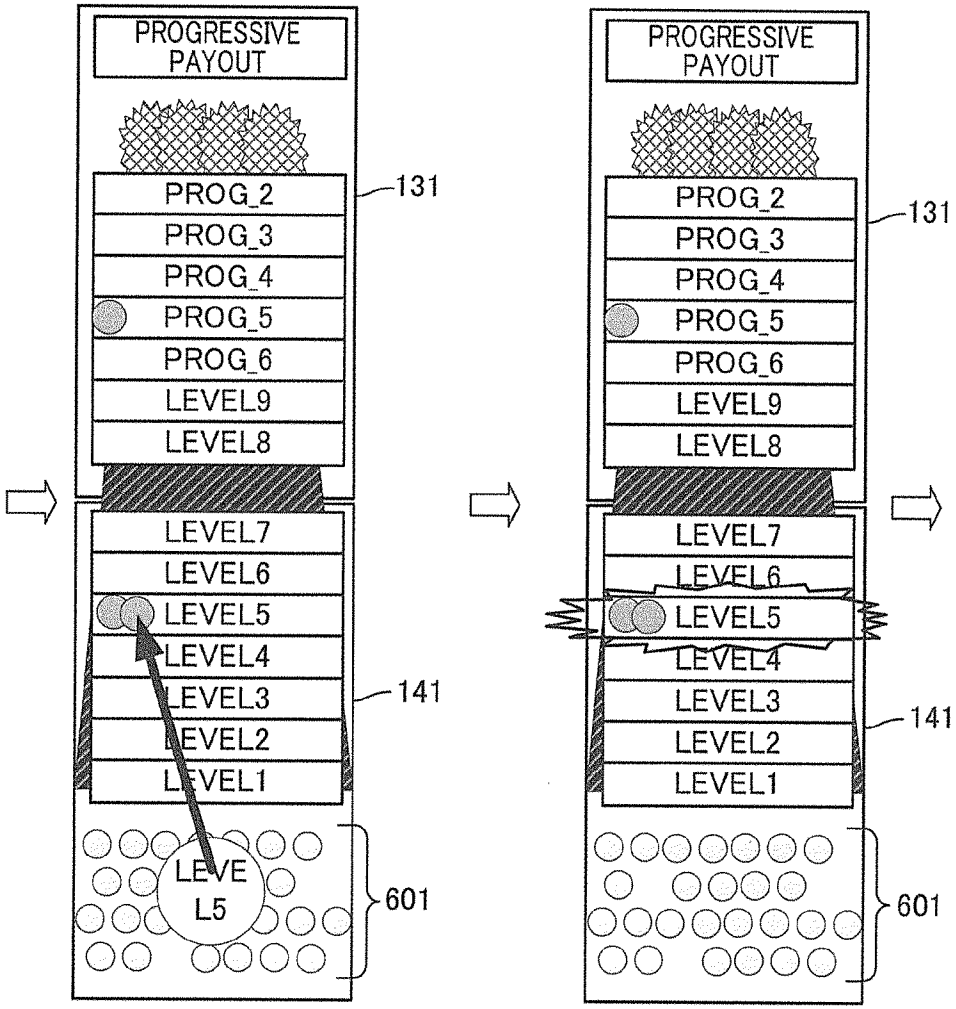
FIG. 72 is an explanatory diagram of an example display screen in the big bonus.
Figure 73:
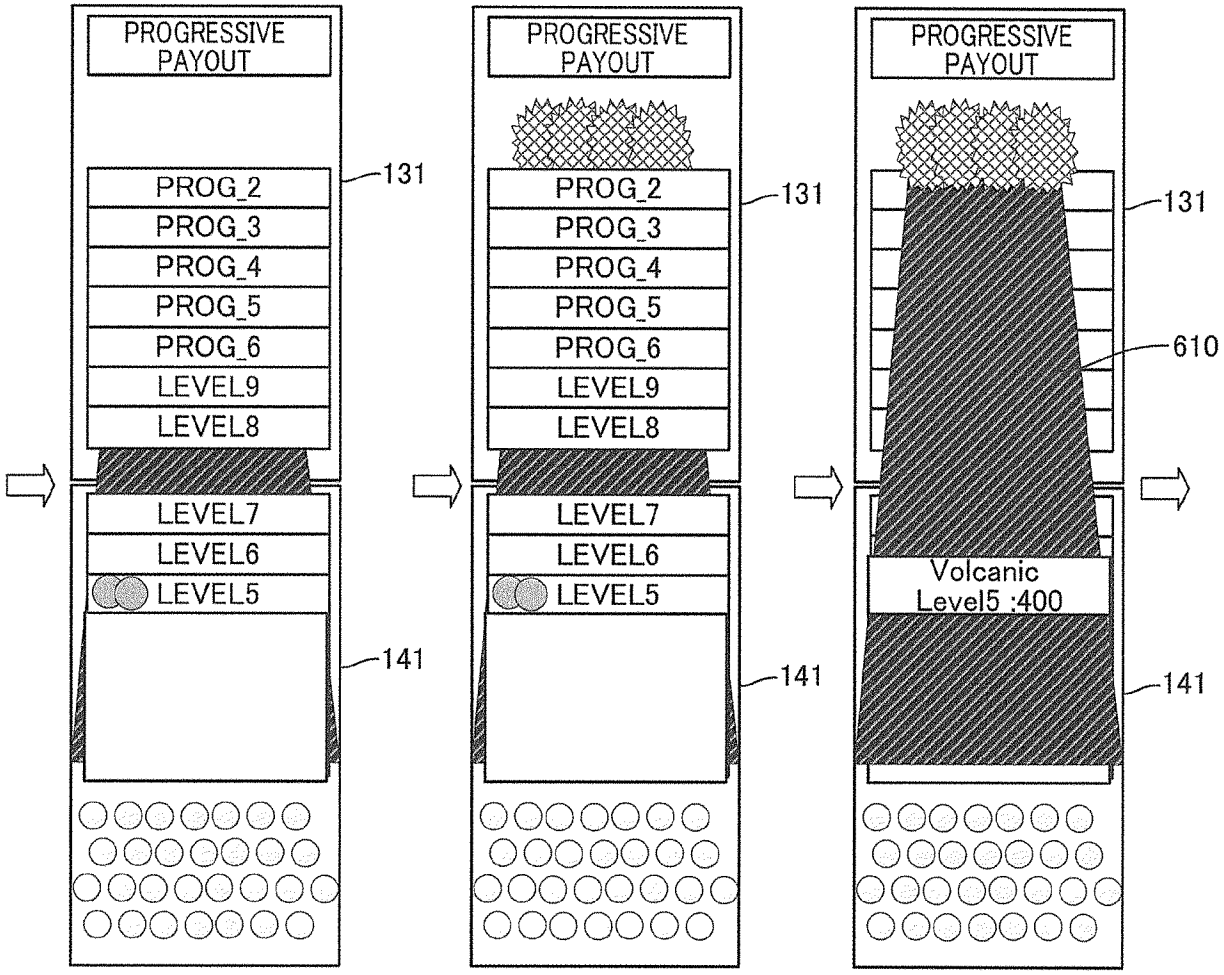
FIG. 73 is an explanatory diagram of an example display screen in the big bonus.
Figure 74:
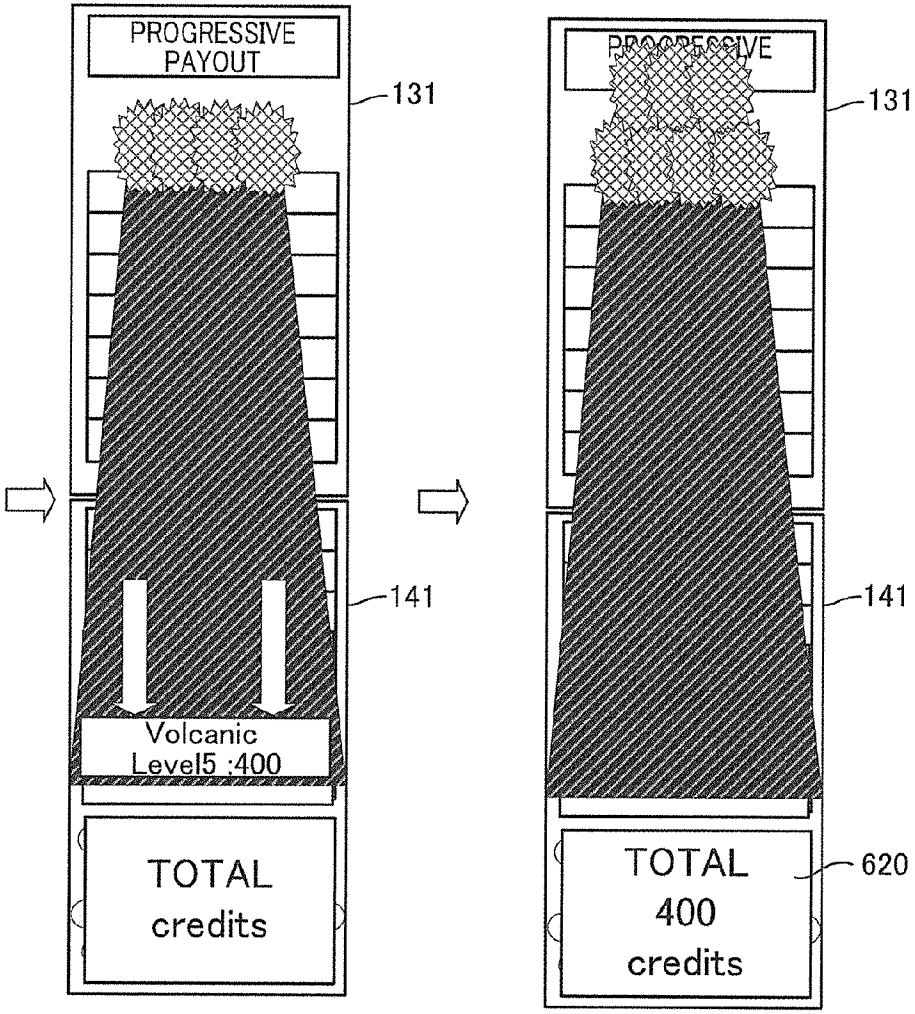
FIG. 74 is an explanatory diagram of an example display screen in the big bonus.

For example, as shown in FIG. 72, when two icons 601*a* are put in the field of "LEVEL 5 300" on the lower image display panel 141, the field of "LEVEL 5 300" on the lower image display panel 141 blinks, to report that the payout of "LV5 300 credits" has been won. Then, as shown in FIG. 73, there is provided an effect in which the fields of the payout types other than the field of the won payout type are hidden on the lower image display panel 141. Then, an effect in which a volcano 610 erupts is displayed on the upper image display panel 131 and the lower image display panel 141. Further, as shown in FIG. 74, there is provided an effect in which the notification of the won payout amount moves downward with magma generated by the eruption of the volcano 610. Finally, the won payout amount is displayed on a signboard 620.

Figure 76:
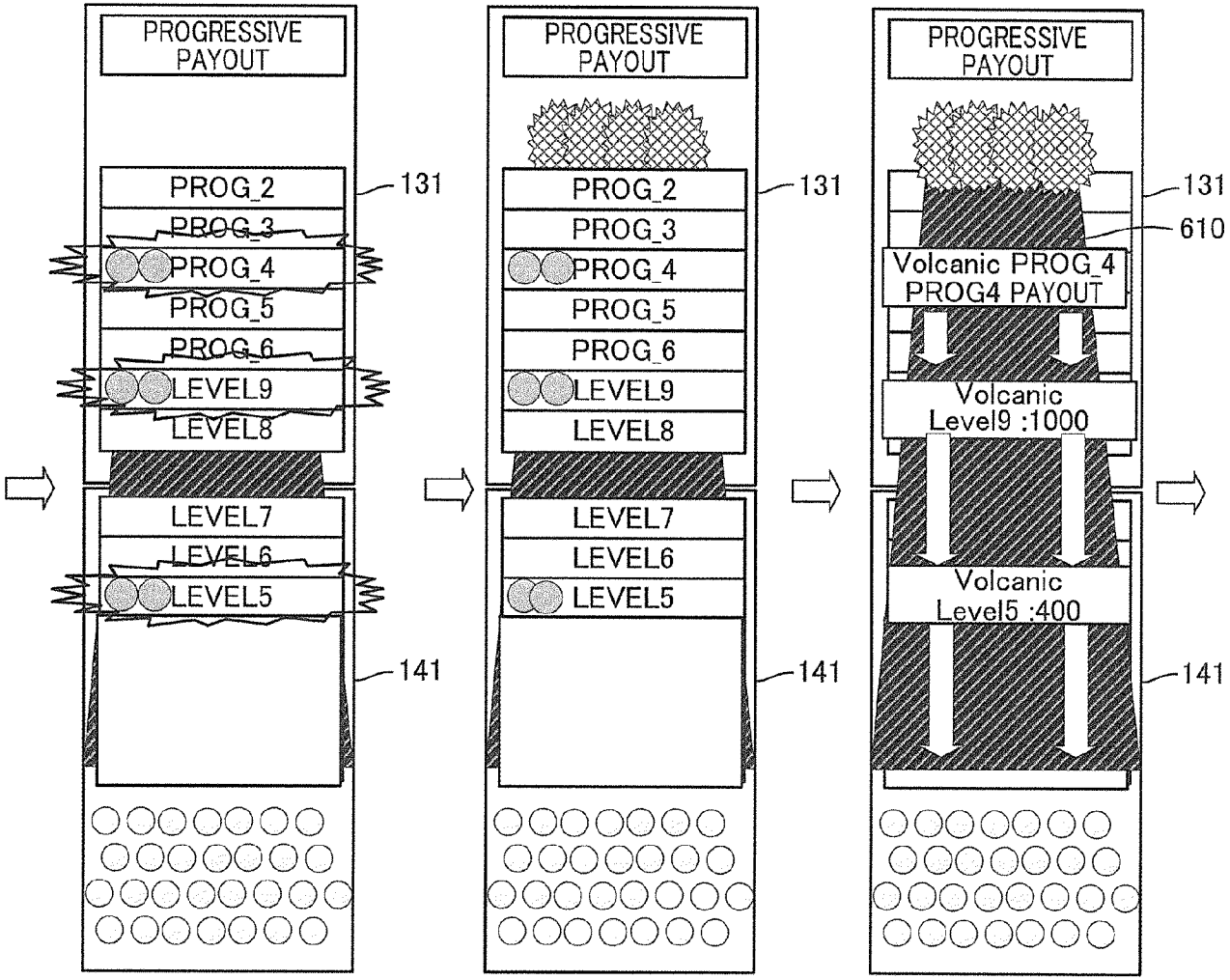
FIG. 76 is an explanatory diagram of an example display screen in the big bonus.
Figure 77:
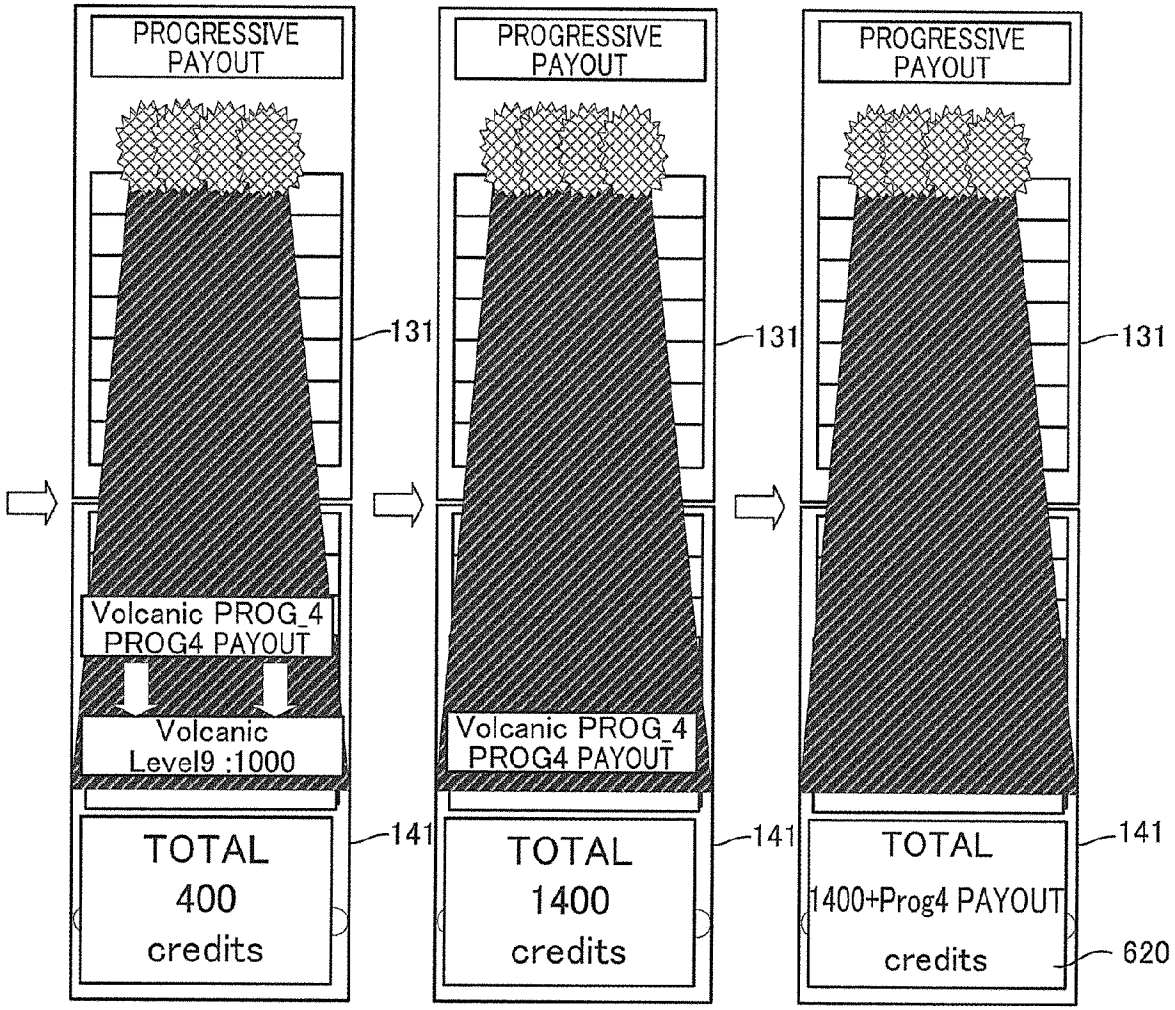
FIG. 77 is an explanatory diagram of an example display screen in the big bonus.

For example, as shown in FIG. 76, if the selected option 601 corresponds to "WILD" and this causes simultaneous winnings of "PROG_4" (level 4 of progressive payout), "LV9 1000 credits", "LV5 300 credits", the fields of "PROG_4", "LEVEL 9", and "LEVEL 5" blink. Then, as shown in FIG. 76, there is provided an effect in which the fields of the payout types other than the fields of the won payout types are hidden on the lower image display panel 141. Thereafter, an effect in which the volcano 610 erupts is displayed on the upper image display panel 131 and the lower image display panel 141. Further, as shown in FIG. 77, there is provided an effect in which the notifications of the won payout amounts move downward with magma generated by the eruption of the volcano 610. Finally, the won payout amounts are displayed on the signboard 620.

Then, the main CPU 71 executes a payout process (S612). In this payout process, the won payout amount is awarded. That is, the won payout amount is added to the value stored in the credit counter provided in the RAM 73. Then, the present routine ends.

(Progressive) A description will be given for the payouts at Level 10 to Level 15 awarded in the big bonus (PICK BONUS).

(Progressive Payout Initial Value Table)

Referring to FIG. 79, a progressive payout initial value table will be described. In the progressive payout initial value table, the initial values of the progressive payouts of Progressive 1 to Progressive 6 are defined. Progressive 1 corresponds to the big bonus payout at Level 15 displayed on the grand progressive value display unit 1309 (see FIG. 18). Progressive 2 corresponds to the big bonus payout at Level 14 displayed on the progressive value display unit 1311 (see FIG. 18). Progressive 3 corresponds to the big bonus payout at Level 13 displayed on the progressive value display unit 1311. Progressive 4 corresponds to the big bonus payout at Level 12 displayed on the progressive value display unit 1311. Progressive 5 corresponds to the big bonus payout at Level 11 displayed on the progressive value display unit 1311. Progressive 6 corresponds to the big bonus payout at Level 10 displayed on the progressive value display unit 1311. The progressive payouts respectively having the initial values set in the table increase as the player makes a bet. Out of these initial values of the progressive payouts, only the initial value of Progressive 1 is changeable by changing the setting (SC01 to SC04).

(Fixed Jackpot Payout Table)

Referring to FIG. 80, a fixed jackpot payout table will be described. In the fixed jackpot payout table, fixed amount of payouts are associated with each of Progressive 1 to Progressive 6. That is, the amount of the big bonus payout is the sum of the amount of the above-described progressive payout and the amount of the fixed payout defined in the fixed jackpot payout table.

(Progressive Increment Rate Table)

Referring to FIG. 81, a progressive increment rate table will be described. In the progressive increment rate table, progressive increment rates are set for each of Progressive 1 to Progressive 6. A certain percentage of the player's bet amount, which is determined according to the rates in the progressive increment rate table, is added to each progressive payout. The progressive increment rate table may include multiple types of settings which respectively have different rates, so that one of the settings can be selected to be used.

(Progressive Upper Limit Table)

Referring to FIG. 82, a progressive upper limit table will be described. In the progressive upper limit table, there are defined the upper limits of the progressive payouts, each of which is increased as a result of the increment.

(Overview of the Invention)

The slot machine 1 functioning as the gaming machine of the present invention includes: the lower image display panel 141 including the plurality of video reels 151 to 155 and being configured so that the symbol arrays each of which is constituted by arranged symbols 501 are variably displayed on the video reels 151 to 155 respectively, and then some of the symbols 501 of the symbol arrays are respectively rearranged, on a one to one basis, in the plurality of display blocks 28 arranged in a matrix of M columns by N rows on the video reels 151 to 155; and a controller formed by the main CPU 71 and the like, the controller being configured to execute a game and to control the symbol display device so that the symbols 501 are rearranged in accordance with the game, the controller configured to execute the following steps of: determining whether a predetermined condition is satisfied before the rearrangement of the symbols 501; when the predetermined condition is not satisfied, setting a plurality of active lines in the symbol display area 150 defined by the display blocks 28 in the matrix of M columns by N rows, each of the active lines being a combination of display blocks 28 made by selecting one block from the blocks in each of the video reels 151 to 155; when the predetermined condition is satisfied, adding further display blocks 28 to the blocks in the symbol display area 150 to form a matrix of blocks of M columns by N+α rows, and setting, in the expanded symbol display area 150, additional active lines, the number of which is calculated by multiplying the number of the added rows, α, by a predetermined value; and when a combination of a predetermined number of more of the symbols 501 of a kind is achieved on any of the active lines, awarding a line payout in accordance with the type of the achieved combination of the symbols 501.

In the above arrangement, one or more rows of the display blocks 28 are able to be added to the display blocks 28 arranged in the matrix. Per each additional row, the additional active lines, the number of which is equal to the predetermined value, are set. With this, the number of the active lines is increased, which allows the gaming machine to provide new gaming characteristics: the number of the active lines is changeable to vary the winning probability.

In the slot machine 1 functioning as the gaming machine of the present invention, the controller may set the active lines in the matrix of the blocks (display blocks 28) of M columns by N+α rows arranged in the display frame (symbol display area 150), by adding the additional active lines, the number of which is equal to the predetermined value, to the active lines in the matrix of the blocks (display blocks 28) of M columns by N+α−1 rows arranged in the display frame (symbol display area 150).

In the above arrangement, the difference between the active lines in the matrix of M columns by N+α rows and those in the matrix of M columns by N+α−1 rows is the additional active lines of the predetermined value only (the differential), and all the remaining active lines in the matrix of M columns by N+α rows are identical with those in the matrix of M columns by N+α−1 rows. With this, when the number of the rows is increased and the number of the active lines is increased, there is a possibility that the active lines easily understandable are provided to the player.

The slot machine 1 functioning as the gaming machine of the present invention includes: the lower image display panel 141 including the plurality of video reels 151 to 155 and being configured so that symbol arrays each of which is constituted by arranged symbols 501 including the wild symbols 505 capable of substituting for other type of symbols 501 are variably displayed on the video reels 151 to 155 respectively, and then some of the symbols 501 of the symbol arrays are respectively rearranged, on a one to one basis, in the plurality of display blocks 28 arranged in a matrix on the video reels 151 to 155; and a controller formed by the main CPU 71 and the like, the controller being configured to execute a game and to control the lower image display panel 141 so that the symbols 501 are rearranged in accordance with the game, the controller configured to execute the following steps of: setting a plurality of active lines in the symbol display area 150 defined by the plurality of display blocks 28, each of the active lines being a combination of the display blocks 28 made by selecting one block from the blocks in each of the video reels 151 to 155; when a combination of a predetermined number of more of the symbols 501 of a kind is achieved on any of the active lines, awarding a line payout in accordance with the type of the combination of the symbols 501; determining whether a predetermined condition is satisfied before the rearrangement of the symbols 501; when the predetermined condition is satisfied, selecting one of the display blocks 28 in each row in accordance with a predetermined pattern, and setting each selected display block 28 as a change block 28*a*, in which predetermined pattern, if the display block 28 in the mth column is selected in the nth row, the display block 28 in the (m−1)th column, the mth column, or the (m+1)th column is selected in the (n+1)th row; providing a magma effect in a column progression direction on an area of each change block 28*a* after the rearrangement of the symbols 501, and then providing an effect of changing the symbol in every change block 28*a* to the wild symbol 505; and treating the symbols 501 rearranged in each change block 28*a* as the wild symbols 505 in determination for the line payout.

In the above arrangement, when the predetermined condition is satisfied, the effect is provided on the change block 28*a* in the nth row and mth column, and then the effect is provided on the display block 28 corresponding to the change block 28*a* in the (n+1)th row, which is selected from the blocks in the (m−1)th column, the mth column, and the (m+1)th column. Thus, the display block 28, on which the specific effect is to be provided subsequently to the specific effect on the display block 28 in the nth row, is selected from the display blocks 28 which are at the three positions on the column progression side of (below) that display block 28 in the nth row. Accordingly, the player is only required to check the display blocks 28 at these three positions, which may increase the possibility that the player easily predicts the position of the symbol to be changed to the wild symbol 505.

In the slot machine 1 functioning as the gaming machine of the present invention, the controller executes, as a game, the base game in which the symbols 501 are rearranged, and the bonus game which has an advantage over the base game, wherein: a trigger condition for triggering the bonus game is that a predetermined number or more of the bonus symbols 504 are included in the symbols 501 rearranged on the video reels 151 to 155 in the base game; and when the bonus symbol 504 is rearranged in the display block 28 selected as the change block 28*a* in the base game, this bonus symbol 504 is treated as the wild symbol 505 in determination for the line payout, and treated as the bonus symbol 504 in determination for the trigger condition.

In the above arrangement, when the display block 28, where the bonus symbol 504 which can satisfy the trigger condition for the bonus game having an advantage over the base game is to be rearranged, is selected as the change block 28*a*, the symbol in this block is treated as the wild symbol 505 in the determination for the line payout, while the symbol in this block is treated as the bonus symbol 504 in the determination for the trigger condition. With this, when the bonus symbol 504 is rearranged in the change block 28*a*, the symbol keeps the function as the wild symbol 505, without losing the function as the bonus symbol 504 to trigger the bonus game having an advantageous over the base game.

Embodiments of the present invention thus described above solely serve as specific examples of the present invention, and are not to limit the scope of the present invention. The specific structures and the like are suitably modifiable. Further, the effects described in the embodiments of the present invention described in the above embodiment are no more than examples of preferable effects brought about by the present invention, and the effects of the present invention are not limited to those described hereinabove.

Further, the detailed description above is mainly focused on characteristics of the present invention to fore the sake of easier understanding. The present invention is not limited to the above embodiments, and is applicable to diversity of other embodiments. Further, the terms and phraseology used in the present specification are adopted solely to provide specific illustration of the present invention, and in no case should the scope of the present invention be limited by such terms and phraseology. Further, it will be obvious for those skilled in the art that the other structures, systems, methods or the like are possible, within the spirit of the present invention described in this specification. The description of claims therefore shall encompass structures equivalent to the present invention, unless otherwise such structures are regarded as to depart from the spirit and scope of the present invention. Further, the abstract is provided to allow, through a simple investigation, quick analysis of the technical features and essences of the present invention by an intellectual property office, a general public institution, or one skilled in the art who is not fully familiarized with patent and legal or professional terminology. It is therefore not an intention of the abstract to limit the scope of the present invention which shall be construed on the basis of the description of the claims. To fully understand the object and effects of the present invention, it is strongly encouraged to sufficiently refer to disclosures of documents already made available.

The detailed description of the present invention provided hereinabove includes a process executed on a computer. The above descriptions and expressions are provided to allow the one skilled in the art to most efficiently understand the present invention. A process performed in or by respective steps yielding one result or blocks with a predetermined processing function described in the present specification shall be understood as a process with no self-contradiction. Further, the electrical or magnetic signal is transmitted/received and written in the respective steps or blocks. It should be noted that such a signal is expressed in the form of bit, value, symbol, text, terms, number, or the like solely for the sake of convenience. Although the present specification occasionally personifies the processes carried out in the steps or blocks, these processes are essentially executed by various devices. Further, the other structures necessary for the steps or blocks are obvious from the above descriptions.

What is claimed is:

1. Gaming machine comprising:

a symbol display device including a plurality of variable display areas and being configured so that symbol arrays each of which is constituted by arranged symbols are variably displayed in the variable display areas respectively, and then some of the symbols of the symbol arrays are respectively rearranged, on a one to one basis, in a plurality of blocks arranged in a matrix of M columns by N rows in the plurality of variable display areas; and a controller configured to execute a game and to control the symbol display device so that the symbols are rearranged in accordance with the game, the controller configured to execute the following steps of:

accepting, via a game medium acceptor, a game medium with a monetary value which establishes a credit balance for the player;

receiving, via a bet input device, a bet whose amount is designated by the player based on the credit balance;

executing a game as a result of the player's bet;

determining whether a predetermined condition is satisfied before the rearrangement of the symbols;

when the predetermined condition is not satisfied, setting a plurality of active lines in a display frame defined by the blocks in the matrix of M columns by N rows, each of the active lines being a combination of blocks made by selecting one block from the blocks in each of the variable display areas;

when the predetermined condition is satisfied, adding blocks to the blocks in the display frame to form a matrix of blocks of M columns by N+α rows, and setting, in the expanded display frame, additional active lines, the number of which is calculated by multiplying the number of the added rows, α , by a predetermined value; and when a combination of a predetermined number of more of the symbols of a kind is achieved on any of the active lines, awarding a line payout in accordance with the type of the combination achieved, wherein the controller randomly determines whether the predetermined condition is satisfied, based on a window number random determination table in which each of row numbers is associated with a corresponding one of weights, and wherein the controller determines that the predetermined condition is not satisfied when the row number randomly determined based on the weights indicates N rows.

2. A gaming machine comprising:

a symbol display device including a plurality of variable display areas and being configured so that symbol arrays each of which is constituted by arranged symbols are variably displayed in the variable display areas respectively, and then some of the symbols of the symbol arrays are respectively rearranged, on a one to one basis, in a plurality of blocks arranged in a matrix of M columns by N rows in the plurality of variable display areas; and a controller configured to execute a game and to control the symbol display device so that the symbols are rearranged in accordance with the game, the controller configured to execute the following steps of:

accepting, via a game medium acceptor, a game medium with a monetary value which establishes a credit balance for the player;

receiving, via a bet input device, a bet whose amount is designated by the player based on the credit balance;

executing a game as a result of the player's bet;

determining whether a predetermined condition is satisfied before the rearrangement of the symbols;

when the predetermined condition is not satisfied, setting a plurality of active lines in a display frame defined by the blocks in the matrix of M columns by N rows, each of the active lines being a combination of blocks made by selecting one block from the blocks in each of the variable display areas;

when the predetermined condition is satisfied, adding blocks to the blocks in the display frame to form a matrix of blocks of M columns by N+α rows, and setting, in the expanded display frame, additional active lines, the number of which is calculated by multiplying the number of the added rows, α , by a predetermined value; and when a combination of a predetermined number of more of the symbols of a kind is achieved on any of the active lines, awarding a line payout in accordance with the type of the combination achieved, wherein the controller sets the active lines in the matrix of the blocks of M columns by N+α rows arranged in the display frame by adding the additional active lines, the number of which is equal to the predetermined value, to the active lines in the matrix of the blocks of M columns by N+α−1 rows arranged in the display frame.

3. The gaming machine according to claim 1, wherein the number of the added rows is determined by a number of rows which the row number randomly determined based on the weights indicates.

4. The gaming machine according to claim 1, wherein the additional active lines includes first additional active lines formed by the (N+α−1)-th row and second additional active lines formed by the (N+α)-th row, and wherein the second additional active lines are arranged in the matrix of blocks of M columns by N+α rows in the same manner as the first additional active lines are arranged in the matrix of blocks of M columns by (N+α−1) rows.

5. The gaming machine according to claim 1, wherein when a basic active line set including a plurality of first additional active lines formed by M columns by K rows exists, additional active line set candidates including a plurality of second additional active lines are generated by shifting the first additional active lines by one row, and wherein third additional active lines are selected from the additional active line set candidates by excluding additional active lines overlapped with the first additional active lines from the additional active line set candidates such that an active line set including the first additional active lines and the third additional active lines are formed by M columns by (K+1) rows.

6. The gaming machine according to claim 2, wherein the controller randomly determines whether the predetermined condition is satisfied, based on a window number random determination table in which each of row numbers to be is associated with a corresponding one of weights, and wherein the controller determines that the predetermined condition is not satisfied when the row number randomly determined based on the weights indicates N rows.

7. The gaming machine according to claim 6, wherein the number of the added rows is determined by a number of rows which the row number randomly determined based on the weights indicates.

8. The gaming machine according to claim 2, wherein the additional active lines includes first additional active lines formed by the $(N+\alpha-1)$-th row and second additional active lines formed by the $(N+\alpha)$-th row, and wherein the second additional active lines are arranged in the matrix of blocks of M columns by $N+\alpha$ rows in the same manner as the first additional active lines are arranged in the matrix of blocks of M columns by $(N+\alpha-1)$ rows.

9. The gaming machine according to claim 2, wherein when a basic active line set including a plurality of first additional active lines formed by M columns by K rows exists, additional active line set candidates including a plurality of second additional active lines are generated by shifting the first additional active lines by one row, and wherein third additional active lines are selected from the additional active line set candidates by excluding additional active lines overlapped with the first additional active lines from the additional active line set candidates such that an active line set including the first additional active lines and the third additional active lines are formed by M columns by (K+1) rows.

* * * * *